US009590307B2

(12) United States Patent
Matsumura et al.

(10) Patent No.: US 9,590,307 B2
(45) Date of Patent: Mar. 7, 2017

(54) ANTENNA APPARATUS

(71) Applicant: FUJITSU LIMITED, Kawasaki-shi, Kanagawa (JP)

(72) Inventors: Takayoshi Matsumura, Yokohama (JP); Manabu Kai, Yokohama (JP); Andrey S. Andrenko, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 173 days.

(21) Appl. No.: 14/590,582

(22) Filed: Jan. 6, 2015

(65) Prior Publication Data

US 2015/0200461 A1 Jul. 16, 2015

(30) Foreign Application Priority Data

Jan. 16, 2014 (JP) ..... 2014-006071

(51) Int. Cl.
*H01Q 9/04* (2006.01)

(52) U.S. Cl.
CPC ..... *H01Q 9/0407* (2013.01)

(58) Field of Classification Search
CPC ..... H01Q 9/0407
USPC ..... 343/700 MS, 843
See application file for complete search history.

(56) References Cited

U.S. PATENT DOCUMENTS 4,063,245 A * 12/1977 James ..... H01Q 1/38 343/700 MS
4,554,549 A * 11/1985 Fassett ..... H01Q 9/0457 343/700 MS
5,006,858 A * 4/1991 Shirosaka ..... H01Q 21/08 343/700 MS
7,671,805 B2 3/2010 Yamada et al.
7,750,813 B2 7/2010 Deavours et al.
(Continued)

FOREIGN PATENT DOCUMENTS

| | | |
|---|---|---|
| JP | 2001-111330 | 4/2001 |
| JP | 2007-306438 | 11/2007 |
| JP | 2011-087296 | 4/2011 |

OTHER PUBLICATIONS

Carla R. Medeiros et al.; "RFID Smart Shelf With Confined Detection Volume at UHF", IEEE Antennas and Wireless Propagation Letters, vol. 7, 2008, pp. 773-776.
(Continued)

*Primary Examiner* — Dameon E Levi
*Assistant Examiner* — David Lotter
(74) *Attorney, Agent, or Firm* — Fujitsu Patent Center

(57) ABSTRACT

An antenna apparatus includes a ground plane, a first dielectric layer disposed on the ground plane, a conductive line having a feeding point and an open end or a short end and disposed on the first dielectric layer, a second dielectric layer disposed on the first dielectric layer, a plurality of first conductive elements disposed on the second dielectric layer so that the first conductive elements intersect with the conductive line at a plurality of first positions corresponding to nodes of a standing wave of current flowing through the conductive line, and one or more second conductive elements disposed on the second dielectric layer so that the one or more second conductive elements intersect with the conductive line at second positions corresponding to antinodes of the standing wave between the second end and the first position closest to the second end among the the first positions.

23 Claims, 32 Drawing Sheets

(56) References Cited

U.S. PATENT DOCUMENTS

2011/0090130 A1 4/2011 Choi et al.

OTHER PUBLICATIONS

A. Michel et al., "Design and Performance Analysis of a Planar Antenna for Near-Field UHF-RFID Desktop Readers", Proceedings of APMC 2012, Kaohsiung, Taiwan, Dec. 4-7, 2012, pp. 1019-1021.

* cited by examiner

ANTENNA APPARATUS

CROSS-REFERENCE TO RELATED APPLICATIONS

This patent application is based upon and claims the benefit of priority of the prior Japanese Patent Application No. 2014-006071 filed on Jan. 16, 2014, the entire contents of which are incorporated herein by reference.

FIELD

The embodiments discussed herein are related to an antenna apparatus.

BACKGROUND

Recently, Radio Frequency Identification (RFID) systems are widely used. Typically, some RFID systems utilize electromagnetic waves in a UHF band (900 MHz band) or a microwave (2.45 GHz) as a communication medium, and some RFID systems utilize a magnetic field generated by mutual induction. Among them, the RFID system utilizing electromagnetic waves in the UHF band is attracting attention since the RFID system can provide relatively long communication distance.

A micro-strip antenna is proposed as an antenna of a reader-writer which communicates with an RFID tag utilizing electromagnetic waves in the UHF band. The micro-strip antenna uses a micro-strip line as an antenna (see, for example, patent document 1 and non-patent documents 1 and 2).

There is a system which includes an antenna provided on a surface of a shelf. Merchandise to which an RFID tag is attached is arranged on the shelf. The system identifies that the merchandise is taken away from the shelf when the system becomes unable to detect the RFID tag. In such a system, it is preferable to use an antenna apparatus which can read the RFID tag attached to the merchandise provided in an area close to the surface of the antenna and can read the RFID tag over the entire surface of the shelf.

However, a communication distance of the conventional antenna is not sufficient and it is difficult to generate a uniform electric field over the entire surface of the antenna, particularly when size of the antenna becomes larger. Accordingly, it is difficult for the conventional antenna to provide uniform and sufficient communication distance.

Therefore, it is difficult to read all of the RFID tags uniformly in a case where a plurality of merchandise to which the RFID tags are attached is arranged on the shelf, in a case where the conventional antenna is used in the system as described above.

PRIOR ART REFERENCES

Patent References

[Patent Reference 1] U.S. Pat. No. 7,750,813

Non-Patent References

[Non-Patent Reference 1] Carla R. Medeiros, Jorge R. Costa, Member, IEEE, and Carlos A. Fernandes, Senior Member, IEEE "RFID Smart Shelf With Confined Detection Volume at UHF", IEEE ANTENNAS AND WIRELESS PROPAGATION LETTERS, vol. 7, pp. 773-776, 2008

[Non-Patent Reference 2] A. Michel, A. Buffi, R. Caso, P. Nepa, G. Isola and H. T. Chou "Design and Performance Analysis of a Planar Antenna for Near-Field UHF-RFID Desktop Readers", Proceeding of APMC 2012, Kaohsiung, Taiwan, Dec. 4-7, 2012

SUMMARY

According to an aspect of an embodiment, there is provided an antenna apparatus including a first dielectric layer having a rectangular shape in plan view, a ground plane configured to be disposed on a first surface of the first dielectric layer, a conductive line configured to have a first end and a second end and to be disposed on a second surface of the first dielectric layer, the first end being a feeding point, the second end being an open end or a short end connected to the ground plane, a second dielectric layer configured to have a shape corresponding to the first dielectric layer and to be disposed on the second surface of the first dielectric layer in a state where the conductive line is sandwiched between the first dielectric layer and the second dielectric layer, the second dielectric layer having a first surface facing toward the first dielectric layer and a second surface opposite to the first surface, a plurality of first conductive elements configured to be disposed on the second surface of the second dielectric layer so that the first conductive elements intersect with the conductive line at a plurality of first positions corresponding to nodes of a standing wave of current flowing through the conductive line in plan view, respectively, and one or more second conductive elements configured to be disposed on the second surface of the second dielectric layer so that the one or more second conductive elements intersect with the conductive line in plan view at one or more second positions corresponding to one or more antinodes of the standing wave between the second end and the first position which is closest to the second end among the the first positions, respectively.

The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

A description is given, with reference to the accompanying drawings, of embodiments of an antenna apparatus.

First Embodiment

Figure 1:
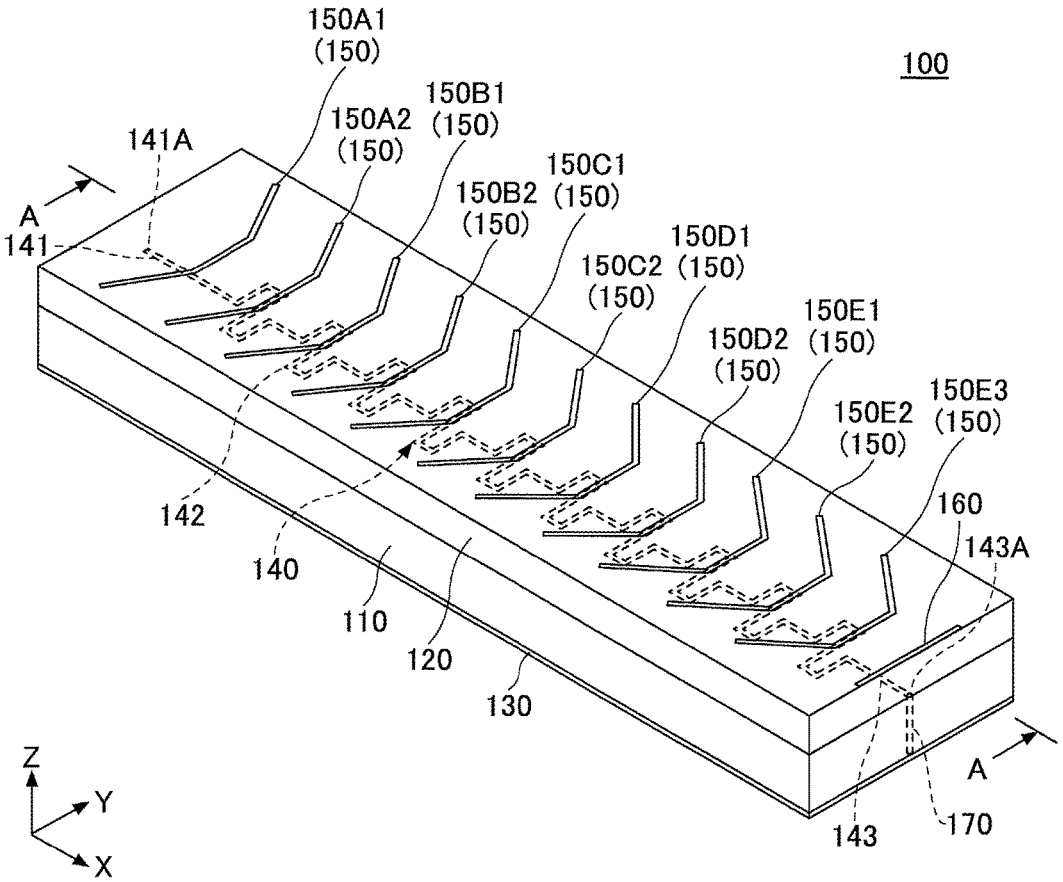
FIG. 1 is an oblique perspective diagram illustrating an antenna apparatus of a first embodiment.
Figure 2:
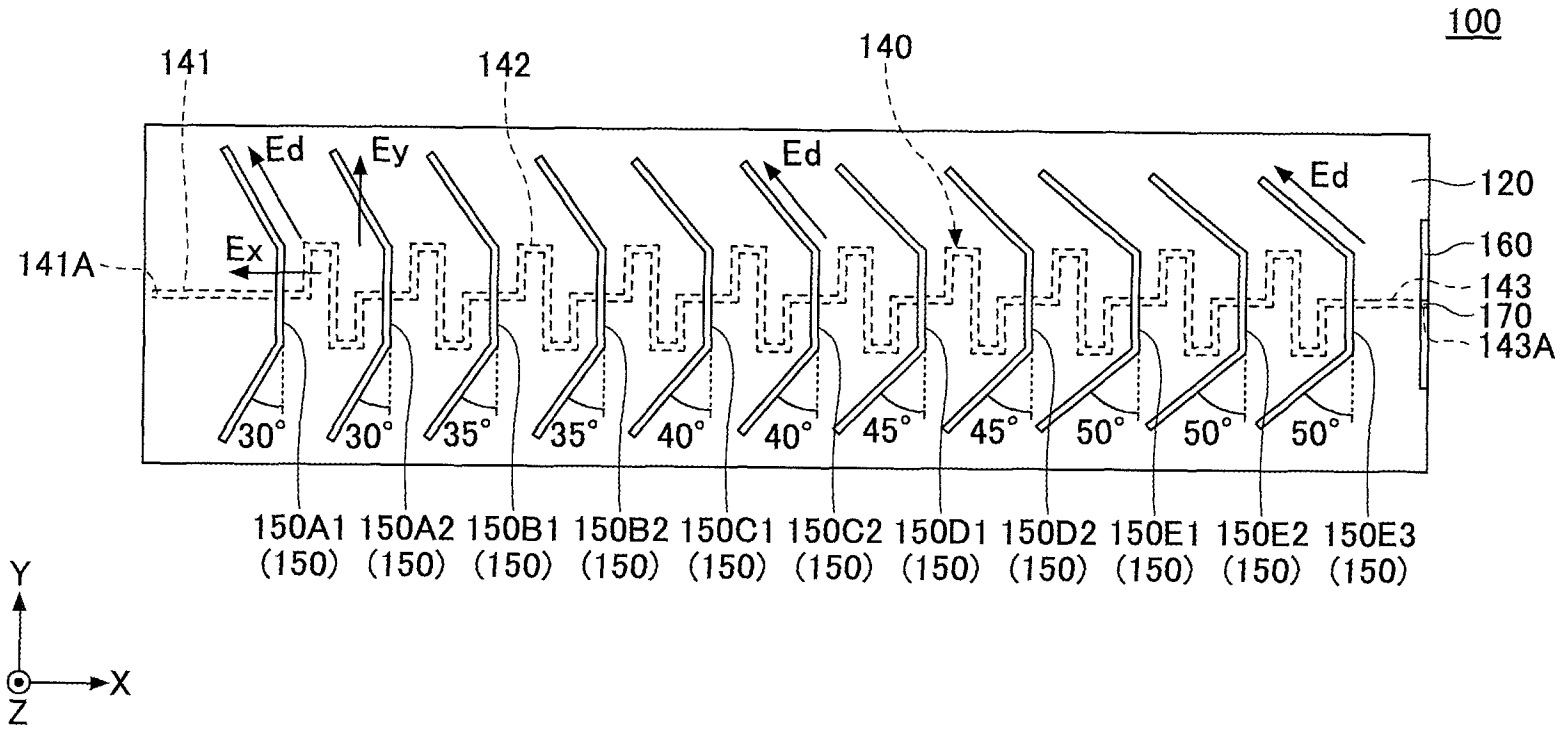
FIG. 2 is an oblique perspective diagram illustrating an antenna apparatus 100 of the first embodiment.
Figure 3:
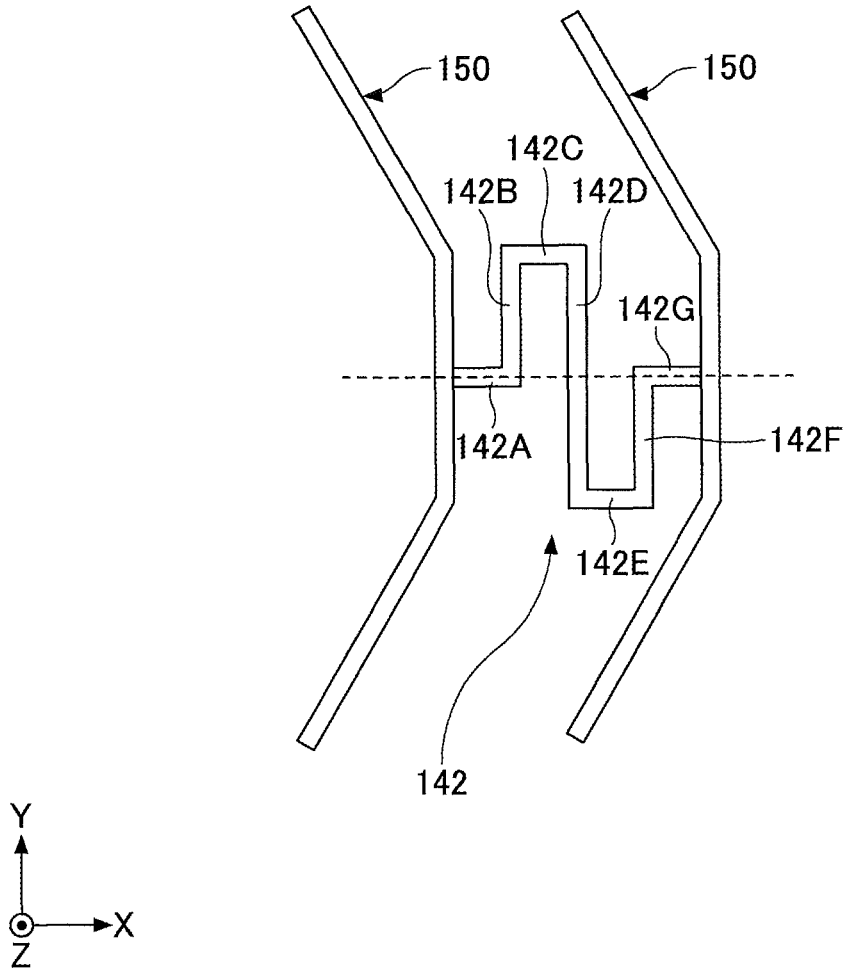
FIG. 3 is an enlarged diagram illustrating a part of the antenna apparatus.
Figure 4:
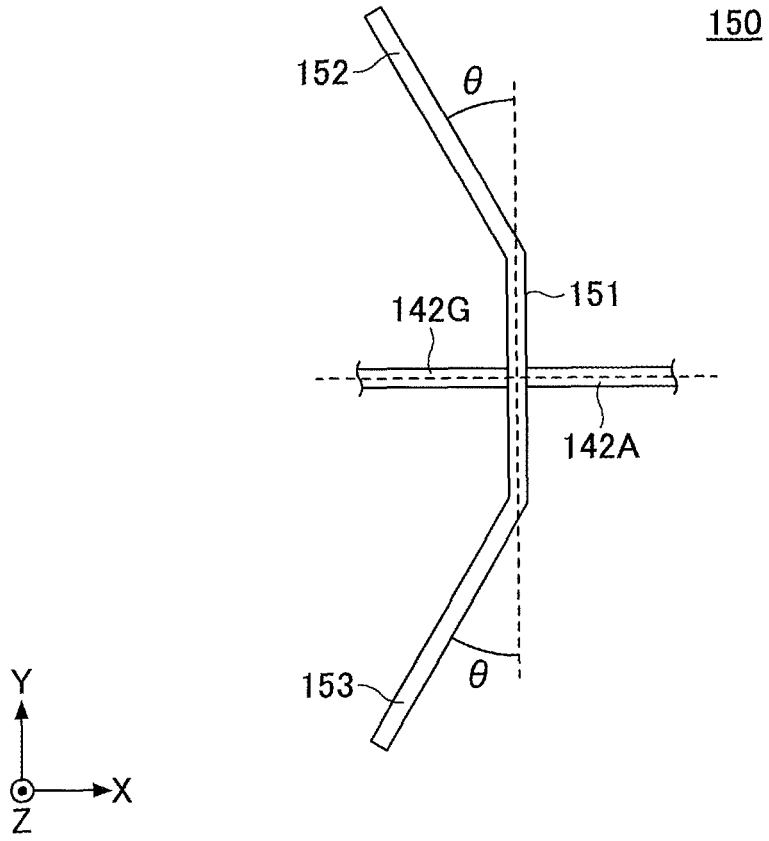
FIG. 4 is an enlarged diagram illustrating another part of the antenna apparatus.
Figure 5:
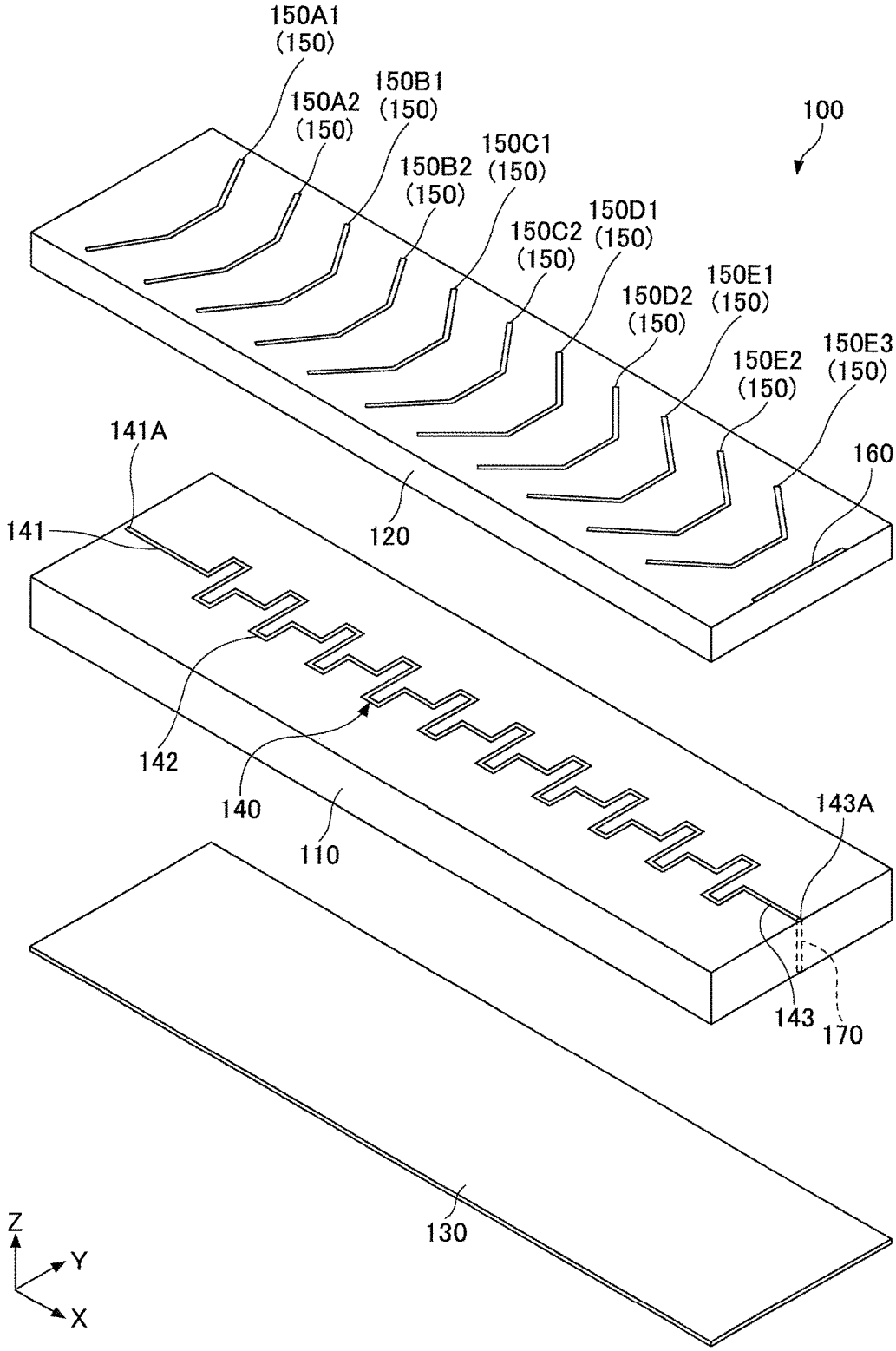
FIG. 5 is an oblique perspective exploded diagram illustrating an antenna apparatus of the first embodiment.
Figure 6:
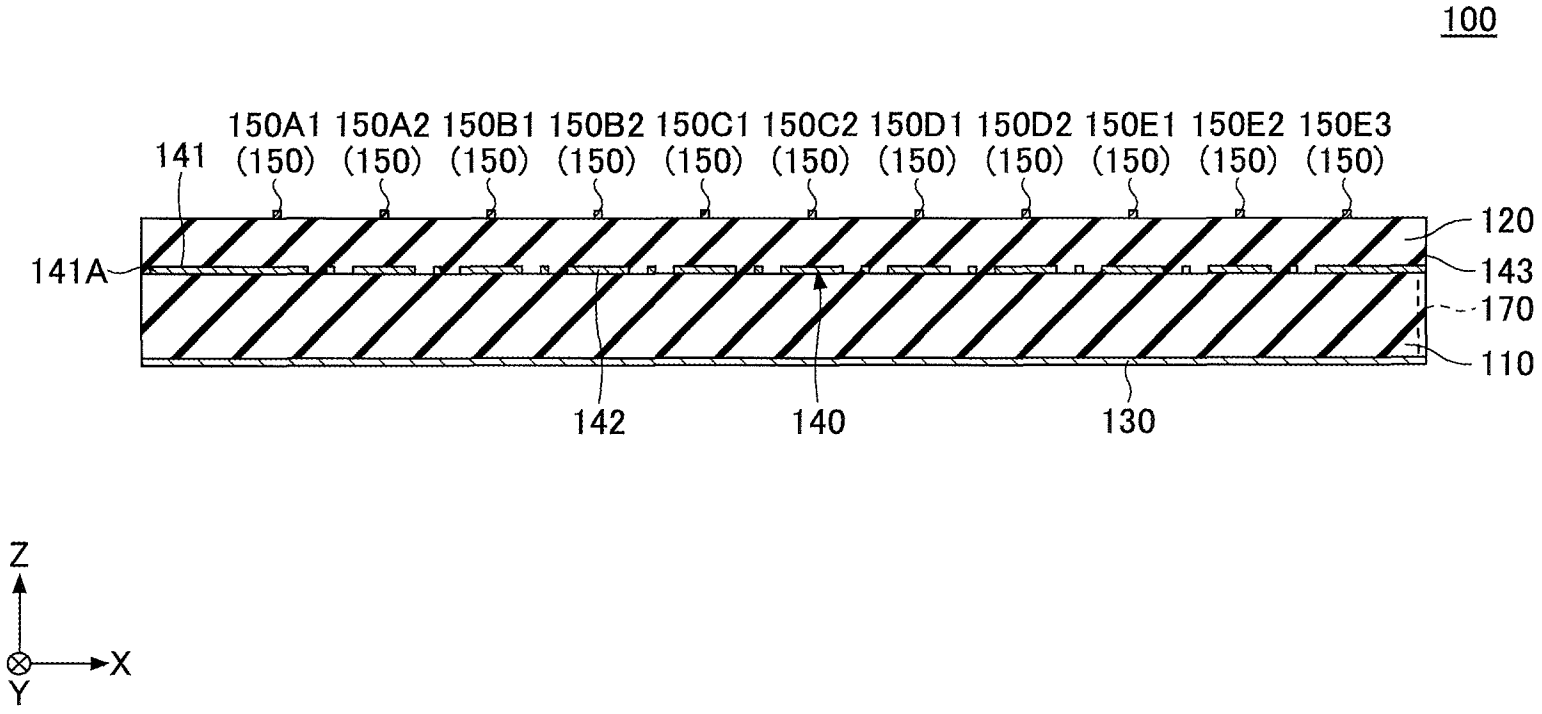
FIG. 6 is a diagram illustrating an A-A cross section of the antenna apparatus as illustrated in FIG. 1.

FIG. 1 is an oblique perspective diagram illustrating an antenna apparatus 100 of the first embodiment. FIG. 2 is an oblique perspective diagram illustrating an antenna apparatus 100 of the first embodiment. FIG. 3 is an enlarged diagram illustrating a part of the antenna apparatus 100. FIG. 4 is an enlarged diagram illustrating another part of the antenna apparatus 100. FIG. 5 is an oblique perspective exploded diagram illustrating an antenna apparatus 100 of the first embodiment. FIG. 6 is a diagram illustrating an A-A cross section of the antenna apparatus 100 as illustrated in FIG. 1.

Hereinafter, the antenna apparatus 100 will be described by using a XYZ coordinate system as an orthogonal coordinate system. Hereinafter, for the purpose of illustration, a surface which is located on the negative side in Z axis direction will be referred to as a bottom surface, and a surface which is located on the positive side in Z axis direction will be referred to as a top surface. However, the top surface and the bottom surface are just exemplary names and do not mean universalistic relationship of upper and lower.

The antenna apparatus 100 includes dielectric layers 110 and 120, a ground plane 130, a meander conductive line 140, conductive strips 150 and a conductive strip 160. The antenna apparatus 100 includes eleven conductive strips 150. In a case where the eleven conductive strips 150 are distinguished from each other, the eleven conductive strips 150 are referred to as conductive strips 150A1, 150A2, 150B1, 150B2, 150C1, 150C2, 150D1, 150D2, 150E1, 150E2 and 150E3. In a case where the conductive strips 150A1 to 150E3 are not distinguished from each other, the conductive strips 150A1 to 150E3 will be described as the conductive strip(s) 150.

The antenna apparatus 100 of the first embodiment is used for communicating electromagnetic waves in the UHF band, and a resonant frequency (central frequency) of the antenna apparatus 100 may be in a range from about 860 MHz to about 960 MHz, for example. In this embodiment, the antenna apparatus 100 having the resonant frequency (central frequency) of 919 MHz will be described, for example.

Since the antenna apparatus 100 communicates at the resonant frequency (central frequency), among lengths of configuration elements included in the antenna apparatus 100, lengths of the meander conductive line 140 and the conductive strips 150 are set to lengths that correspond to wavelength at the resonant frequency.

Since the wavelength at the resonant frequency may be shortened by a shortening effect in a dielectric material (dielectric substance), the lengths of the meander conductive line 140 and the conductive strips 150 may be determined in the light of relative permittivity of the dielectric layers 110 and 120.

For example, a practical wavelength of electromagnetic waves at 919 MHz is about 326 mm, while a wavelength λ used for designing the antenna apparatus 100 is about 180 mm. The wavelength λ is determined in consideration of relative permittivities of the dielectric layers 110 and 120.

Hereinafter, designing the lengths of the meander conductive line 140 and the conductive strips 150 or the like based on the wavelength in light of the relative permittivity of the dielectric layers 110 and 120 or the like will be referred to as determining the lengths corresponding to the wavelength at the resonant frequency. A length of the wavelength obtained in a dielectric material (dielectric substance) will be referred to as a length corresponding to the wavelength at the resonant frequency.

The dielectric layers 110 and 120 are sheet-like substrates having rectangular shapes in plan view, respectively. A substrate of the antenna apparatus 100 is constituted by adhering the dielectric layers 110 and 120 to each other while the meander conductive line 140 is placed therebetween. The dielectric layer 110 is one example of a first dielectric layer, and the dielectric layer 120 is one example of a second dielectric layer.

Lengths of the dielectric layers 110 and 120 in X-axis direction are 730 mm, and lengths (widths) of the dielectric layers 110 and 120 in Y-axis direction are 200 mm, for example. Thickness of the dielectric layer 110 is 1.6 mm, and thickness of the dielectric layer 120 is 1.0 mm. For the purpose of illustration, thicknesses of the dielectric layers 110 and 120 are illustrated thicker than actual thicknesses in FIGS. 1 and 5.

In the first embodiment, the dielectric layers 110 and 120 are Flame Retardant type 4 (FR4) standardized substrate materials, for example. For example, glass-reinforced epoxy laminate sheets made of glass cloth dipped into epoxy resin may be used as the dielectric layers 110 and 120. For example, relative permittivities Er of the dielectric layers 110 and 120 are 4.4, and dielectric tangents tan δ thereof are 0.02.

The ground plane 130 is disposed on the bottom surface of the dielectric layer 110, and the meander conductive line 140 is disposed on the top surface of the dielectric layer 110. The conductive strips 150 are disposed on the top surface of the dielectric layer 120.

The ground plane 130 is disposed on the bottom surface of the dielectric layer 110. The ground plane 130 is made of copper foil, for example, and constitutes a microstripline with the meander conductive line 140.

The meander conductive line 140 is disposed on the top surface of the dielectric layer 110. The meander conductive line 140 is one example of a conductive line. The meander conductive line 140 constitutes the microstripline with the ground plane 130. The microstripline functions as a microstrip-antenna. The characteristic impedance of the micro-strip antenna is 50Ω or 75Ω, for example.

Since the meander conductive line 140 is disposed on the top surface of the dielectric layer 110 and is located under the dielectric layer 120, the meander conductive line 140 is insulated from the conductive strips 150 that are disposed on the top surface of the dielectric layer 120.

The meander conductive line 140 is made by patterning a copper foil, for example. The meander conductive line 140 is a type of a conductive pattern which extends along X-axis while snaking in Y-axis direction in a meander fashion. Line width of the meander conductive line 140 is 3 mm, for example.

The meander conductive line 140 includes a straight portion 141, meander portions 142 and a straight portion 143. The straight portion 141 extends in X-axis direction. An end portion of the straight portion 141 located on negative side in X-axis direction constitutes a first end of the meander conductive line 140, and constitutes a feeding point 141A.

The straight portion 141 is located on the central axis, parallel to X-axis, of the dielectric layers 110 and 120. A cable core of a coaxial cable connected to the reader-writer is connected to the feeding point 141A, for example.

Ten meander portions 142 are located on positive side of the straight portion 141 in X-axis direction and are connected in series with each other. The ten meander portions 142 have the same pattern which is illustrated in FIG. 3. Single unit of the meander portion 142 have a shape as illustrated in FIG. 3. The meander portion 142 includes straight portions 142A, 142B, 142C, 142D, 142E, 142F and 142G. In FIG. 3, for the sake of indicating a positional relationship of the meander portion 142 and the conductive strips 150 in an easy-to-understand manner, the meander portion 142 and the conductive strips 150 are illustrated transparently.

As illustrated in FIG. 3, the meander portion 142 is located between a pair of the conductive strips 150, i.e., two neighboring conductive strips. A trace length (line length) of the meander portion 142 is set to a length corresponding to the single wavelength (λ) at the resonant frequency. The trace length of the meander portion 142 is obtained between a crossover point of the straight portion 142A and one conductive strip 150 and a crossover point of the straight portion 142G and another conductive strip 150.

In FIG. 3, a dashed line extending along X-axis direction is the centerline of the dielectric layers 110 and 120 which is parallel to X-axis. The straight portions 142A and 142G are located on the centerline. The meander portion 142 has a shape which is symmetrical with respect to a crossover point of the straight portion 142D and the centerline.

The straight portion 142A extends on the centerline from the negative side to the positive side in X-axis direction. The straight portion 142B which extends toward positive Y-axis direction is connected to the end portion of the straight portion 142A which is located on positive side in X-axis direction.

The straight portion 142C which extends toward positive X-axis direction is connected to the end portion of the straight portion 142B which is located on positive side in Y-axis direction. The straight portion 142D which extends toward negative Y-axis direction is connected to the end portion of the straight portion 142C which is located on positive side in X-axis direction. The straight portion 142E which extends toward positive X-axis direction is connected to the end portion of the straight portion 142D which is located on negative side in Y-axis direction.

The straight portion 142F which extends toward positive Y-axis direction is connected to the end portion of the straight portion 142E which is located on positive side in X-axis direction. The straight portion 142G which extends toward positive X-axis direction is connected to the end portion of the straight portion 142F which is located on positive side in Y-axis direction.

The meander portion 142 including the straight portions 142A, 142B, 142C, 142D, 142E, 142F and 142G, as described above, extends along X-axis while snaking in Y-axis direction in the meander fashion. In the meander conductive line 140, the ten meander portions 142 are connected in series between the straight portion 141 and the L-shaped portion 143 from negative side to positive side in X-axis direction.

The straight portion 143 (see FIG. 2) is connected to an X-axis-positive-side-end-portion of the ten meander portions 142. The straight portion 143 extends from the X-axis-positive-side-end-portion of the ten meander portions 142 to an X-axis-positive-side-end-portion of the dielectric layer 110 along X-axis. An end portion of the straight portion 143 constitutes an end portion of the meander conductive line 140 which is located on positive side in X-axis direction. The end portion constitutes a second end of the meander conductive line 140 and is a grounded point (grounded end) 143A. The grounded point 143A is one example of a short end.

As illustrated in FIG. 5, the grounded point 143A is connected to the ground plane 130 via a through hole 170 which penetrates the dielectric layer 110 in thickness direction (Z-axis direction). The through hole 170 includes a conductive wall which electrically connects the grounded point 143A and the ground plane 130. Accordingly, the second end, i.e., the grounded point 143A, of the meander conductive line 140 is shorted to the ground.

The length of the straight portion 143 is set to a length corresponding to quarter wavelength (λ/4) at the resonant frequency. In a case where the straight portion 143 is an open end, the length of the straight portion 143 may be set to a length corresponding to half wavelength (λ/2) at the resonant frequency.

As described above, the length of the straight portion 143 having the ground point 143A is set to the length corresponding to the quarter wavelength (λ/4) at the resonant frequency. If the meander conductive line 140 is fed from the feeding point 141A, a standing wave of current is formed on the meander conductive line 140. Nodes of the standing wave occur at eleven locations that are λ/4, 3λ/4, 5λ/4, 7λ/4, 9λ/4, 11λ/4, 13λ/4, 15λ/4, 17λ/4, 19λ/4 and 21λ/4 away from the ground point 143A, respectively. These lengths are obtained by subtracting quarter wavelength (λ/4) from multiplied result of half wavelength (λ/2) and integer number.

In other words, the eleven nodes occur at a boundary between the straight portion 141 and the meander portion 142, nine boundaries between the ten meander portions 142, and a boundary between the meander portion 142 and the straight portion 143, respectively.

Each of the nodes of the standing wave of current is a point where current value becomes zero and electric field becomes the maximum value. In the antenna apparatus 100 of the first embodiment, the conductive strips 150 are disposed on the meander conductive line 140 via the dielectric layer 120 and intersect with the meander conductive line 140 at the locations of the nodes of the standing wave of the current, in order to electromagnetically couple the meander conductive line 140 and the conductive strips 150 and to maximize the electric field generated by the conductive strips 150.

Each of antinodes of the standing wave of the current is a point where current value becomes the maximum value and electric field becomes zero. The antinodes appear at positions that are shifted by the quarter wavelength (λ/4) at the resonant frequency with respect to positions of the nodes. In other words, the antinodes appear at positions that are shifted by the quarter wavelength (λ/4) on the positive side or the negative side in X-axis direction with respect to the positions of the nodes as described above.

According to the antenna apparatus 100 of the first embodiment, the conductive strip 160 is disposed on the meander conductive line 140 via the dielectric layer 120 and intersect with the meander conductive line 140 at the location of the antinode located on the positive side of the conductive strip 150E3 in X-axis direction, in order to electromagnetically couple the meander conductive line 140 and the conductive strip 160 and to maximize the electromagnetic field generated by the conductive strip 160.

The location of the antinode located on the positive side of the conductive strip 150E3 in X-axis direction is the location of the grounded point 143A. The antinode is located the most positive side in X-axis direction among the antinodes of the standing wave of the current flowing through the meander conductive line 140. This is because the length of the straight portion 143 is set to a length corresponding to the quarter wavelength (λ/4) at the resonant frequency.

Accordingly, in the first embodiment, the conductive strip 160 intersects with the straight portion 143 in a T-shaped fashion at the grounded point 143A in plan view. The conductive strip 160 is placed so that the center point of the conductive strip 160 in a longitudinal direction overlaps with the grounded point 143A and the conductive strip 160 and the straight portion 143 form a right angle in plan view.

The reason why the conductive strip 160 is provided on the positive side of the conductive strip 150E3 in X-axis direction is as follows. A distribution of the electric field in X-axis direction is uniformized by the conductive strips 150A1, 150A2, 150B1, 150B2, 150C1, 150C2, 150D1, 150D2, 150E1, 150E2 and 150E3 between the conductive strip 150A1 and the conductive strip 150E3. Since the feeding point 141A is located on negative side of the conductive strip 150A1 in X-axis direction and the grounded point 143A is located on positive side of the conductive strip 150E3 in X-axis direction, there is an inclination that a distribution of the electric field in an area located on positive side of the conductive strip 150E3 in X-axis direction becomes weaker than that in an area located on negative side of the conductive strip 150A1 in X-axis direction.

Therefore, the conductive strip 160 is disposed on the positive side of the conductive strip 150E3 in X-axis direction for the sake of reinforcing a communication area in which the antenna apparatus 100 can communicate with an RFID tag on the positive side of the conductive strip 150E3 in X-axis direction.

It is possible to improve the distribution of the electromagnetic field on the positive side of the conductive strip 150E3 in X-axis direction by causing the conductive strip 160 to be coupled with the meander conductive line 140 by the magnetic field. The improvement of the distribution of the electromagnetic field is confirmed by measured results obtained from an experiment in which the RFID tags are attached to towels.

The electric field generated by the conductive strip 150 and the magnetic field generated by the conductive strip 160 leak in a near field on a top-surface-side of the micro-strip antenna including the meander conductive line 140 as described above. Accordingly, the micro-strip antenna makes it possible to communicate with the RFID tags by utilizing the leak electric field and the leak magnetic field in the near field of the micro-strip antenna.

The conductive strips 150 are constituted of eleven conductive patterns that are disposed on the top surface of the dielectric layer 120. Each of the conductive strips 150 is one example of a first conductive element.

Since the conductive strips 150 are disposed on the top surface of the dielectric layer 120, the conductive strips 150 are insulated from the meander conductive line 140. The conductive strip 150 is made by patterning a copper foil, for example. The line width of the conductive strip 150 is set to 4 mm, for example.

As illustrated in FIG. 4, the conductive strip 150 includes straight portions 151, 152 and 153. In FIG. 4, for the sake of indicating a positional relationship of the conductive strip 150 and the straight portions 142A and 142G of the meander portion 142 in an easy-to-understand manner, the conductive strips 150 and the straight portions 142A and 142G are illustrated transparently.

The straight portion 151 extends in parallel with Y axis. Accordingly, the straight portion 151 intersects with the straight portions 142A and 142G at right angle. The straight portion 152 extends from an end portion of the straight portion 151 located on positive side in Y-axis direction. The straight portion 153 extends from an end portion of the straight portion 151 located on negative side in Y-axis direction.

The straight portions 152 and 153 are bent toward the feeding point 141A with respect to the straight portion 151. In other words, the straight portions 152 and 153 that extend in Y-axis direction are bent on negative side in X-axis direction. The straight portions 152 and 153 are bent on negative side in X-axis direction with respect to the straight portion 151. Bend angles of the straight portions 152 and 153 with respect to the central axis of the straight portion 151 extending along the longitudinal direction are equal to each other. The bend angles are represented as angles θ. The bend angle is one example of a bend degree.

The conductive strip 150 is disposed so that the center point of the straight portion 151 in Y-axis direction overlaps with the position at which the node of the standing wave generated on the meander conductive line 140 occurs in plan view. Accordingly, the eleven conductive strips 150 are disposed on the dielectric layer 120 so that the eleven conductive strips 150 intersect with the meander conductive line 140 at the positions of the eleven nodes of the standing wave of the current formed on the meander conductive line 140, respectively, in plan view.

In each of the conductive strips 150, length from an end portion of the straight portion 152 to an end portion of the straight portion 153 along the straight portions 152, 151 and 153 is set to a length corresponding to the single wavelength (λ) at the resonant frequency. Accordingly, each conductive strip 150 functions as a resonator (first resonator).

Thickness of the dielectric layer 120 is set to a thickness that does not suppress the electromagnetic coupling of the conductive strips 150 and the meander conductive line 140. Therefore, the conductive strips 150 function as resonators that are electromagnetically coupled with the meander conductive line 140. Each of the conductive strips 150 can radiate and receive electromagnetic waves via the meander conductive line 140 and can perform communications at the resonant frequency.

Each of the nodes of the standing wave of the current is a point where current value becomes zero and electric field becomes the maximum value. Accordingly, it becomes possible to increase electric field intensity on the positive side of the microstrip-antenna in Z-axis direction by utilizing the conductive strips 150. The microstrip-antenna includes the meander conductive line 140.

Since the conductive strips 150 are arranged on the top surface of the antenna apparatus 100 in a manner that the conductive strips 150 encompass the whole top surface of the antenna apparatus 100 in X axis direction and Y axis direction, it is possible to increase and uniformize the electric field intensity on the top surface side of the antenna apparatus 100.

Next, the lengths and the angles θ of the conductive strips 150A1, 150A2, 150B1, 150B2, 150C1, 150C2, 150D1, 150D2, 150E1, 150E2 and 150E3 will be described.

The lengths of the conductive strips 150A1 and 150A2 are equal to each other and are set to 186 mm, for example. The lengths of the conductive strips 150E1, 150E2 and 150E3 are equal to each other and are set to 202 mm, for example. The lengths of the conductive strips 150A1, 150A2, 150E1, 150E2 and 150E3, i.e. 186 mm and 202 mm, are lengths corresponding to the single wavelength at the resonant frequency.

The lengths of the conductive strips 150B1 and 150B2 are equal to each other. The lengths of the conductive strips 150C1 and 150C2 are equal to each other. The lengths of the conductive strips 150D1 and 150D2 are equal to each other. The lengths of the conductive strips 150B1 and 150B2, the lengths of the conductive strips 150C1 and 150C2 and the lengths of the conductive strips 150D1 and 150D2 are longer than 186 mm and shorter than 202 mm. The lengths of the conductive strips 150B1 and 150B2, the lengths of the conductive strips 150C1 and 150C2 and the lengths of the conductive strips 150D1 and 150D2 increase in this order. These three lengths correspond to the single wavelength at the resonant frequency as well.

In each of the conductive strips 150, length of the straight portion 151 is 60 mm, and lengths of the straight portions 152 and 153 are equal to each other.

As illustrated in FIG. 2, in each of the conductive strips 150A1 and 150A2, the bend angle θ of the straight portions 152 and 153 with respect to the central axis of the straight portion 151 is 30 degrees. In each of the conductive strips 150B1 and 150B2, the bend angle θ of the straight portions 152 and 153 with respect to the central axis of the straight portion 151 is 35 degrees.

In each of the conductive strips 150C1 and 150C2, the bend angle θ of the straight portions 152 and 153 with respect to the central axis of the straight portion 151 is 40 degrees. In each of the conductive strips 150D1 and 150D2, the bend angle θ of the straight portions 152 and 153 with respect to the central axis of the straight portion 151 is 45 degrees.

In each of the conductive strips 150E1, 150E2 and 150E3, the bend angle θ of the straight portions 152 and 153 with respect to the central axis of the straight portion 151 is 50 degrees.

The lengths and the angles θ were derived by an electromagnetic field simulation utilizing a Finite Element Method. The simulation result will be described later. More enhanced S11 parameter characteristics were obtained in a case where the lengths of the eleven conductive strips 150 are different as described above than in a case where the lengths of the eleven conductive strips 150 are the same.

A more uniformized field distribution was obtained in a case where the lengths of the eleven conductive strips 150 are different as described above than in a case where the lengths of the eleven conductive strips 150 are the same. As illustrated in FIG. 2, the electric field Ed generated by the conductive strips 150 is divided into X component Ex obtained in X axis direction and Y component Ey obtained in Y axis direction. The reason why the more uniform field distribution is obtained in a case where the lengths of the eleven conductive strips 150 are different is because the Y component Ey is increased compared with the case where the lengths of the eleven conductive strips 150 are the same.

If the conductive strips 150 have straight-line-shapes extending along Y axis, the electric field Ed generated by the conductive strips 150 only have the X component Ex. In other words, in this case, Y component Ey is not generated by the conductive strips 150.

Accordingly, it is important for each of the conductive strips 150 that the straight portions 152 and 153 are bent at the bend angle θ with respect to the straight portion 151 in order to obtain the Y component Ey. By setting the bend angles θ of the eleven conductive strips 150 to various angles as illustrated in FIG. 2, it becomes possible to obtain the Y components Ey with various intensities and to obtain more uniformized field distribution.

The conductive strip 160 is one example of a second conductive element. The conductive strip 160 is disposed on the top surface of the dielectric layer 120 so that the conductive strip 160 intersects with the straight portion 143 in a T-shaped fashion at the location of the antinode of the standing wave of the current flowing through the meander conductive line 140 on the positive side of the conductive strip 150E3 in X-axis direction in plan view.

The conductive strip 160 is placed at the location of the antinode of the standing wave of the current flowing through the meander conductive line 140 for the sake of improving the distribution of the electromagnetic field on the positive side of the conductive strip 150E3 in X-axis direction.

Each of antinodes of the standing wave of the current is the point where the current value and the magnetic field become the maximum values and the electric field becomes zero. The antinodes appear at the positions that are shifted by the quarter wavelength (λ/4) at the resonant frequency with respect to the positions of the nodes.

According to the antenna apparatus 100 of the first embodiment, the conductive strip 160 is disposed on the meander conductive line 140 via the dielectric layer 120 and intersects with the meander conductive line 140 at the location of the antinode located on the positive side of the conductive strip 150E3 in X-axis direction, in order to electromagnetically couple the meander conductive line 140 and the conductive strip 160 and to maximize the electromagnetic field generated by the conductive strip 160.

The length of the conductive strip 160 is a half wavelength (λ/2) at the resonant frequency. The conductive strip 160 is a straight-shaped conductive pattern extending in Y-axis direction and is disposed on the top surface of the dielectric layer 120 so that the center point of the conductive strip 160 in the longitudinal direction overlaps with the grounded point 143A in plan view.

The conductive strip 160 is made by patterning a copper foil, for example. The line width of the conductive strip 150 is set to 4 mm, for example. The copper foil used for forming the conductive strip 160 may be the same as the copper foil used for forming the conductive strip 150.

Since the length of the conductive strip 160 is set to half wavelength (λ/2) at the resonant frequency, the conductive strip 160 functions as the resonator (second resonator). In the conductive strip 160, the current becomes the maximum value at the center point in the longitudinal direction and becomes zero at the end portions in the longitudinal direction. Accordingly, the magnetic field generated by the conductive strip 160 becomes the maximum value at the center point of the conductive strip 160 in the longitudinal direction.

It is possible to improve the distribution of the electromagnetic field on the positive side of the conductive strip 150E3 in X-axis direction by causing the conductive strip 160 to be coupled with the meander conductive line 140 by the magnetic field.

Thickness of the dielectric layer 120 is set to a thickness that does not suppress the electromagnetic coupling of the conductive strip 160 and the meander conductive line 140. Therefore, the conductive strip 160 functions as the resonator which is electromagnetically coupled with the meander conductive line 140. The conductive strip 160 can radiate and receive electromagnetic waves via the meander conductive line 140 and can perform communications at the resonant frequency.

Each of the antinodes of the standing wave of the current is a point where current value becomes the maximum value and electric field becomes zero. Accordingly, it becomes possible to increase the intensity of the magnetic field on the positive side of the microstrip-antenna in Z-axis direction at around the end portion located on positive side of the microstrip-antenna in X-axis direction by utilizing the conductive strip 160. The microstrip-antenna includes the meander conductive line 140.

According to the first embodiment, it is possible to provide the antenna apparatus 100 which can generate the electric field having sufficient uniformity and intensity in the near field by electromagnetically coupling the conductive strips 150 with the microstrip-antenna. The microstrip-antenna includes the meander conductive line 140 and the ground plane 130. Further, it is possible to provide the antenna apparatus 100 which can generate the magnetic field having sufficient intensity around the grounded point 143A in the near field by electromagnetically coupling the conductive strip 160 with the microstrip-antenna.

Since the feeding point 141A is located on negative side of the conductive strip 150A1 in X-axis direction and the grounded point 143A is located on positive side of the conductive strip 150E3 in X-axis direction, there is an inclination that the distribution of the electric field in the area located on positive side of the conductive strip 150E3 in X-axis direction becomes weaker than that in the area located on negative side of the conductive strip 150A1 in X-axis direction and the area between the conductive strips 150A1 and 150E3, if the antenna apparatus 100 does not include the conductive strip 160. Decrease or ununiformity of the distribution of the electric field makes the communication area narrow.

Therefore, the conductive strip 160 is disposed on the positive side of the conductive strip 150E3 in X-axis direction for the sake of reinforcing or broadening the communication area on the positive side of the conductive strip 150E3 in X-axis direction. The communication area is provided by the magnetic field generated by the conductive strip 160.

According to the antenna apparatus 100, the electric field generated by the conductive strip 150 and the magnetic field generated by the conductive strip 160 leak in the near field on the top-surface-side of the micro-strip antenna including the meander conductive line 140. Accordingly, the antenna apparatus 100 makes it possible to communicate with the RFID tags in the near field located on the whole surface area of the the antenna apparatus 100.

According to the embodiment as described above, the conductive strips 150A1, 150A2, 150B1, 150B2, 150C1, 150C2, 150D1, 150D2, 150E1, 150E2 and 150E3 are disposed at positions that are located designated distances away from the ground point 143A, respectively.

The positions are located λ/4, 3λ/4, 5λ/4, 7λ/4, 9λ/4, 11λ/4, 13λ/4, 15λ/4, 17λ/4, 19λ/4 and 21λ/4 away from the ground point 143A, respectively.

Accordingly, the length between the conductive strips 150A1, 150A2, 150B1, 150B2, 150C1, 150C2, 150D1, 150D2, 150E1, 150E2 and 150E3 are lengths corresponding to λ/2 at the resonant frequency.

Accordingly, currents flowing through the two neighboring conductive strips 150 among the conductive strips 150A1, 150A2, 150B1, 150B2, 150C1, 150C2, 150D1, 150D2, 150E1, 150E2 and 150E3 have opposite phases with each other.

According to a variation example of the first embodiment, the antenna apparatus 100 may include only the conductive strips 150A1, 150B1, 150C1, 150D1, 150E1 and 150E3. In this case, the currents flowing through the two neighboring conductive strips 150 have the same phases with each other. Accordingly, it is possible to provide a configuration in that the electric fields generated by the conductive strips 150A1, 150B1, 150C1, 150D1, 150E1 and 150E3 strengthen one another.

It is possible to manufacture the antenna apparatus 100 as described above as follows. First of all, prepare a sheeted substrate material to which two copper foils are attached on both surfaces of the substrate material. Form the meander conductive line 140 by patterning one of the copper foils and keep the other copper foil as the ground plane 130. Accordingly, a first structural body which includes the dielectric layer 110, the ground plane 130 and the meander conductive line 140 is obtained.

Next, prepare another sheeted substrate material to which one copper foil is attached on a surface of the substrate material. Form the conductive strips 150 and 160 by patterning the copper foil. Accordingly, a second structural body which includes the dielectric layer 120 and the conductive strips 150 and 160 is obtained.

Then, put the top surface of the first structural body and the bottom surface of the second structural body together. Accordingly, the antenna apparatus 100 is completed. The dielectric layer 110 and the dielectric layer 120 may be put together by thermo-compression bonding, adhesive bonding or the like.

According to the embodiment as described above, the ground plane 130, the meander conductive line 140 and the conductive strips 150 and 160 are made of copper. However, the ground plane 130, the meander conductive line 140 and the conductive strips 150 and 160 may be made of metal such as gold, silver, nickel or the like, or alloy of these metals.

A cover member which covers the bottom surface of the ground plane 130 may be attached to the antenna apparatus 100. The cover member may be made of resin, for example, and may have dimensions in X axis direction and Y axis direction similar to that of the dielectric layer 110. Similarly, a cover member which covers the conductive strips 150 and 160 and the top surface of the dielectric layer 120 may be attached to the antenna apparatus 100. The cover member may be made of resin, for example, and may have dimensions in X axis direction and Y axis direction similar to that of the dielectric layer 120.

According to the embodiment as described above, the conductive strips 150 and 160 are placed on the top surface of the dielectric layer 120. The conductive strips 150 or the conductive strip 160 may be placed on a top surface of another dielectric layer disposed on the dielectric layer 120. In this case, the conductive strips 150 and the conductive strip 160 are placed on the top surfaces of the different dielectric layers with respect to each other.

Next, another variation example of the antenna apparatus 100 according to the first embodiment will be described with reference to FIGS. 7A to 7E.

FIGS. 7A to 7E are diagrams illustrating conductive strips 171 to 175 of the variation example of the antenna apparatus 100 according to the first embodiment. The conductive strips 171 to 175 as illustrated in FIGS. 7A to 7E may be used instead of the conductive strips 150 as illustrated in FIGS. 1 to 6.

Figure 7A:
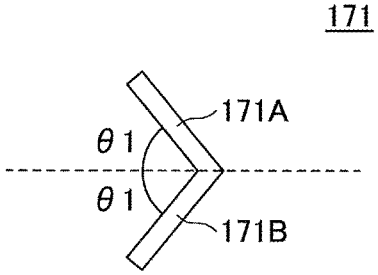
FIG. 7A is a diagram illustrating conductive strips of the variation example of the antenna apparatus according to the first embodiment.

As illustrated in FIG. 7A, the conductive strip 171 includes straight portions 171A and 171B. The straight portions 171A and 171B are bent at angles θ1 with respect to the central axes of the dielectric layers 110 and 120 that are described by dashed line and are parallel with X axis. The angles θ1 may be greater than 0 degrees and less than 90 degrees.

Figure 7B:
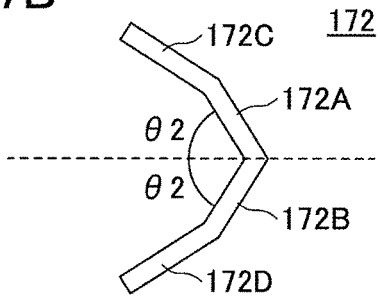
FIG. 7B is a diagram illustrating conductive strips of the variation example of the antenna apparatus according to the first embodiment.

As illustrated in FIG. 7B, the conductive strip 172 includes straight portions 172A, 172B, 172C and 172D. The straight portions 172A and 172B are bent at angles θ2 with respect to the central axes of the dielectric layers 110 and 120 that are described by dashed line and are parallel with X axis. The angles θ2 may be greater than 0 degrees and less than 90 degrees.

The straight portions 172C and 172D are formed from end portions of the straight portions 172A and 172B, respectively, in a continuous fashion. The straight portions 172C and 172D are bent with respect to the straight portions 172A and 172B so that the straight portions 172C and 172D face toward the feeding point 141A (see FIGS. 1 and 2) more than the straight portions 172A and 172B.

Figure 7C:
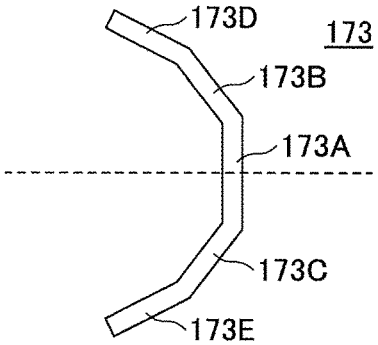
FIG. 7C is a diagram illustrating conductive strips of the variation example of the antenna apparatus according to the first embodiment.

As illustrated in FIG. 7C, the conductive strip 173 includes straight portions 173A, 173B, 173C, 173D and 173E. The straight portion 173A extends in Y axis direction in a manner similar to that of the straight portion 151 of the conductive strips 150 as illustrated in FIGS. 1 to 6.

The straight portions 173B and 173C are formed from both end portions of the straight portion 173A, respectively, in a continuous fashion. The straight portions 173B and 173C are bent with respect to the straight portion 173A so that the straight portions 173B and 173C face toward the feeding point 141A (see FIGS. 1 and 2).

The straight portions 173C and 173E are formed from end portions of the straight portions 173B and 173C, respectively, in a continuous fashion. The straight portions 173D and 173E are bent with respect to the straight portions 173B and 173C so that the straight portions 173D and 173E face toward the feeding point 141A (see FIGS. 1 and 2) more than the straight portions 173B and 173C.

Figure 7D:
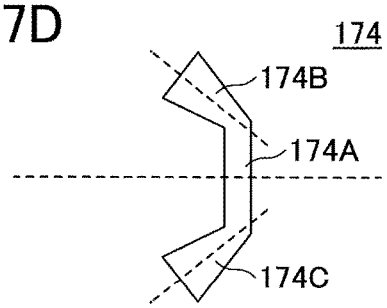
FIG. 7D is a diagram illustrating conductive strips of the variation example of the antenna apparatus according to the first embodiment.

As illustrated in FIG. 7D, the conductive strip 174 includes straight portion 174A and tapered portions 174B and 174C. The straight portion 174A extends in Y axis direction in a manner similar to that of the straight portion 151 of the conductive strips 150 as illustrated in FIGS. 1 to 6.

The tapered portions 174B and 173C are formed from both end portions of the straight portion 174A, respectively, in a continuous fashion. The tapered portions 174B and 173C are bent with respect to the straight portion 174A so that centerlines of the tapered portions 174B and 173C face toward the feeding point 141A (see FIGS. 1 and 2).

Figure 7E:
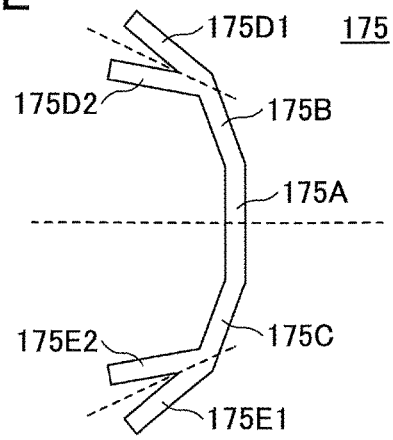
FIG. 7E is a diagram illustrating conductive strips of the variation example of the antenna apparatus according to the first embodiment.

As illustrated in FIG. 7E, the conductive strip 175 includes straight portions 175A, 175B and 175C and branch portions 175D1, 175D2, 175E1 and 175E2. The straight portions 175A, 175B and 175C are similar to the straight portion 173A, 173B and 173C as illustrated in FIG. 7C.

The branch portions 175D1 and 175D2 and the branch portions 175E1 and 175E2 are formed from end portions of the straight portions 173B and 173C in a continuous fashion and branch into two portions, respectively. The branch portions 175D1 and 175D2 and the branch portions 175E1 and 175E2 are bent with respect to the straight portions 175B and 175C so that central axes of the branch portions 175D1 and 175D2 and the branch portions 175E1 and 175E2 face toward the feeding point 141A (see FIGS. 1 and 2) more than the straight portions 175B and 175C.

The conductive strips 171 to 175 as illustrated in FIGS. 7A to 7E may be used instead of the conductive strips 150 as illustrated in FIGS. 1 to 6. The bend angles or number of the branches may not be limited to that illustrated in FIGS. 7A to 7E, and may be changed in various way. However, it is preferable for the conductive strips 171 to 175 to be bent toward the feeding point 141A (see FIGS. 1 and 2).

Accordingly, the conductive strips 150 may be bent or rounded with respect to Y axis direction in non-linear fashion.

According to the embodiment as described above, the conductive strips 150 are bent or rounded with respect to Y axis direction in non-linear fashion, the conductive strips 150 may extend along Y axis direction in a linear fashion as long as sufficient electric field in the near field can be obtained.

Next, the locations of the antinodes of the standing wave of the current flowing through the meander conductive line 140 will be described with reference to FIG. 8.

Figure 8A:
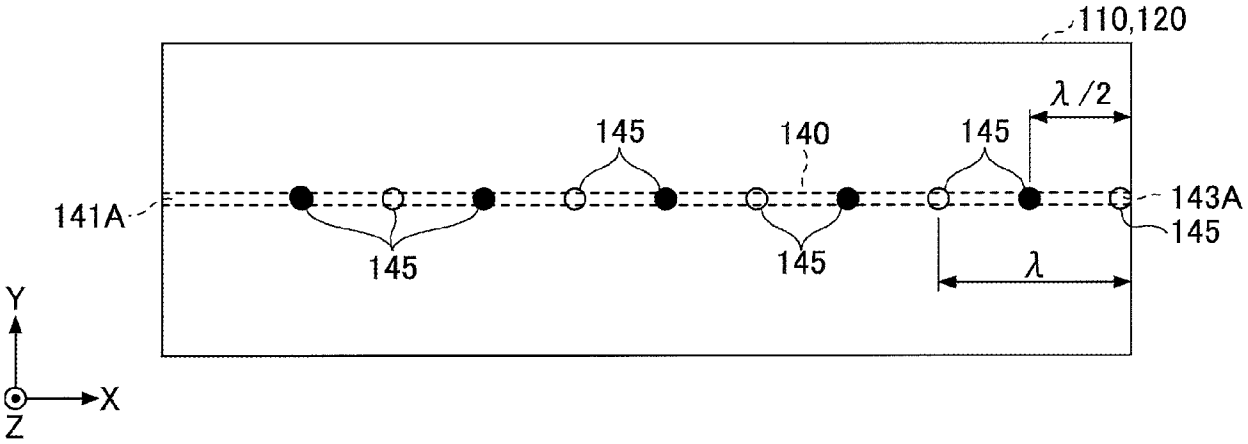
FIG. 8A is a diagram illustrating locations of antinodes of a standing wave of current.
Figure 8B:
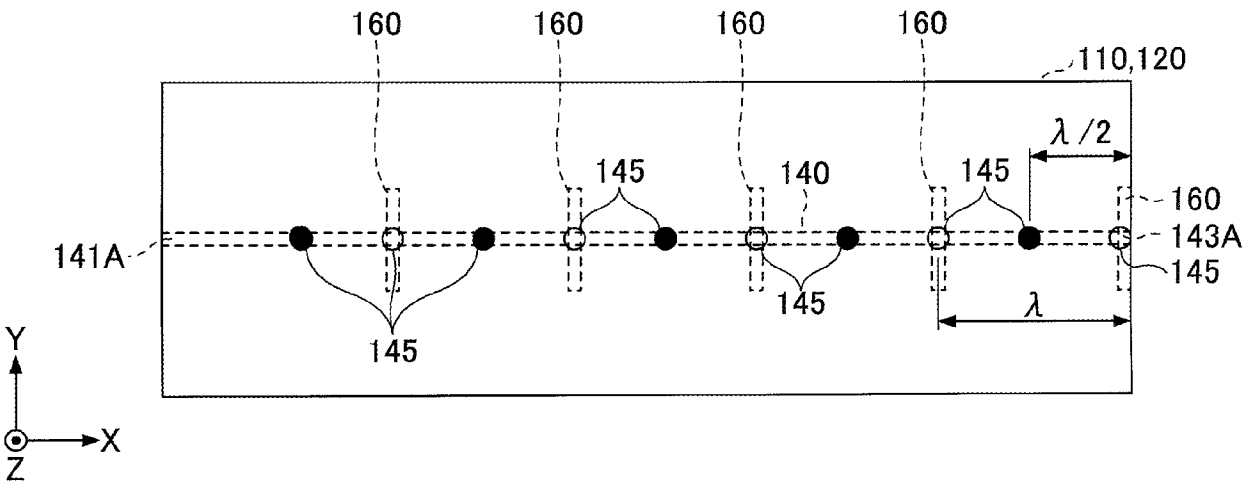
FIG. 8B is a diagram illustrating locations of antinodes of a standing wave of current.

FIGS. 8A and 8B are diagrams illustrating the locations of the antinodes of the standing wave of the current flowing through the meander conductive line 140. In FIG. 8A, for the purpose of illustration, the meander conductive line 140 is described as a straight-shape in plan view, the feeding point 141A is placed at an end portion located on negative side of the straight-shape in X-axis direction and the grounded point 143A is placed at an end portion located on positive side of the straight-shape in X-axis direction. Further, in FIG. 8A, a rectangular-shaped outline represents the dielectric layers 110 and 120. Furthermore, for the purpose of illustration, length of the meander conductive line 140 as illustrated in FIG. 8A is different from that along the meander conductive line 140 as illustrated in FIGS. 1, 2 and 5. In FIG. 8B, a plurality of positions at which a plurality of conductive strips 160 are placed is added compared with FIG. 8A.

As illustrated in FIG. 8A, the antinodes 145 appear at positions placed at the half wavelength length ($\lambda/2$) intervals from the grounded point 143A on the meander conductive line 140. The antinodes 145 appear at the positions that are shifted by the quarter wavelength ($\lambda/4$) at the resonant frequency with respect to the positions of the nodes.

Distances between the adjacent two antinodes 145 are the half wavelength ($\lambda/2$) at the resonant frequency. The antinodes 145 having the same phases alternately. In FIG. 8A, the antinodes 145 indicated by white circles have the same phases with each other and the antinodes 145 indicated by black circles have the same phases with each other. The phases of the antinodes 145 indicated by white circles and the phases of the antinodes 145 indicated by black circles have opposite phases with each other. The antinodes 145 indicated by the white circles and the antinode 145 indicated by the black circles appear alternately.

In FIG. 8A, the conductive strip 160 located on the grounded point 143A corresponds to the conductive strip 160 as illustrated in FIGS. 1, 2 and 5. The conductive strip 160 is located on the antinode indicated by the white circle. In addition to the conductive strip 160 located on the grounded point 143A, the antenna apparatus 100 may further include one or more conductive strip(s) 160 located on the antinode(s) 145 beside the antinode 145 located on the grounded point 143A.

In this case, the antenna apparatus 100 may further include the one or more conductive strip(s) 160 located on the antinode(s) 145 indicated by white circle(s).

In a case where the antenna apparatus 100 further include one or more conductive strip(s) 160 located on the antinode(s) 145 beside the antinode 145 located on the grounded point 143A, it is possible to further reinforce the communication area provided by the conductive strips 150.

In this case, if the antenna apparatus 100 further include the one or more conductive strip(s) 160 located on the antinode(s) 145 indicated by white circle(s), it is possible to reinforce the communication area provided by the conductive strips 150 furthermore and more effectively.

FIG. 8B illustrates positional relationship of the conductive strips 160 in a case where the antenna apparatus 100 further include one or more conductive strip(s) 160 located on the antinode(s) 145 beside the antinode 145 located on the grounded point 143A. In FIG. 8B, for the purpose of illustration, the positions of the conductive strips 160 are indicated by dashed lines. These conductive strips 160 are disposed on the top surface of the dielectric layer 120 with the conductive strips 150 as illustrated in FIGS. 1, 2 and 5 in a practical sense. Accordingly, the conductive patterns of the conductive strips 150 and the conductive strips 160 are designed so that the conductive strips 160 do not contact with the conductive strips 150 and that the conductive strips 150 and the conductive strips 160 are insulated with each other.

According to the embodiment as described above, the length of the conductive strip 160 is the half wavelength ($\lambda/2$) at the resonant frequency. The length of the conductive strip 160 may set to length obtained by multiplying an integer number to the half wavelength ($\lambda/2$). If the conductive strip 160 have such a length, the conductive strip 160 which is placed on the antinode of the standing wave of the current functions as the resonator.

Next, the conductive patterns of the conductive strips 160 in plan view are described with reference to FIGS. 9A to 9E.

FIGS. 9A to 9E are diagrams illustrating the conductive patterns of the conductive strips 160 in plan view. FIGS. 9A to 9E illustrate five exemplary conductive patterns. In FIGS.

9A to 9E, the conductive strips 160 are indicated by solid lines and the meander conductive lines 140 are indicated by dashed lines. In FIGS. 9A to 9E, configuration elements other than the conductive strips 160 and the meander conductive lines 140 are omitted.

Figure 9A:
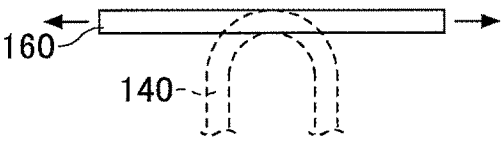
FIG. 9A is a diagram illustrating conductive patterns in plan view.

For example, as illustrated in FIG. 9A, the conductive strip 160 having the straight-shape may intersect with the meander conductive line 140 at an apex of a rounded portion of the meander conductive line 140. The conductive strip 160 having the straight-shape may extend in a direction along X-axis as illustrated in FIGS. 1 and 2, for example.

Figure 9B:
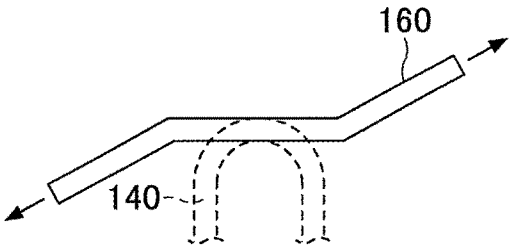
FIG. 9B is a diagram illustrating conductive patterns in plan view.

As illustrated in FIG. 9B, the conductive strip 160 may have a bent-shape in plan view.

Figure 9C:
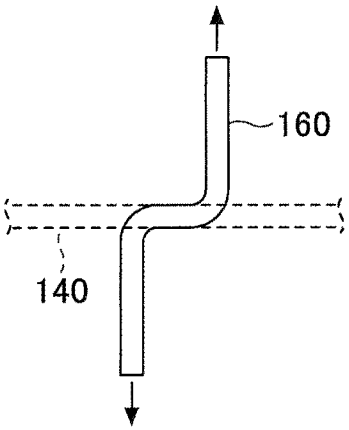
FIG. 9C is a diagram illustrating conductive patterns in plan view.

As illustrated in FIG. 9C, the conductive strip 160 may include a crank shape having a straight portion located in a center portion of the conductive strip 160, and the straight portion may be overlapped with the straight portion of the meander conductive line 140.

Figure 9D:
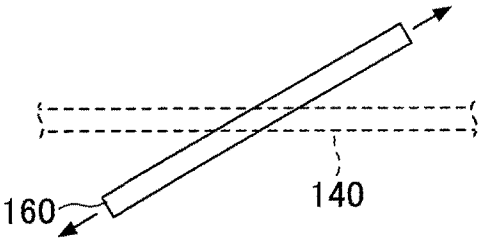
FIG. 9D is a diagram illustrating conductive patterns in plan view.

As illustrated in FIG. 9D, the conductive strip 160 having the straight-shape may intersect with the straight portion of the meander conductive line 140 at a designated angle.

Figure 9E:
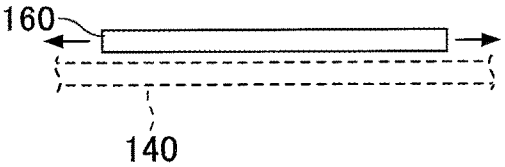
FIG. 9E is a diagram illustrating conductive patterns in plan view.

As illustrated in FIG. 9E, the conductive strip 160 having the straight-shape may be placed in parallel with the straight portion of the meander conductive line 140. In this case, the conductive strip 160 may be overlapped with the straight portion of the meander conductive line 140.

As described above, the conductive strips 160 having various conductive patterns may be used. Since the electric field generated by the conductive strip 160 is increased in two directions in which the both ends of the conductive strip 160 extend, respectively, i.e., in directions as indicated by arrows as illustrated in FIGS. 9A to 9E, the conductive pattern of the conductive strip 160 may be designed in accordance with the positions and the shapes of the conductive strips 150 and with the distribution characteristics of the communication area of the antenna apparatus 100.

Next, a shelf antenna system 900 utilizing the antenna apparatus 100 according to the first embodiment will be described with reference to FIG. 10.

Figure 10:
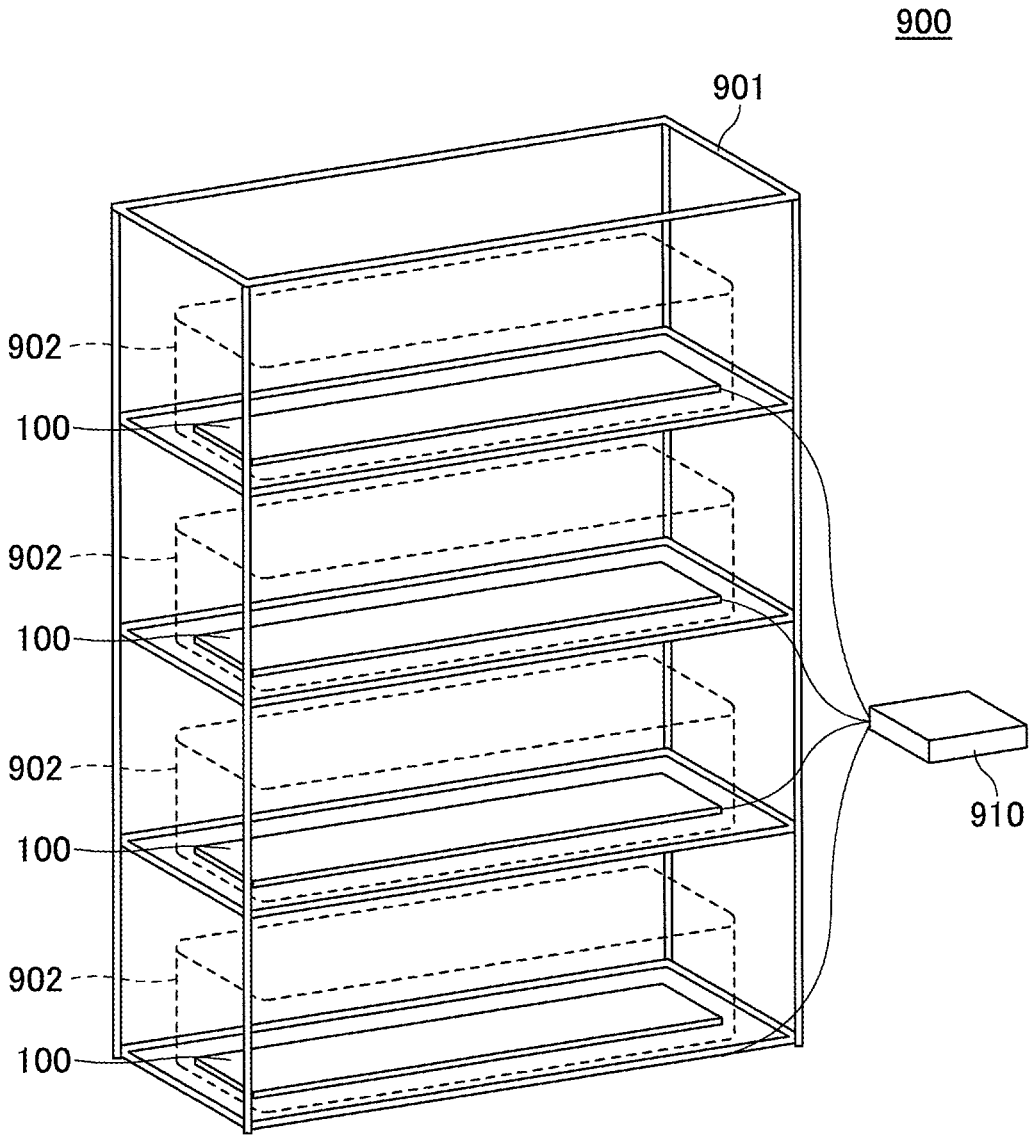
FIG. 10 is a diagram illustrating a shelf antenna system utilizing the antenna apparatuses according to the first embodiment.

FIG. 10 is a diagram illustrating the shelf antenna system 900 utilizing the antenna apparatuses 100 according to the first embodiment. In the shelf antenna system as illustrated in FIG. 10, four antenna apparatuses 100 are connected to a reader-writer 910 and are disposed on each level of four-level shelf 901. Since the antenna apparatuses 100 can perform communications in the near fields, readable areas 902 are formed at each level of the shelf 901.

In the shelf antenna system 900, merchandises to which RFID tags are attached are arranged on the antenna apparatuses 100 provided on each of the shelf 910. In this condition, the reader-writer 901 reads the RFID tags. The shelf antenna system 900 identifies that at least one of the merchandise is taken away from the shelf 901 when the shelf antenna system 900 becomes unable to detect any of the RFID tags. The reader-writer 910 cannot read the RFID tag when the merchandise is taken away from the readable areas 902.

Second Embodiment

Figure 11:
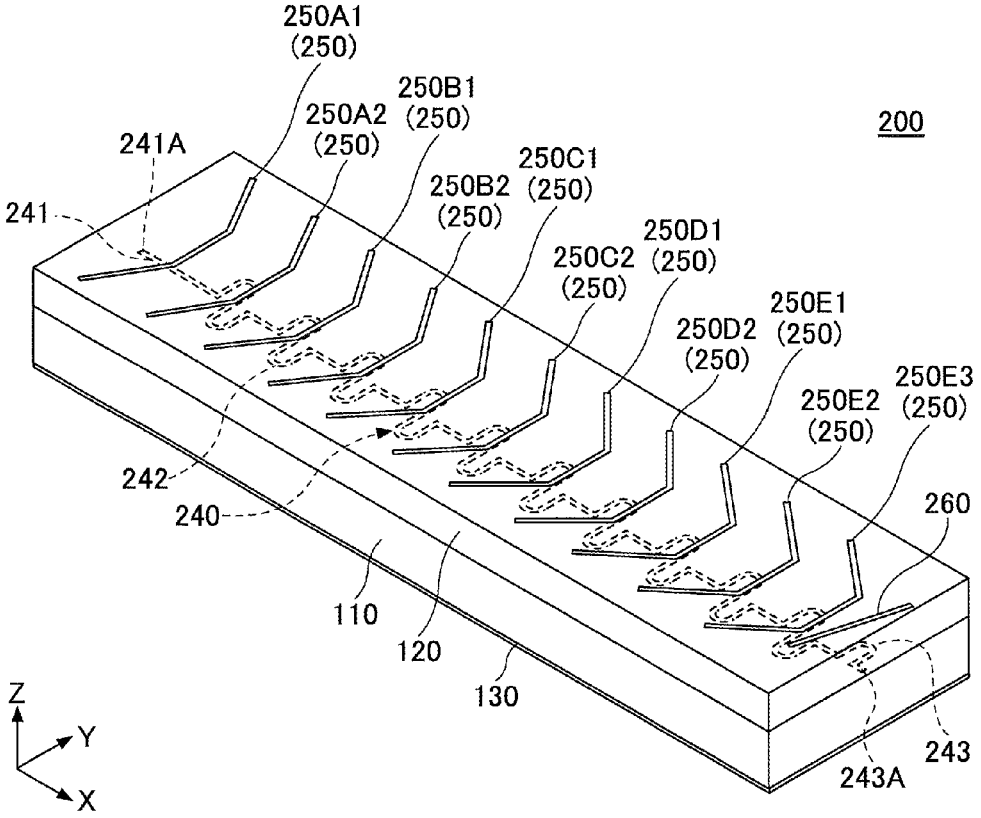
FIG. 11 is an oblique perspective diagram illustrating an antenna apparatus of a second embodiment.
Figure 12:
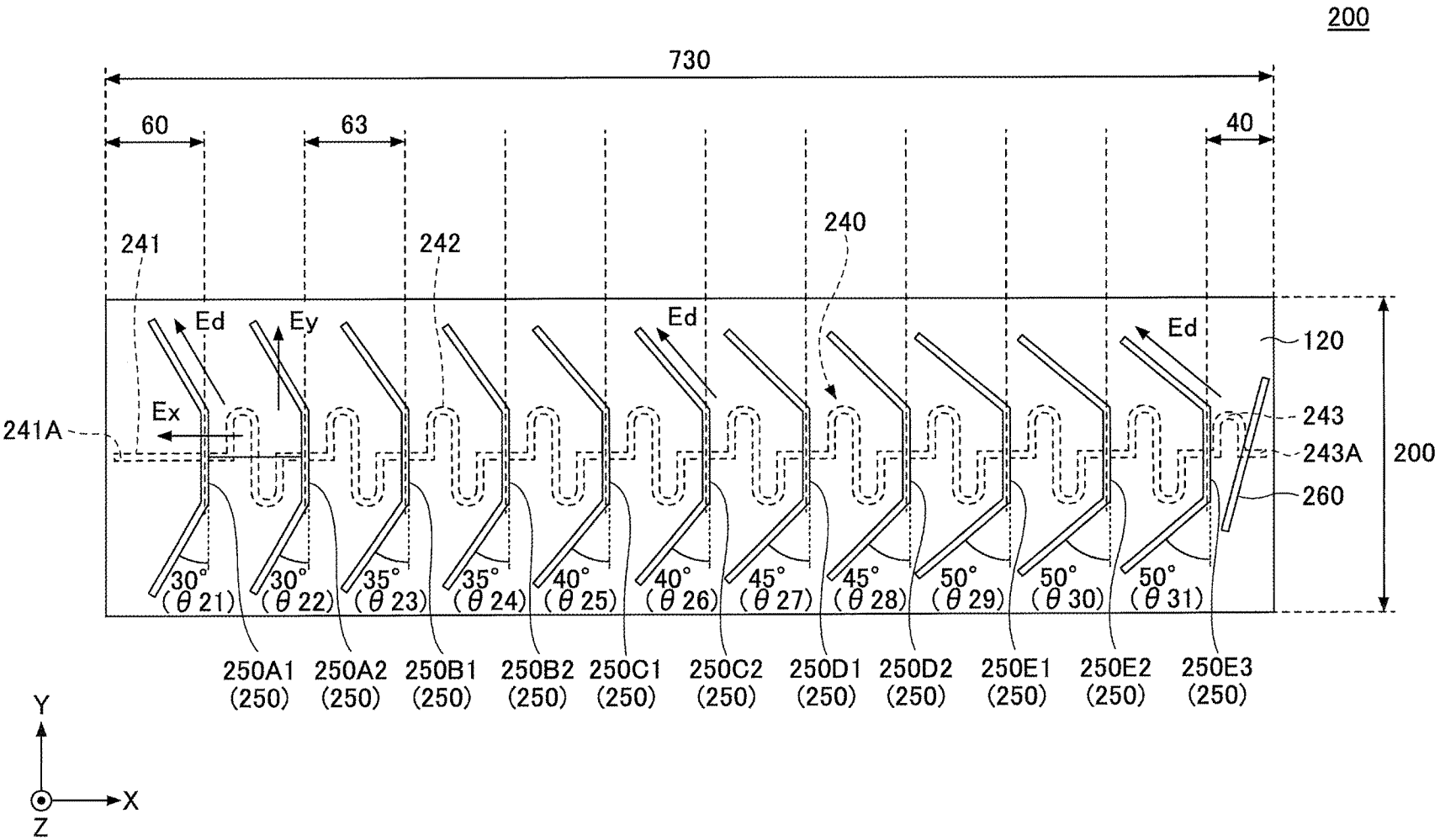
FIG. 12 is an oblique perspective diagram illustrating the antenna apparatus of the second embodiment.

FIG. 11 is an oblique perspective diagram illustrating an antenna apparatus 200 of the second embodiment. FIG. 12 is an oblique perspective diagram illustrating an antenna apparatus 200 of the second embodiment. In the antenna apparatus 200 according to the second embodiment, configuration elements corresponding to the meander conductive line 140 and the conductive strips 150 of the antenna apparatus 100 according to the first embodiment are changed.

Accordingly, the same elements as or elements similar to those of the antenna apparatus 100 of the first embodiment are referred to by the same reference numerals, and a description thereof is omitted. In FIG. 12, principal dimensions are illustrated.

The antenna apparatus 200 includes dielectric layers 110 and 120, a ground plane 130, a meander conductive line 240, conductive strips 250 and a conductive strip 260. The antenna apparatus 200 includes eleven conductive strips 250. In a case where the eleven conductive strips 250 are distinguished from each other, the eleven conductive strips 250 are referred to as conductive strips 250A1, 250A2, 250B1, 250B2, 250C1, 250C2, 250D1, 250D2, 250E1, 250E2 and 250E3. In a case where the conductive strips 250A1 to 250E3 are not distinguished from each other, the conductive strips 250A1 to 250E3 will be described as the conductive strip(s) 250.

In the meander conductive line 240, a meander shape is rounded whereas a meander shape of the meander conductive line 140 of the first embodiment is bent at a right angle. The meander conductive line 240 includes an open end 243A instead of the grounded point 143A of the meander conductive line 140 of the first embodiment.

The meander conductive line 240 is disposed on the top surface of the dielectric layer 110. The meander conductive line 240 is one example of a conductive line. The meander conductive line 240 constitutes the microstripline with the ground plane 130. The microstripline functions as a microstrip-antenna.

The meander conductive line 240 includes a straight portion 241, meander portions 242 and an adjust portion 243. The straight portion 241 extends in X axis direction. An end portion of the straight portion 241 located on negative side in X-axis direction constitutes a first end of the meander conductive line 240 and constitutes a feeding point 241A. This is similar to the straight portion 141 of the first embodiment. Length of the straight portion 241 is 60 mm, for example.

Ten meander portions 242 are connected in series with each other between the straight portion 241 and the adjust portion 243 in a similar manner to that of the ten meander portions 142 of the first embodiment. Since the ten meander portions 242 have similar configuration to each other, the meander portion 242 will be described with reference to FIG. 13. The adjust portion 243 will be described with reference to FIG. 14.

Figure 13:
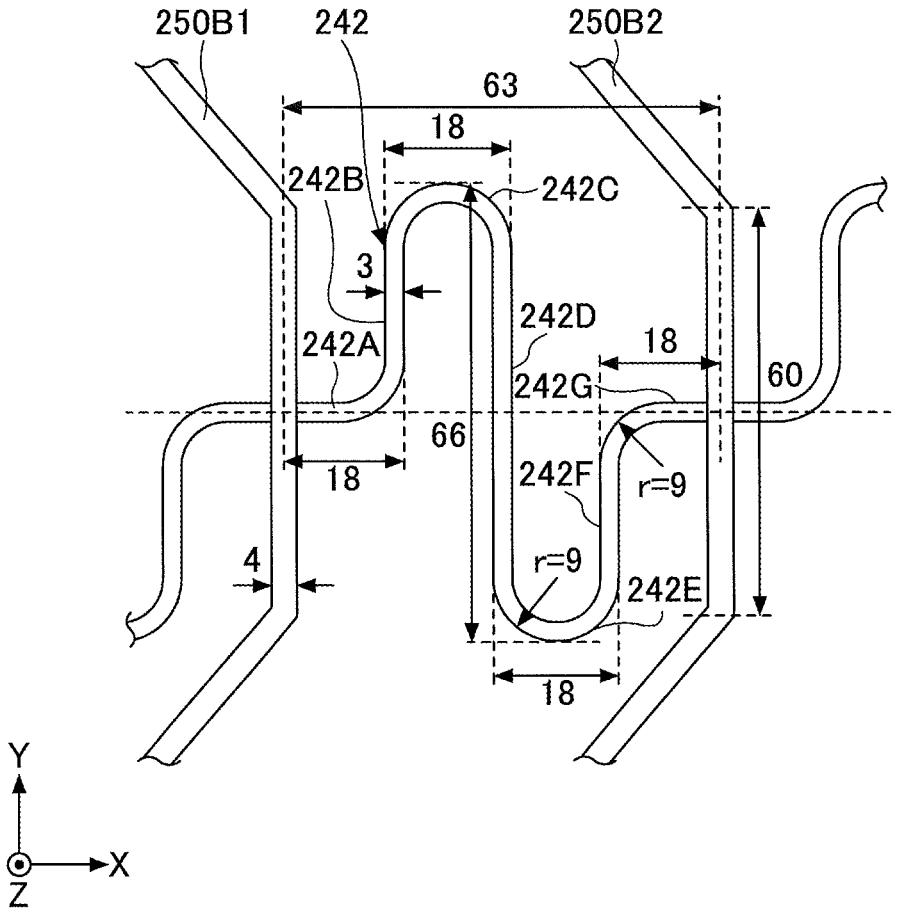
FIG. 13 is a diagram illustrating a meander portion of the second embodiment in plan view.

FIG. 13 is a diagram illustrating the meander portion 242 of the second embodiment in plan view. In FIG. 13, the meander portion 242 located between the conductive strips 250B1 and 250B2 is illustrated.

The meander portion 242 includes line portions 242A, 242B, 242C, 242D, 242E, 242F and 242G. As illustrated in FIG. 13, connecting portions of the line portions 242A, 242B, 242C, 242D, 242E, 242F and 242G are rounded in plan view.

Straight portions and rounded portions included in the line portions 242A, 242B, 242C, 242D, 242E, 242F and 242G have the same width. The width is 3 mm, for example. Radius of curvature of the rounded portions is 9 mm, for example. The radius of curvature is one example of the rounded degree. The line portions 242A, 242B, 242C, 242D, 242E, 242F and 242G have dimensions as illustrated in FIG. 13 other than the dimensions as described above, for example. Unit of dimensions as illustrated in FIG. 13 is mm.

Trace length from a first end at which the meander portion 242 intersects with the conductive strip 250B1 to a second end at which the meander portion 242 intersects with the conductive strip 250B2 is set to a length corresponding to the single wavelength (λ) at the resonant frequency. A gap between the conductive strips 250B1 and 250B2 in X-axis direction is 63 mm, for example.

Figure 14:
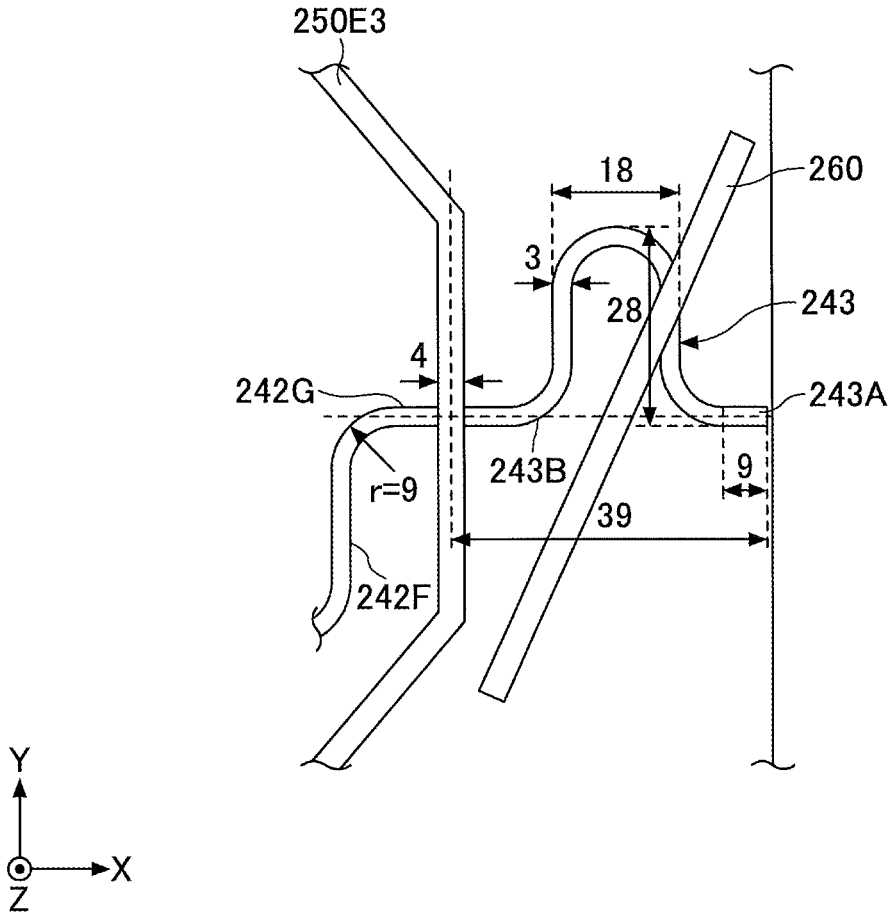
FIG. 14 is a diagram illustrating an adjust portion and a conductive strip of the second embodiment in plan view.

FIG. 14 is a diagram illustrating the adjust portion 243 and the conductive strip 260 of the second embodiment in plan view.

A first end of the adjust portion 243 is connected to a second end of the meander portion 242 farthest from the feeding point 241A, and a second end of the adjust portion 243 is the open end 243A. The open end 243A is opened and is not electrically connected to anything.

The adjust portion 243 extends from the first end located on positive side in X-axis direction, is rounded in circular arc shape, extends in positive Y-axis direction, is rounded in circular arc shape, extends in negative Y-axis direction, is rounded in circular arc shape and extends in positive X-axis direction to the open end 243A in plan view.

Length of the adjust portion 243 between the first end and the second end is set to a length corresponding to the half wavelength (λ/2) at the resonant frequency. Width of the adjust portion 243 is constant from the first end to the second end, and is 3 mm, for example. The adjust portion 243 has dimensions as illustrated in FIG. 14. Unit of dimensions as illustrated in FIG. 14 is mm.

The trace length of the adjust portion 243 including the open end 243A is set to the half wavelength (λ/2) at the resonant frequency. Accordingly, if electrical power is fed into the meander conductive line 240 from the feeding point 241A, current flowing through the meander conductive line 240 is reflected at the open end 243A and a standing wave of the current is generated on the meander conductive line 240.

Nodes of the standing wave occur at eleven locations that are λ/2, λ, 3λ/2, 2λ, 5λ/2, 3λ, 7λ/2, 4λ, 9λ/2, 5λ and 11λ/2 away from the open end 243A, respectively. These lengths are obtained by multiplying integer numbers by the half wavelength at the resonant frequency, respectively.

In other words, the eleven nodes occur at a boundary between the straight portion 241 and the meander portion 242, nine boundaries between the ten meander portions 242, and a boundary between the meander portion 242 and the adjust portion 243, respectively.

Each of the nodes of the standing wave of current is a point where current value becomes zero and electric field becomes the maximum value. In the antenna apparatus 200 of the second embodiment, the conductive strips 250 are disposed on the meander conductive line 240 via the dielectric layer 120 and intersect with the meander conductive line 240 at the locations of the nodes of the standing wave of the current, in order to electromagnetically couple the meander conductive line 240 and the conductive strips 250 and to maximize the electric field generated by the conductive strips 250.

The microstrip-antenna including the meander conductive line 240 makes it possible to perform a communication in the near field by utilizing electric field which leaks from the top surface of the microstrip-antenna. Herein, the electric field which leaks from the top surface of the microstrip-antenna is referred to as leak electric field.

Although the eleven conductive strips 250 as illustrated in FIG. 11 have three straight portions, respectively, in a manner similar to that of the conductive strips 150 as illustrated in FIG. 3, lengths and angles θ of the eleven conductive strips 250 are different from the lengths and the angles θ of the conductive strips 150.

Herein, the conductive strip 260 is described before describing the lengths and the angles θ of the eleven conductive strip 250.

The conductive strip 260 is one example of a second conductive element. The conductive strip 260 is disposed on the top surface of the dielectric layer 120 so that the conductive strip 260 intersects with the adjust portion 243 at a location corresponding to the antinode of the standing wave of the current flowing through the meander conductive line 240 on the positive side of the conductive strip 250E3 in X-axis direction in plan view.

Herein, the location corresponding to the antinode is not limited to the location of the antinode of the standing wave of the current, but also include the location where magnetic field coupling similar to that obtained in a case where the conductive strip 260 is placed at the location of the antinode is obtained. The location corresponding to the antinode is placed nearer the antinode than a mid-point between the antinode and the node. The reason why the location corresponding to the antinode is not limited to the exact location of the antinode is because there may be a case where the antenna apparatus 200 does not include enough space to dispose the conductive strip 260.

The conductive strip 260 is placed at the location corresponding to the antinode for the sake of improving the distribution of the electromagnetic field on the positive side of the conductive strip 250E3 in X-axis direction. This principle is similar to that of the conductive strip 160 of the second embodiment.

The length of the conductive strip 260 is the half wavelength (λ/2) at the resonant frequency. The conductive strip 260 is a straight-shaped conductive pattern and is disposed on the top surface of the dielectric layer 120 so that the center point of the conductive strip 260 in the longitudinal direction is placed on a central axis indicated by dashed line in plan view. The conductive strip 260 extends obliquely with respect to X-axis and Y-axis. The central axis is a central axis of the top surface of the dielectric layer 120 which extends along X-axis direction.

The conductive strip 260 is made by patterning a copper foil, for example. The line width of the conductive strip 250 is set to 4 mm, for example. The copper foil used for forming the conductive strip 260 may be the same as the copper foil used for forming the conductive strip 250.

Since the length of the conductive strip 260 is set to the half wavelength (λ/2) at the resonant frequency, the conductive strip 260 functions as the resonator (second resonator). In the conductive strip 260, the current becomes the maximum value at the center point in the longitudinal direction and becomes zero at the end portions in the longitudinal direction. Accordingly, the magnetic field generated by the conductive strip 260 becomes the maximum value at the center point of the conductive strip 260 in the longitudinal direction.

It is possible to improve the distribution of the electromagnetic field on the positive side of the conductive strip 250E3 in X-axis direction by causing the conductive strip 260 to be coupled with the meander conductive line 240 by the magnetic field.

According to the second embodiment, it is possible to provide the antenna apparatus 200 which can generate the electric field having sufficient uniformity and intensity in the near field by electromagnetically coupling the conductive strips 250 with the microstrip-antenna. The microstrip-antenna includes the meander conductive line 240 and the ground plane 130. Further, it is possible to provide the antenna apparatus 200 which can generate the magnetic field having sufficient intensity on the positive side of the conductive strip 250E3 in X-axis direction in the near field by electromagnetically coupling the conductive strip 260 with the microstrip-antenna.

Since the feeding point 241A is located on negative side of the conductive strip 250A1 in X-axis direction and the open end 243A is located on positive side of the conductive strip 250E3 in X-axis direction, there is an inclination that the distribution of the electric field in the area located on positive side of the conductive strip 250E3 in X-axis direction becomes weaker than that in the area located on negative side of the conductive strip 250A1 in X-axis direction and the area between the conductive strips 250A1 and 250E3. Decrease or ununiformity of the distribution of the electric field makes the communication area narrow.

Therefore, the conductive strip 260 is disposed on the positive side of the conductive strip 250E3 in X-axis direction for the sake of reinforcing or broadening the communication area on the positive side of the conductive strip 250E3 in X-axis direction. The communication area is provided by the magnetic field generated by the conductive strip 260.

Next, the lengths and angles θ of the eleven conductive strips 250 is described. Hereinafter, the lengths of the conductive strips 250A1, 250A2, 250B1, 250B2, 250C1, 250C2, 250D1, 250D2, 250E1, 250E2 and 250E3 are referred to as L21, L22, L23, L24, L25, L26, L27, L28, L29, L30 and L31, respectively.

The angles θ included in the conductive strips 250A1, 250A2, 250B1, 250B2, 250C1, 250C2, 250D1, 250D2, 250E1, 250E2 and 250E3 will be referred to as angles θ21, θ22, θ23, θ24, θ25, θ26, θ27, θ28, θ29, θ30 and θ31, respectively. Each of the angles θ21 to θ31 is formed by three straight portions included in each of the conductive strips 250A1 to 250E3 as illustrated in FIG. 12.

The lengths L21 and L22 are 173 mm, for example. The lengths L23 and L24 are 175 mm, for example. The lengths L25 and L26 are 177 mm, for example. The lengths L27 and L28 are 175 mm, for example. The lengths L29, L30 and L31 are 173 mm, for example.

As described above, according to the antenna apparatus 200 of the second embodiment, the lengths L25 and L26 of the conductive strips 250C1 and 250C2 that are disposed in the middle in X-axis direction are the longest. On the other hand, the lengths L21, L22, L29, L30 and L31 of the conductive strips 250A1, 250A2, 250E1, 250E2 and 250E3 that are disposed on both ends in X-axis direction are the shortest.

Herein, the lengths L21 to L31 are lengths corresponding to the single wavelength (λ) at the resonant frequency.

The angles θ21 and θ22 are 30 degrees, for example. The angles θ23 and θ24 are 35 degrees, for example. The angles θ25 and θ26 are 40 degrees, for example. The angles θ27 and θ28 are 45 degrees, for example. The angles θ29, θ30 and θ31 are 50 degrees, for example.

As described above, the angles θ21 to θ31 included in the conductive strips 250A1 to 250E3 becomes smaller in an area closer to the feeding point 241A and becomes larger in an area closer to the open end 243A.

The lengths L21 to L31 and the angles θ21 to θ31 are optimum values derived from the electromagnetic field simulation utilizing the Finite Element Method.

Herein, for the sake of validating an effect of the different lengths L21 to L31 of the conductive strips 250A1 to 250E3 as described above, a comparison result of S11 parameter of the antenna apparatus 200 according to the second embodiment and S11 parameter of an antenna apparatus of a comparative example will be described with reference to FIG. 15. In the antenna apparatus of the comparative example, the lengths L21 to L31 are set to 186 mm.

Figure 15:
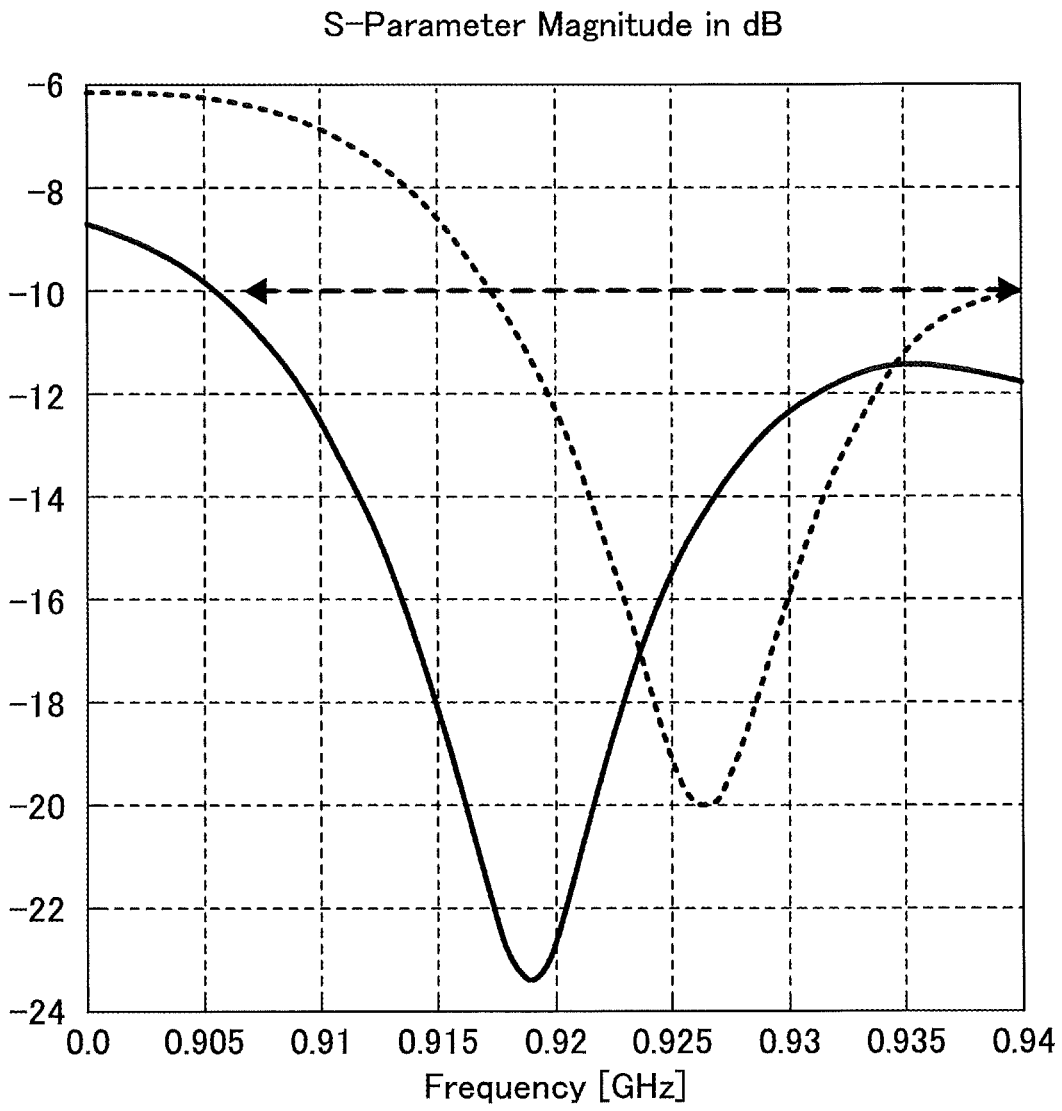
FIG. 15 is a diagram illustrating frequency characteristics of S11 parameter of the antenna apparatus according to the second embodiment and S11 parameter of an antenna apparatus of a comparative example.

FIG. 15 is a diagram illustrating frequency characteristics of the S11 parameter of the antenna apparatus 200 according to the second embodiment and the S11 parameter of the antenna apparatus of the comparative example. The frequency characteristics of S11 parameter of the antenna apparatus 200 is obtained in a condition where the antenna apparatus 200 does not include the conductive strip 260. It is experimentally verified that the antenna apparatus 200 which includes the conductive strip 260 has wider communication area than that of the antenna apparatus 200 which does not include the conductive strip 260 and that the antenna apparatus 200 which includes the conductive strip 260 can read the RFID tags in a broader area than the antenna apparatus 200 which does not include the conductive strip 260. However, the frequency characteristics of S11 parameter of the antenna apparatus 200 which does not include the conductive strip 260 will be described.

In FIG. 15, a solid line represents the frequency characteristics of the S11 parameter obtained from the antenna apparatus 200. A dashed line represents the frequency characteristics of the S11 parameter obtained from the antenna apparatus of the comparative example. In the antenna apparatus of the comparative example, the lengths L21 to L31 of the eleven conductive strips 250A1 to 250E3 are set to 186 mm.

Both S11 parameters are calculated under a condition where values of S11 parameter of the antenna apparatus 200 and the S11 parameter of antenna apparatus of the comparative example take almost the same values at 935 MHz. A criterion value of S11 parameter is −10 dB.

As illustrated in FIG. 15, a bandwidth in which the value of S11 parameter of the antenna apparatus 200 is less than or equal to −10 dB is wider than that of the antenna apparatus of the comparative example.

Accordingly, it becomes possible to widen the bandwidth by setting the lengths L21 to L31 of the conductive strips 250A1 to 250E3 to the different lengths as described above. Similar results will be obtained with the antenna apparatus 200 including the conductive strip 260.

Next, a simulation result of electric field vector was obtained at a point 400 mm high from the top surface of the dielectric layer 110 of the antenna apparatus 200 while varying a phase ϕ of the input signal fed into the feeding point 241A of the antenna apparatus 200.

Figure 16:
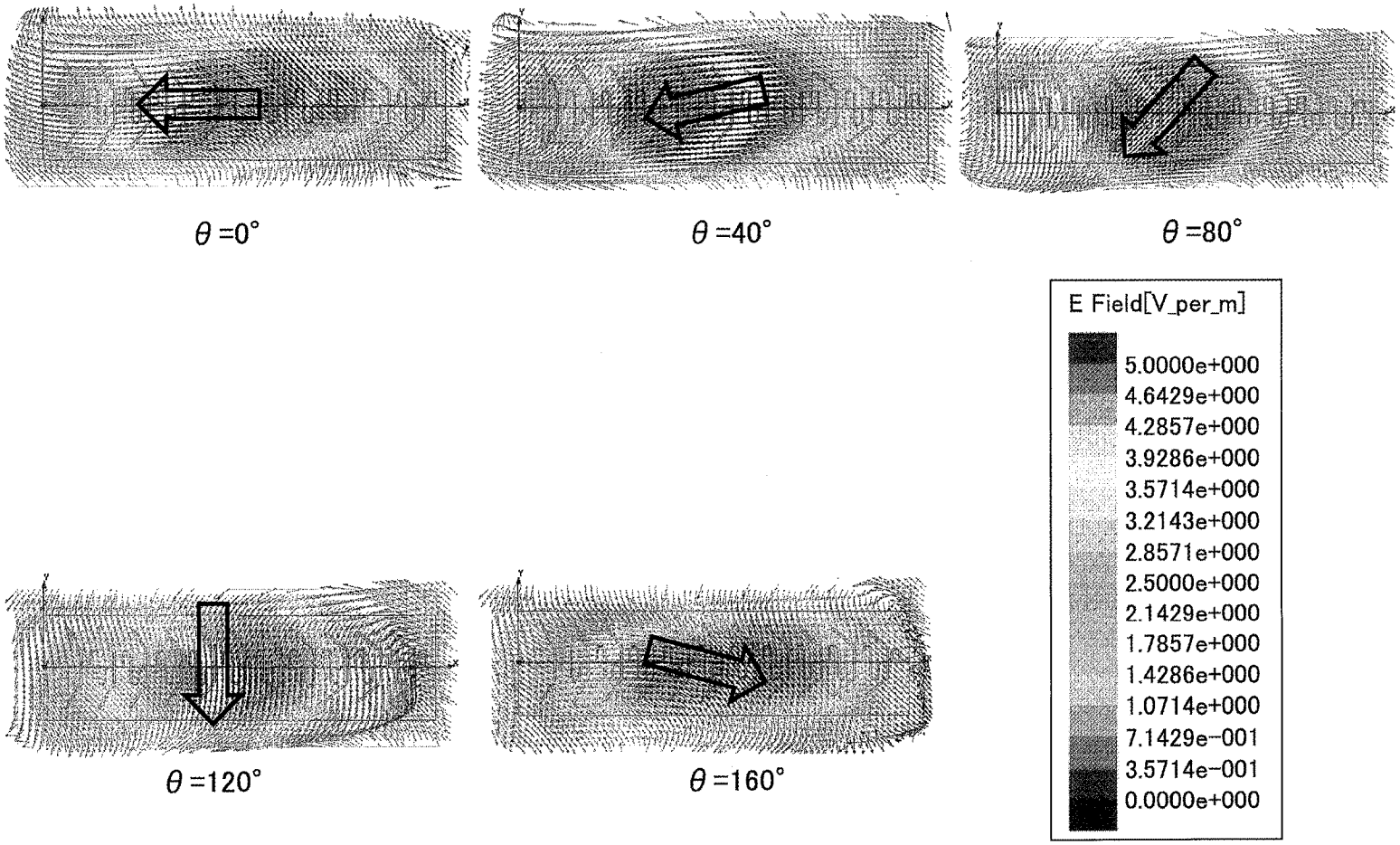
FIG. 16 illustrates simulation results of electric field vector of the antenna apparatus.
Figure 17:
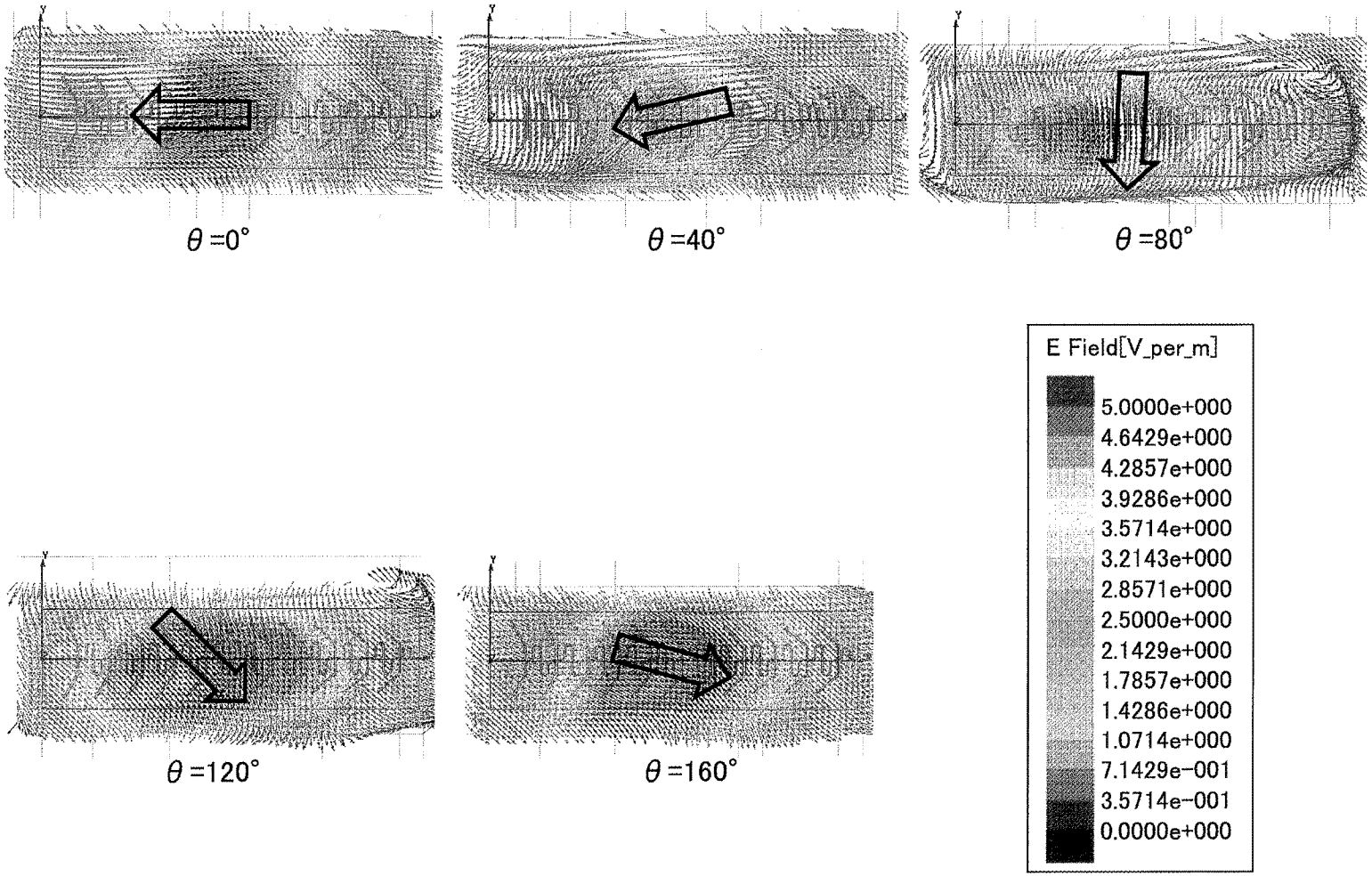
FIG. 17 illustrates simulation results of electric field vector of the antenna apparatus.
Figure 18:
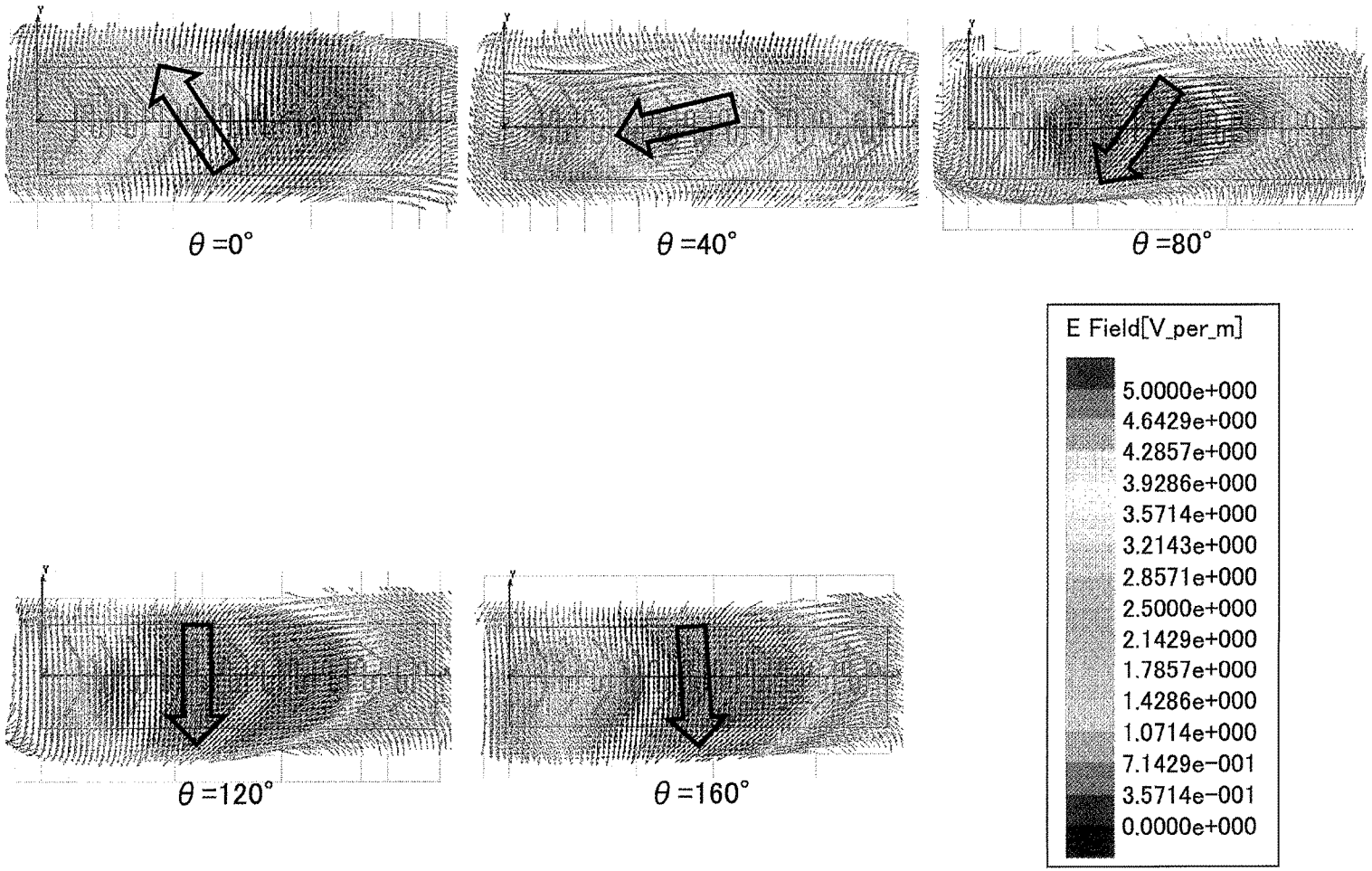
FIG. 18 illustrates simulation results of electric field vector of the antenna apparatus.

FIGS. 16 to 18 are diagrams illustrating the simulation results of the electric field vector of the antenna apparatus 200. Similar to the frequency characteristics as illustrated in FIG. 15, the simulation results as illustrated in FIGS. 16 to 18 are obtained from the antenna apparatus 200 which does not include the conductive strip 260. It is experimentally verified that the antenna apparatus 200 which includes the conductive strip 260 has wider communication area than that of the antenna apparatus 200 which does not include the conductive strip 260 and that the antenna apparatus 200 which includes the conductive strip 260 can read the RFID tags in a broader area than the antenna apparatus 200 which does not include the conductive strip 260. However, the simulation results of the electric field vector of the antenna apparatus 200 which does not include the conductive strip 260 will be described.

FIGS. 16 to 18 illustrate the simulation results of the electric field vector of the antenna apparatus 200 to which the input signals of 919 MHz, 910 MHz and 930 MHz are fed into the feeding point 241A, respectively.

Each of FIGS. 16 to 18 illustrates the five simulation results of the electric field vector of the antenna apparatus 200 at moments when the phase ϕ becomes 0 degrees, 40 degrees, 80 degrees, 120 degrees and 160 degrees, respectively. In these FIGS., distributions and directions of the electric field vector are illustrated. The phase ϕ of the input signal represents a phase during one cycle (360 degrees) at 919 MHz, 910 MHz and 930 MHz.

In actual simulation results, the electric field intensities are represented in full color, i.e. 0 V/m is indicated by blue (see the bottom of legend is FIGS. 16 to 18) and 5 V/m is indicated by red (see the bottom of legend is FIGS. 16 to 18). Since the electric field intensities are represented by achromatic color in FIGS. 16 to 18, it is not possible to distinguish 5 V/m and 0 V/m.

However, the strong electric fields that are represented in red in the actual simulation result are located in a central portion of the antenna apparatus 200 in plan view, and the weak electric fields that are represented in blue in the actual simulation result are located in the peripheral portion of the antenna apparatus 200 in plan view.

Accordingly, large arrows that represent principal directions of the strong electric field are added to the central portions in FIGS. 16 to 18.

As illustrated in FIG. 16, when the phase ϕ of the input signal of 919 MHz is 0 degrees, the principal directions of the strong electric fields that occur in the central portion of the antenna apparatus 200 are negative X axis direction.

As the phase ϕ of the input signal of 919 MHz varies to 40 degrees, 80 degrees, 120 degrees and 160 degrees, the principal directions of the strong electric fields vary in counterclockwise direction. When the phase ϕ of the input signal of 919 MHz is 160 degrees, the principal directions of the strong electric fields are positive X axis direction.

This means that the principal directions of the strong electric fields that occur on the top surface of the antenna apparatus 200 rotate in a circular polarization manner as the phase ϕ of the input signal varies.

An inclination such as this can be seen in a case where the input signals of 910 MHz and 930 MHz are input to the feeding point 241A of the antenna apparatus 200 as illustrated in FIGS. 17 and 18.

According to the second embodiment, it is possible to provide the antenna apparatus 200 which generates the electric field of which the direction rotates in a circular polarization manner as the phase ϕ of the input signal of 919 MHz, 910 MHz and 930 MHz varies.

As described above, the direction of the electric field generated on the surface of the antenna apparatus 200 varies in response to the phase ϕ of the input signal. Accordingly, it is possible to read the identification information of the RFID tag which is attached to the merchandise arranged on the shelf 501 in a state where the antenna apparatus 200 is provided on the shelf 501, even if the merchandise is disposed on the shelf 501 in any direction.

As described above, it is experimentally verified that the antenna apparatus 200 which includes the conductive strip 260 has wider communication area than that of the antenna apparatus 200 which does not include the conductive strip 260 and that the antenna apparatus 200 which includes the conductive strip 260 can read the RFID tags in a broader area than the antenna apparatus 200 which does not include the conductive strip 260. Such an improvement of the antenna apparatus 200 is confirmed by the measured results obtained from the experiment in which the RFID tags are attached to towels.

According to the second embodiment, it is possible to provide the antenna apparatus 200 which can generate the electric field having sufficient uniformity and intensity in the near field by electromagnetically coupling the conductive strips 250 with the microstrip-antenna. The microstrip-antenna includes the meander conductive line 240 and the ground plane 130. Further, it is possible to provide the antenna apparatus 200 which can generate the magnetic field having sufficient intensity on the positive side of the conductive strip 250E3 in X-axis direction in the near field by electromagnetically coupling the conductive strip 260 with the microstrip-antenna.

Although the simulation results as illustrated in FIGS. 15 to 18 were derived with respect to the antenna apparatus 200 of the second embodiment, it is presumed that similar results can be obtained with respect to the antenna apparatus 100 of the first embodiment.

Third Embodiment

Antenna apparatuses according to third to sixth embodiments use a micro-strip line, one end of which is connected to a power feeding port and the other end of which is an open end, as a micro-strip antenna in a manner similar to the first and the second embodiments. Therefore, in the antenna apparatuses, a current which flows through the micro-strip antenna is reflected by the open end, whereby the current forms a standing wave. The antenna apparatuses include at least one conductor for resonance in a region where electromagnetic coupling is possible with the micro-strip antenna. The region is in the vicinity of any of nodal points of the standing wave, i.e., any of positions where flowing current is minimum and the intensity of the electric field around the position is maximum. This causes an improvement of the uniformity and intensity of the electric field in the vicinity of an antenna surface.

In each embodiment described below, each antenna apparatus disclosed in this specification is formed as an antenna apparatus. However, the antenna apparatuses disclosed in this specification may be utilized for purposes other than the antenna apparatus.

Figure 19:
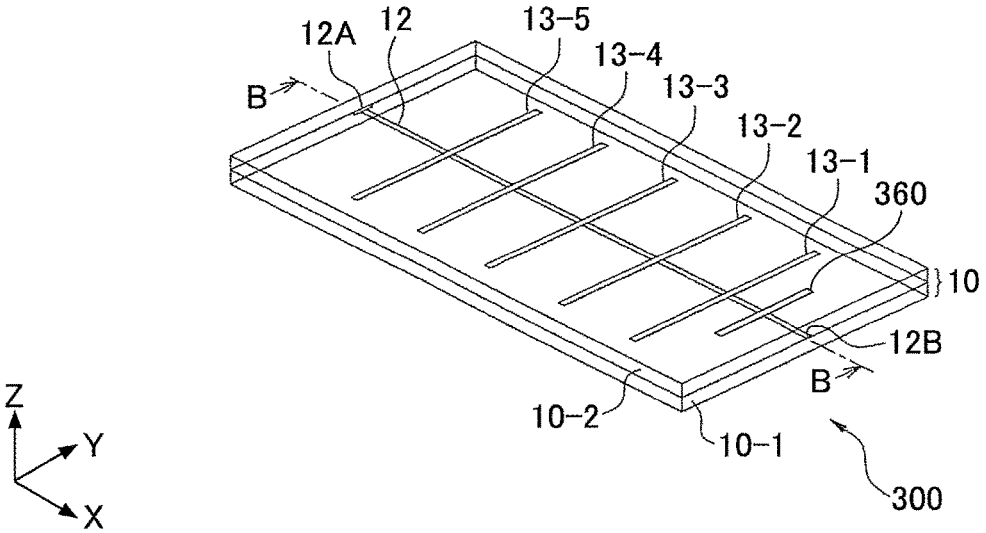
FIG. 19 is a perspective view of an antenna apparatus according to a third embodiment.
Figure 20:
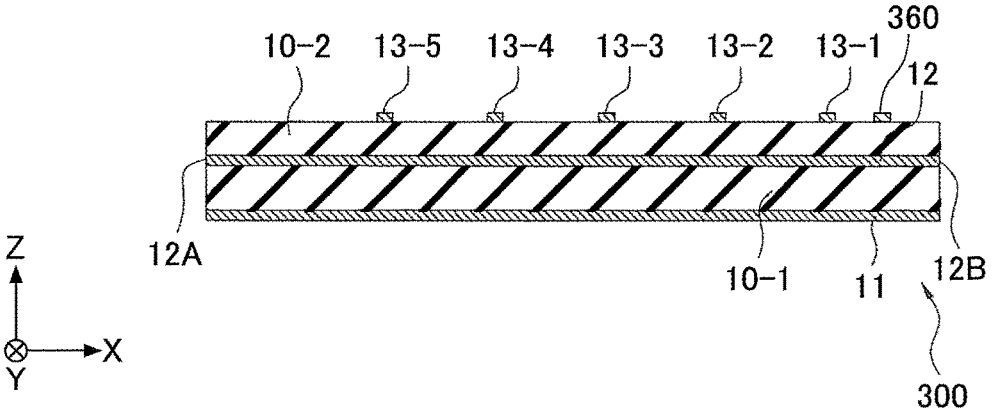
FIG. 20 is a side cross-sectional view of the antenna apparatus along a line B-B seen from a direction of an arrow in FIG. 19.
Figure 21:
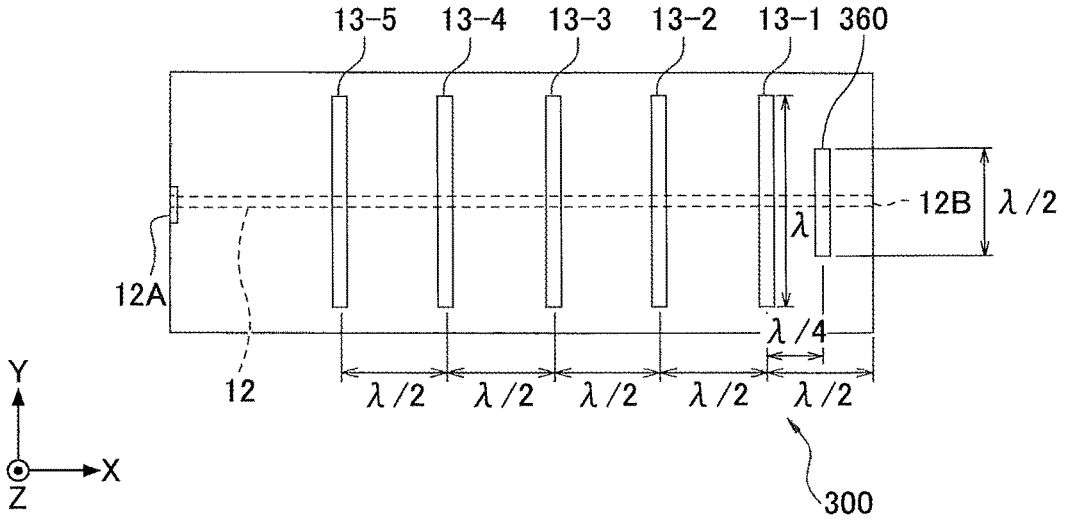
FIG. 21 is a plan view of the antenna apparatus as illustrated in FIG. 19.

FIG. 19 is a perspective view of an antenna apparatus according to a third embodiment. FIG. 20 is a side cross-sectional view of the antenna apparatus along a line B-B seen from a direction of an arrow in FIG. 19. FIG. 21 is a plan view of the antenna apparatus as illustrated in FIG. 19.

The antenna apparatus 300 includes a substrate 10 which includes two dielectric layers, a ground electrode 11 provided under the substrate 10, a conductor 12 provided between the two dielectric layers of the substrate 10, a plurality of resonators 13-1 to 13-5 provided on an upper surface of the substrate 10, and a conductive strip 360.

The conductive strip 360 is disposed on a top surface of an upper layer 10-2 and intersects with the conductive line 12 in plan view. Otherwise, the conductive strip 360 is similar to the conductive strip 260 of the second embodiment. The conductive line 12 corresponds to the meander conductive line 240 of the second embodiment. The conductive line 12 has a straight-shape in plan view. The conductive line 12 is obtained by modifying the meander conductive line 240 into the straight-shape in plan view. The resonators 13-1 to 13-5 correspond to the conductive strips 250 of the second embodiment. The substrate 10 includes a lower layer 10-1 and the upper layer 10-2. The lower layer 10-1 and the upper layer 10-2 correspond to the dielectric layers 110 and 120 of the second embodiment, respectively. The grounded electrode 11 corresponds to the ground plane 130 of the second embodiment.

The substrate 10 supports the ground electrode 11, the conductor 12, and the resonators 13-1 to 13-5. The substrate 10 includes a lower layer 10-1 located in relatively lower side, and an upper layer 10-2 arranged above the lower layer 10-1. Both of the lower layer 10-1 and the upper layer 10-2 of the substrate 10 are formed with a dielectric, and accordingly, the ground electrode 11, the conductor 12, and the resonator 13-1 to 13-5 are isolated each other. For example, the lower layer 10-1 and the upper layer 10-2 may be formed of a glass epoxy resin such as FR-4, respectively. Alternatively, the lower layer 10-1 and the upper layer 10-2 may be formed of other dielectric which can be layered. Moreover, the lower layer 10-1 and the upper layer 10-2 may be formed with the same dielectric, or may be formed with different dielectrics.

The ground electrode 11 is a grounded plain-plate-like conductor, and is provided so that the overall lower surface of the substrate 10 may be covered.

The conductor 12 is a conductor in the form of a line provided between the lower layer 10-1 and the upper layer 10-2 of the substrate 10, and one end of the conductor 12 is a power feeding port 12*a*. On the other hand, the other end 12*b* of the conductor 12 is an open end. The conductor 12, the ground electrode 11, and the lower layer 10-1 of the substrate 10 forms the micro-strip antenna.

Since the end 12*b* of the conductor 12 is the open end, the current which flows through the conductor 12 due to the electric wave radiated from the micro-strip antenna, or due to the electric wave received by the micro-strip antenna forms a standing wave. Therefore, nodal points of the standing wave are formed at a distance of half-wavelength of the current and distances of integral multiples thereof from the end 12*b* of the conductor 12, i.e., from the open end of the micro-strip antenna. It is noted that, since the conductor 12 is located between the lower layer 10-1 and the upper layer 10-2, the wavelength of the electric wave shortens depending on the relative permittivity of the lower layer 10-1 and the relative permittivity of the upper layer 10-2. At each nodal point of the standing wave, the current has a local minimum value, and a relatively strong electric field is formed around the nodal point. Hereinafter, the wavelength of the electric wave radiated from the micro-strip antenna or received by the micro-strip antenna in the substrate 10 is referred to as a design wavelength for the sake of simplicity.

Each of the resonators 13-1 to 13-5 is formed with a conductor in the form of a line which has a length substantially equal to the design wavelength or integral multiples thereof, and is provided on the surface of the upper layer 10-2 of the substrate 10. In the present embodiment, the length of each resonator is substantially equal to the design wavelength.

As described above, the relatively strong electric field is formed around the conductor 12 at the distance of half design wavelength and distances of integral multiples thereof from the open end 12*b* of the micro-strip antenna along with the conductor 12. Therefore, each of the resonators 13-1 to 13-5 is arranged, along with the conductor 12, at the distance of half design wavelength and distances of substantially integral multiples thereof from the end 12*b* of the conductor 12, so that the resonator crosses the conductor 12 perpendicular thereto. In the present embodiment, the resonators 13-1 to 13-5 are arranged in the vicinity of positions where are spaced from the open end 12*b* at distances of .lamda./2, .lamda., 3.lamda./2, 2.lamda. and 5.lamda./2, respectively (.lamda. denotes the design wavelength). Accordingly, each resonator 13-1 to 13-5 is electromagnetically coupled with the micro-strip antenna with respect to an electric wave which has the design wavelength. Therefore, each resonator 13-1 to 13-5 can radiate or receive the electric wave with the design wavelength. Furthermore, since the resonators 13-1 to 13-5 are arranged so that the resonators cross the conductor 12 perpendicular thereto, each of the resonators 13-1 to 13-5 can form the electric field which expands in a different direction from the electric field due to the micro-strip antenna. As a result, uniformity and intensity of the electric field in the vicinity of the surface of the antenna apparatus 300 are improved in comparison with the electric field produced by only the micro-strip antenna.

In addition, for example, based on a result of an electric field simulation using a finite element method, the exact arrangement position of each resonator 13-1 to 13-5 is adjusted so that the electromagnetic coupling between each resonator 13-1 to 13-5 and the micro-strip antenna may be the strongest. Moreover, the length of each resonator may be determined, based on the result of the electric field simulation using the finite element method, so that the electric field radiated from each resonator 13-1 to 13-5 may be the strongest.

The ground electrode 11, the conductor 12, and the resonators 13-1 to 13-5 are made of, for example, metal such as copper, gold, silver and nickel, alloys thereof, or other material which has conductivity. The ground electrode 11, the conductor 12, and the resonators 13-1 to 13-5 are fixed to the lower layer 10-1 or the upper layer 10-2 of the substrate 10 by etching or adhesion, for example. Moreover, the lower layer 10-1 and the upper layer 10-2 are also fixed to each other by adhesion, for example.

The thickness of the upper layer 10-2 is optimized by a simulation using a finite element method so that the micro-strip antenna and each resonator 13-1 to 13-5 are electromagnetically coupled. On the other hand, the thickness of the lower layer 10-1 is determined so that the characteristic impedance of the micro-strip antenna is a certain value, for example, 50Ω or 75Ω.

The conductive strip 360 is one example of a second conductive element. The conductive strip 360 is disposed on the top surface of the upper layer 10-2 so that the conductive strip 360 intersects with the conductive line 12 at right angle at a location corresponding to the antinode of the standing wave of the current flowing through the conductive line 12 on the positive side of the resonator 13-1 in X-axis direction in plan view. Since a length of the conductive line 12 between the resonator 13-1 and the open end 12B is a half wavelength (λ/2) at the resonant frequency, the conductive strip 360 is placed at a location shifted by a quarter wavelength (λ/4) on the positive side in X-axis direction, i.e., on the side of the open end 12B. The length of the conductive line 12 between the conductive strip 360 and the open end 12B is the quarter wavelength (λ/4) at the resonant frequency.

Next, simulation results of the frequency characteristics of the S11 parameter of the antenna apparatus 300 is described with reference to FIG. 22. The frequency characteristics of S11 parameter of the antenna apparatus 300 is obtained in a condition where the antenna apparatus 300 does not include the conductive strip 360. It is experimentally verified that the antenna apparatus 300 which includes the conductive strip 360 has wider communication area than that of the antenna apparatus 300 which does not include the conductive strip 360 and that the antenna apparatus 300 which includes the conductive strip 360 can read the RFID tags in a broader area than the antenna apparatus 300 which does not include the conductive strip 360. However, the frequency characteristics of S11 parameter of the antenna apparatus 300 which does not include the conductive strip 360 will be described.

Figure 22:
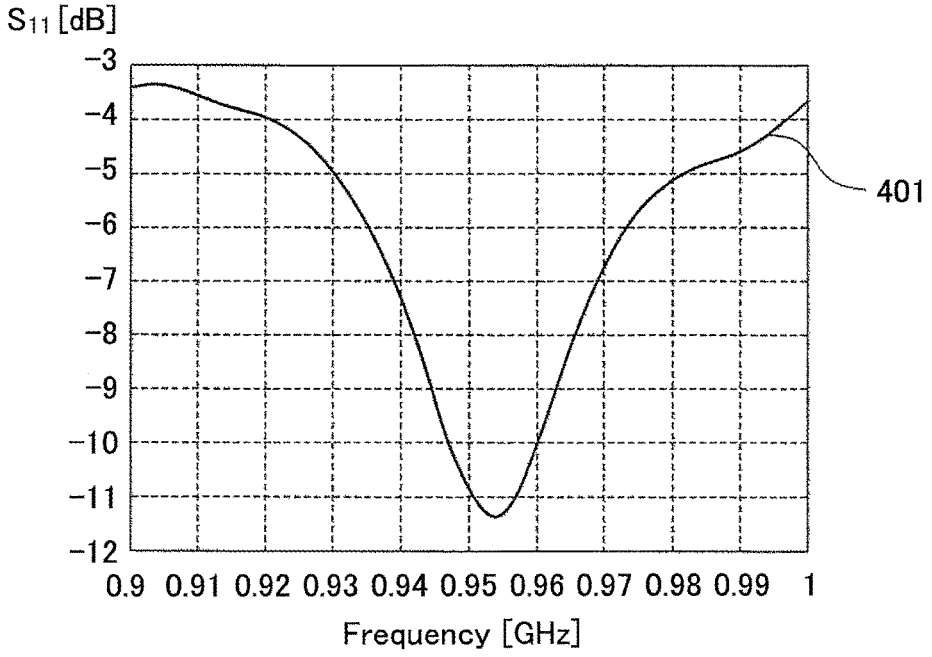
FIG. 22 is a drawing illustrating a simulation result of frequency characteristic of S parameter with respect to the antenna apparatus according to the third embodiment.
Figure 23:
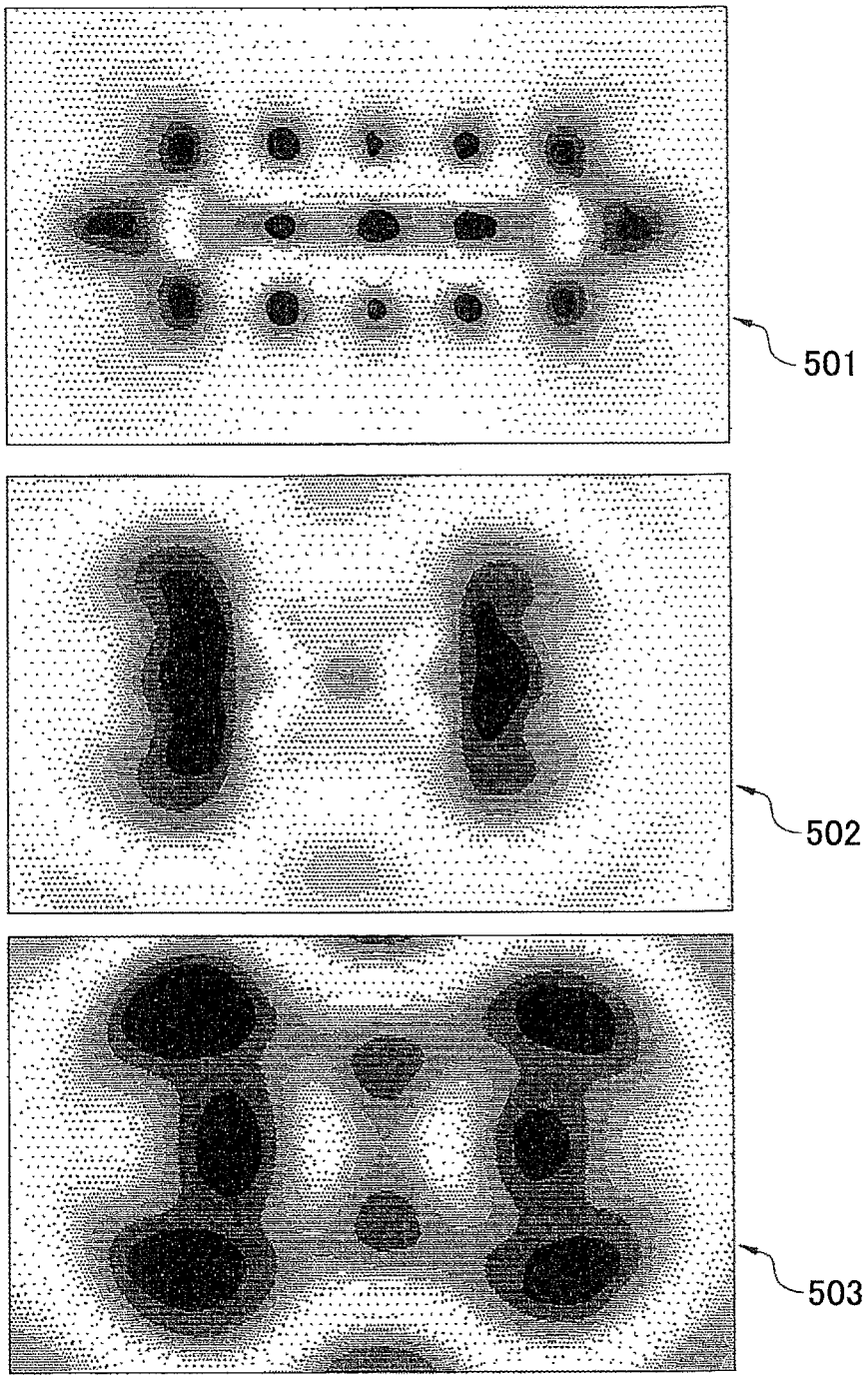
FIG. 23 illustrates simulation results of the electric field formed in surface's vicinity of the antenna apparatus according to the third embodiment.

FIG. 22 is a drawing illustrating a simulation result of frequency characteristic of S parameter with respect to the antenna apparatus 300. FIG. 23 is drawings illustrating simulation results of the electric field formed in surface's vicinity of the antenna apparatus 300. With respect to the simulation results of which are illustrated in FIG. 22 and FIG. 23, the condition of the simulation is defined as follows. Both of the lower layer 10-1 and the upper layer 10-2 of the substrate 10 are formed by FR4 (relative permittivity .di-elect cons.r=4.4, and dielectric tangent tan .delta.=0.02). The length of the substrate 10 along a longitudinal direction of the conductor 12 is 550 mm, and the length of the substrate 10 along a direction perpendicular to the longitudinal direction of the conductor 12 is 200 mm. The thickness of the lower layer 10-1 is 1.6 mm so that the characteristic impedance of the micro-strip line formed with the lower layer 10-1, the ground electrode 11 and the conductor 12 is 50Ω. The thickness of the upper layer 10-2 is 1.0 mm.

The ground electrode 11, the conductor 12 and the resonators 13-1 to 13-5 are formed with copper (electric conductivity .sigma.=5.8.times.10.sup.7). Furthermore, the width of the conductor 12 is 3 mm. On the other hand, the width of each resonator 13-1 to 13-5 is 4 mm, and the length of each resonator is 161 mm. The distance from the open end 12*b* of the conductor 12 to the center line of the resonator 13-1 is 84 mm. Furthermore, the distance between the center line of the resonator 13-1 and the center line of the resonator 13-2 is 85 mm. Similarly, the distance between the center line of the resonator 13-2 and the center line of the resonator 13-3, the distance between the center line of the resonator 13-3 and the center line of the resonator 13-4, and the distance between the center line of the resonator 13-4 and the center line of the resonator 13-5 are 82 mm, 85 mm and 85 mm, respectively.

In FIG. 22, a horizontal axis represents frequency [GHz] and a vertical axis represents value [dB] of S.sub.11 parameter. The characteristics 401 represent the frequency characteristics of the S.sub.11 parameter of the antenna apparatus 300, obtained by a simulation of electromagnetic field according to a finite element method. As illustrated in the characteristics 401, it is found that the S.sub.11 parameter of the antenna apparatus 300 is −10 dB or less, the range providing an indication of excellent antenna characteristics, in 950 MHz to 960 MHz utilized for an RFID system.

Next, a distribution of an intensity of the electric field parallel to the surface of the antenna apparatus 300 is described with reference to FIG. 23. The the distribution of the intensity of the electric field as illustrated in FIG. 23 is obtained in a condition where the antenna apparatus 300 does not include the conductive strip 360. It is experimentally verified that the antenna apparatus 300 which includes the conductive strip 360 has wider communication area than that of the antenna apparatus 300 which does not include the conductive strip 360 and that the antenna apparatus 300 which includes the conductive strip 360 can read the RFID tags in a broader area than the antenna apparatus 300 which does not include the conductive strip 360. However, the distribution of the intensity of the electric field of the antenna apparatus 300 which does not include the conductive strip 360 will be described.

In FIG. 23, the distribution chart 501 represents the intensity distribution of the electric field on a plane which is parallel to the surface of the antenna apparatus 300 at a distance of 50 mm above from the surface of the antenna apparatus 300. The distribution chart 502 represents the intensity distribution of the electric field on a plane which is parallel to the surface of the antenna apparatus 300 at a distance of 100 mm above from the surface of the antenna apparatus 300. The distribution chart 503 represents the intensity distribution of the electric field on a plane which is parallel to the surface of the antenna apparatus 300 at a distance of 200 mm above from the surface of the antenna apparatus 300. In each distribution charts, the frequency of the electric wave is 950 MHz. In each distribution chart, the area which has deeper color represents a stronger electric field. As illustrated in the distribution charts 501 to 503, it is found that the electric field is strong not only in the vicinity of the conductor 12 but also in the vicinity of each resonator 13-1 to 13-5. Therefore, it is found that the uniformity of the electric field in the vicinity of the surface of the antenna apparatus 300 is improved in comparison with the uniformity of the electric field formed by the micro-strip antenna itself. The maximum values of the intensities of the electric field at the distances 50 mm, 100 mm, and 200 mm above from the surface of the antenna apparatus 300 are 9.7 V/m, 2.9 V/m and 1.2 V/m, respectively.

According to above-described configuration, in this antenna apparatus, the current which flows through the micro-strip antenna forms a standing wave by forming one end of the micro-strip antenna as the open end. Then, the micro-strip antenna and the resonators are electromagnetically coupled by arranging the resonators in the vicinity of the nodal points of the standing wave. Therefore, this antenna apparatus can radiate the electric wave from both of the micro-strip antenna and the resonators, and can receive the electric wave by both of them, whereby it is possible to improve the uniformity of the electric field in the vicinity of the surface of the antenna apparatus, and to achieve stronger intensity of the electric field.

As described above, it is experimentally verified that the antenna apparatus 300 which includes the conductive strip 360 has wider communication area than that of the antenna apparatus 300 which does not include the conductive strip 360 and that the antenna apparatus 300 which includes the conductive strip 360 can read the RFID tags in a broader area than the antenna apparatus 300 which does not include the conductive strip 360. Such an improvement of the antenna apparatus 300 is confirmed by the measured results obtained from the experiment in which the RFID tags are attached to towels.

According to the third embodiment, it is possible to provide the antenna apparatus 300 which can generate the electric field having sufficient uniformity and intensity in the near field by electromagnetically coupling the resonators 13-1 to 13-5 with the microstrip-antenna. The microstrip-antenna includes the conductive line 12 and the grounded electrode 11. Further, it is possible to provide the antenna apparatus 300 which can generate the magnetic field having sufficient intensity around the open end 12B in the near field by electromagnetically coupling the conductive strip 360 with the microstrip-antenna.

Fourth Embodiment

Next, an antenna apparatus according to a fourth embodiment will be described. The antenna apparatus according to the fourth embodiment is different from the antenna apparatus according to the third embodiment in a position of the resonators. Accordingly, hereinafter, the description related to the resonators will be made. The explanation for other components of the antenna apparatus according to the fourth embodiment can be referred to the explanation of corresponding components of the antenna apparatus according to the third embodiment.

Figure 24:
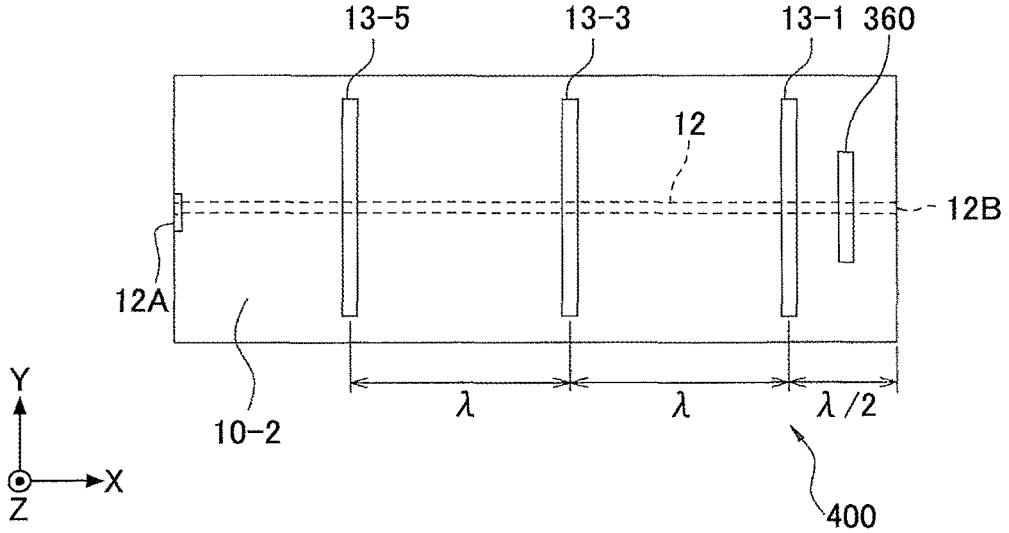
FIG. 24 is a plan view of an antenna apparatus according to a fourth embodiment.

FIG. 24 is a plan view of the antenna apparatus according to the fourth embodiment. In FIG. 24, the same reference numbers are provided to each component of the antenna apparatus 400 according to the fourth embodiment as the reference number of the corresponding component of the antenna apparatus 300 as illustrated in FIG. 19 through FIG. 21.

In the antenna apparatus 400 according to the fourth embodiment, each of the three resonators 13-1, 13-3, and 13-5 is formed with a conductor in the form of a line which has a length substantially equal to the design wavelength, and each of resonators is provided on the surface of the upper layer 10-2 of the substrate. However, it is different from the antenna apparatus 300 according to the third embodiment in that the resonators 13-2 and the resonator 13-4 located at distances of integral multiples of the design wavelength from the open end 12*b* are omitted in the antenna apparatus 400. In other words, the resonators 13-1, 13-3, and 13-5 are provided in positions at the distances of sum of the half design wavelength and the integral multiples of the design wavelength from the open end 12*b* of the micro-strip antenna, respectively. Therefore, the distance between two resonators which are adjacent each other along the conductor 12 is substantially equal to the design wavelength.

In the antenna apparatus 300 according to the third embodiment, each of the resonators 13-1 to 13-5 is separated from the other resonators adjacent thereto at the distance of substantially half design wavelength along with the conductor 12. Therefore, the phases of the current which flows through two adjacent resonators are reversed with each other.

On the other hand, in the antenna apparatus 400 according to the fourth embodiment, since each of the resonators 13-1, 13-3, and 13-5 is separated from the other resonators adjacent thereto at the distance of substantially design wavelength along with the conductor 12, the phases of the current which flows through two adjacent resonators are in-phase. Accordingly, the electric field formed by each resonator can also be strengthened one another.

Figure 25:
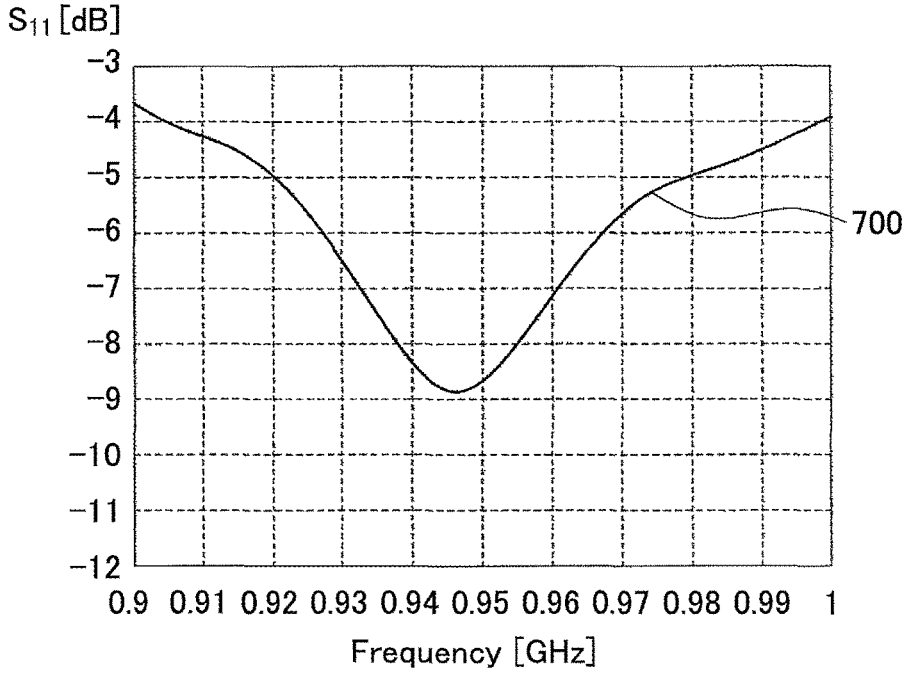
FIG. 25 is a drawing illustrating a simulation result of frequency characteristic of S parameter with respect to the antenna apparatus according to the fourth embodiment.
Figure 26:
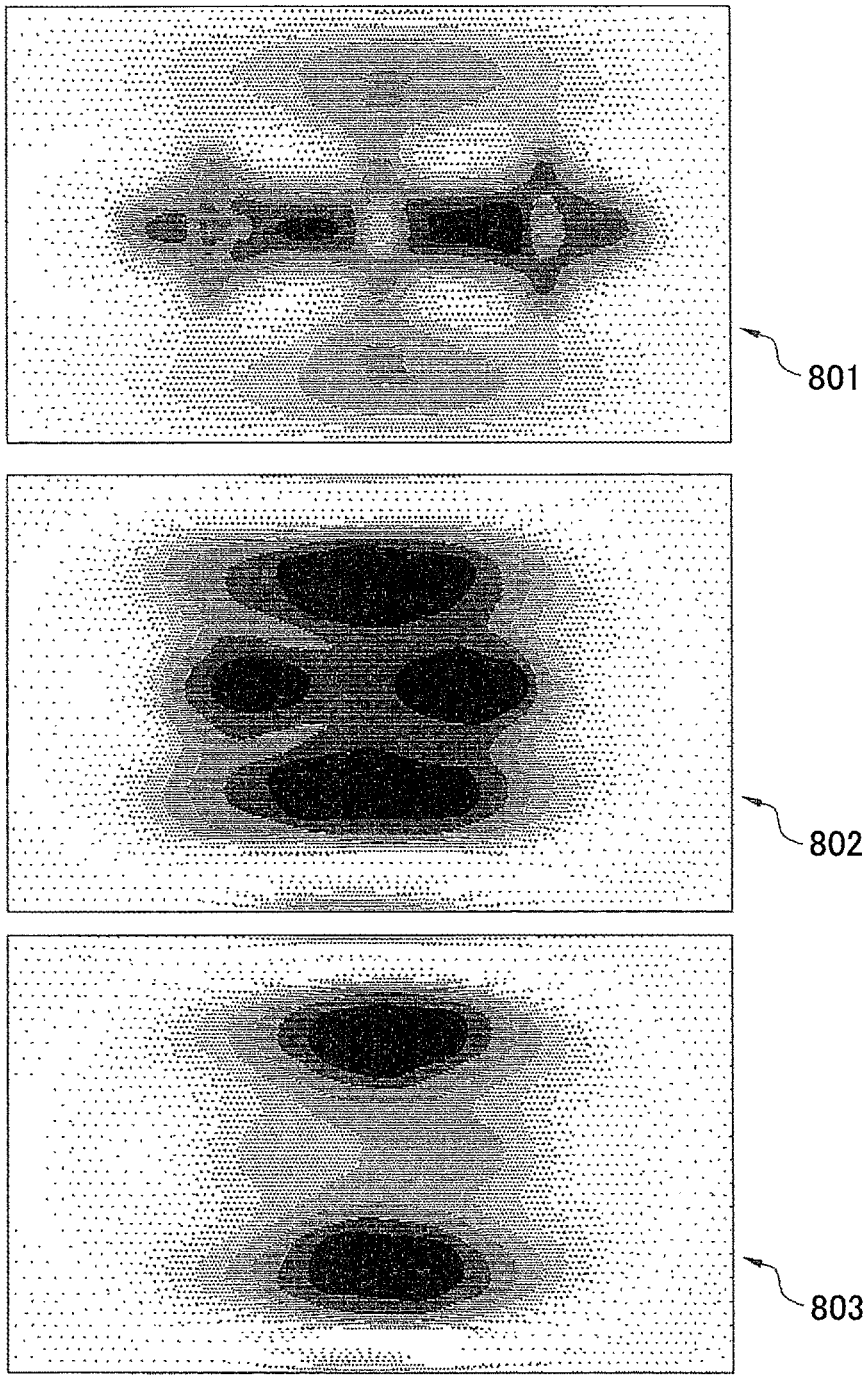
FIG. 26 illustrates simulation results of electric field formed in surface's vicinity of the antenna apparatus according to the fourth embodiment.

FIG. 25 is a drawing illustrating a simulation result of frequency characteristic of S parameter with respect to the antenna apparatus 400. FIG. 26 is drawings illustrating simulation results of electric field formed in surface's vicinity of the antenna apparatus 400. In this simulation, it is assumed that the size and the position of each component of the antenna apparatus 400 are the same as the size and position of corresponding component of the antenna apparatus 300.

Similar to the third embodiment, the frequency characteristics of S11 parameter of the antenna apparatus 400 as illustrated in FIG. 25 are obtained in a condition where the antenna apparatus 400 does not include the conductive strip 360. The distribution of the intensity of the electric field as illustrated in FIG. 26 is obtained in a condition where the antenna apparatus 400 does not include the conductive strip 360.

In FIG. 25, a horizontal axis represents frequency [GHz] and a vertical axis represents value [dB] of S.sub.11 parameter. The characteristics 700 represent the frequency characteristics of the S.sub.11 parameter of the antenna apparatus 400, obtained by a simulation of electromagnetic field according to a finite element method. As illustrated in the characteristics 700, it is found that the S.sub.11 parameter of the antenna apparatus 400 is −6 dB or less, the range providing an indication of antenna characteristics for operation without any difficulty, in 950 MHz to 960 MHz utilized for an RFID system.

In FIG. 26, the distribution chart 801 represents the intensity distribution of the electric field on a plane which is parallel to the surface of the antenna apparatus 400 at a distance of 50 mm above from the surface of the antenna apparatus 400. The distribution chart 802 represents the intensity distribution of the electric field on a plane which is parallel to the surface of the antenna apparatus 400 at a distance of 100 mm above from the surface of the antenna apparatus 400. The distribution chart 803 represents the intensity distribution of the electric field on a plane which is parallel to the surface of the antenna apparatus 400 at a distance of 200 mm above from the surface of the antenna apparatus 400. In each distribution chart, the frequency of the electric wave is 950 MHz. In each distribution chart, the area which has deeper color represents a stronger electric field. As illustrated in the distribution charts 801 to 803, it is found that the electric field is strong not only in the vicinity of the conductor 12 but also in the vicinity of each resonator 13-1, 13-3 and 13-5. Furthermore, it is found that, in the position of 100 mm above from the surface of the antenna apparatus 400, the intensity distribution of the electric field is more uniform in comparison with the electric field formed by the antenna apparatus 300.

Furthermore, the maximum values of the intensities of the electric field at the distances 50 mm, 100 mm, and 200 mm above from the surface of the antenna apparatus 400 are 11.6 V/m, 5.6 V/m and 4.2 V/m, respectively. Those values in respective positions are stronger than the maximum values of the intensities of the electric field about the antenna apparatus 300.

As described above, in the antenna apparatus according to the fourth embodiment, the distance between two resonators adjacent to each other is substantially equal to the design wavelength. Accordingly, the phases of the current which flows through each resonator is in-phase. As a result, the electric fields radiated from respective resonators are strengthened one another, whereby it is possible to improve the uniformity of the electric field in the vicinity of the surface of the antenna apparatus, and to strengthen the intensity of the electric field.

Similar to the third embodiment, it is experimentally verified that the antenna apparatus 400 which includes the conductive strip 360 has wider communication area than that of the antenna apparatus 400 which does not include the conductive strip 360 and that the antenna apparatus 400 which includes the conductive strip 360 can read the RFID tags in a broader area than the antenna apparatus 400 which does not include the conductive strip 360. Such an improvement of the antenna apparatus 400 is confirmed by the measured results obtained from the experiment in which the RFID tags are attached to towels.

According to the fourth embodiment, it is possible to provide the antenna apparatus 400 which can generate the electric field having sufficient uniformity and intensity in the near field by electromagnetically coupling the resonators 13-1, 13-3 and 13-5 with the microstrip-antenna. The microstrip-antenna includes the conductive line 12 and the grounded electrode 11. Further, it is possible to provide the antenna apparatus 400 which can generate the magnetic field having sufficient intensity around the open end 12B in the near field by electromagnetically coupling the conductive strip 360 with the microstrip-antenna.

Fifth Embodiment

Next, an antenna apparatus according to a fifth embodiment will be described. In the antenna apparatus according to the fifth embodiment, the conductor which forms the micro-strip antenna is bent, for example, the conductor may meander, whereby the interval between resonators adjacent to each other is narrowed, in comparison with the antenna apparatus according to the third embodiment. Accordingly, hereinafter, the description related to the conductor and the resonators will be made. The explanation for other components of the antenna apparatus according to the fifth embodiment can be referred to the explanation of corresponding components of the antenna apparatus according to the third embodiment.

Figure 27:
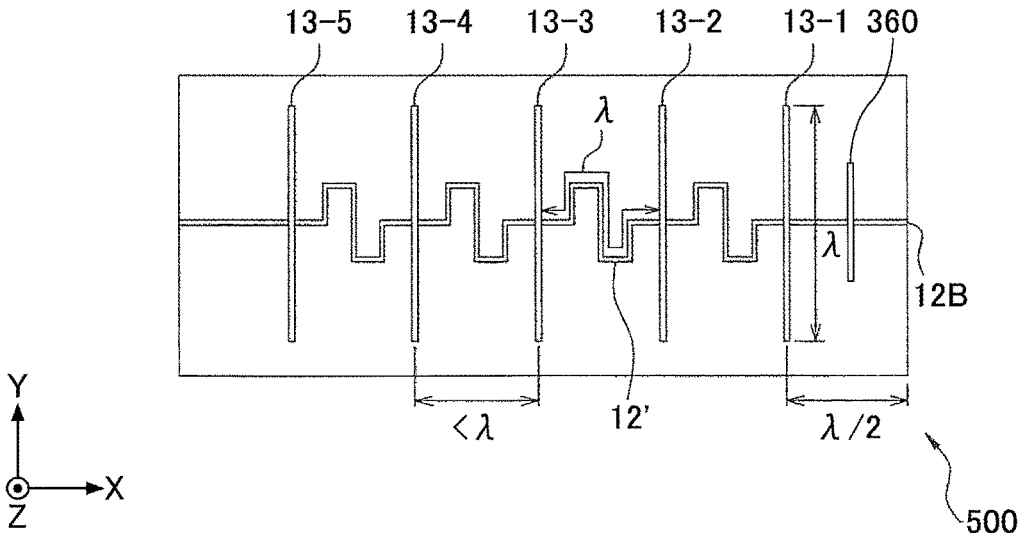
FIG. 27 is a plan view of an antenna apparatus according to a fifth embodiment.

FIG. 27 is a plan view of the antenna apparatus according to the fifth embodiment. In FIG. 27, the same reference numbers are provided to each component of the antenna apparatus 500 according to the fifth embodiment as the reference number of the corresponding component of the antenna apparatus 300 as illustrated in FIG. 19 through FIG. 21.

In the antenna apparatus 500 according to the fifth embodiment, a conductor 12' which forms a part of the micro-strip antenna includes a meander shape, in which the conductor is bent to a right angle, at a plurality of positions between the two resonators adjacent to each other.

In the antenna apparatus 500 according to the fifth embodiment, each of the five resonators 13-1 to 13-5 is formed with a conductor in the form of a line which has a length substantially equal to the design wavelength, and each of resonators is provided on the surface of the upper layer 10-2 of the substrate. Each of the resonators 13-1 to 13-5 is arranged so that the distance along the conductor 12' between two resonators adjacent to each other is substantially equal to the design wavelength. Therefore, the distance in a straight line between two resonators adjacent to each other is shorter than the design wavelength. As a result, the electric waves radiated from respective resonators can be strengthened by one another. Moreover, in this embodiment, the resonator 13-1 which is the nearest to the open end 12*b* of the micro-strip antenna among the resonators 13-1 to 13-5 is preferably arranged at the distance of substantially half design wavelength from the open end 12*b* along the conductor 12', i.e., in the vicinity of the nodal point of the standing wave nearest to the open end 12*b*.

Figure 28:
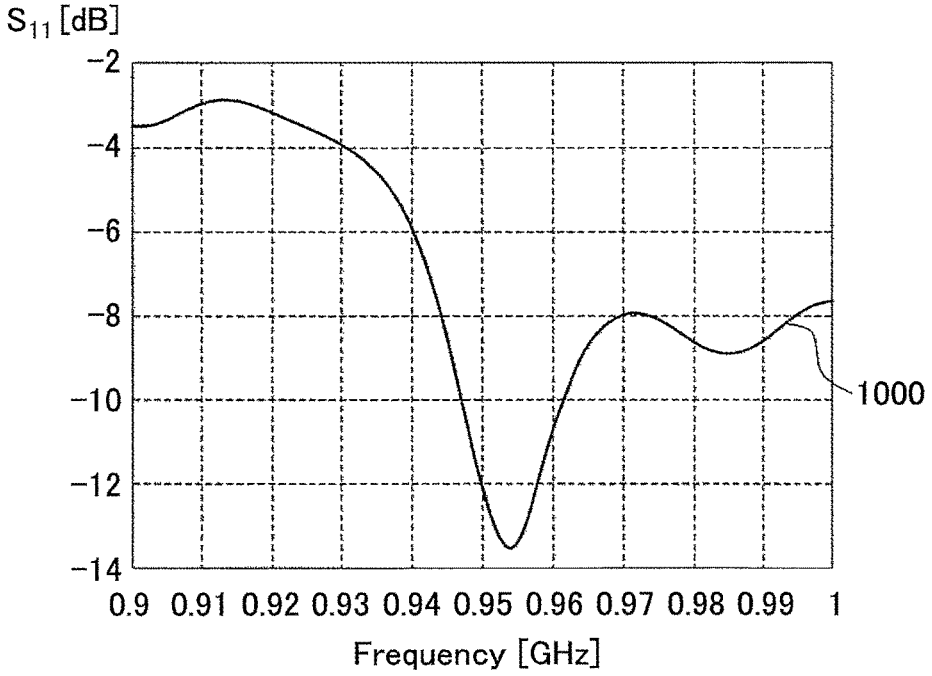
FIG. 28 is a drawing illustrating a simulation result of frequency characteristic of S parameter with respect to the antenna apparatus according to the fifth embodiment.
Figure 29:
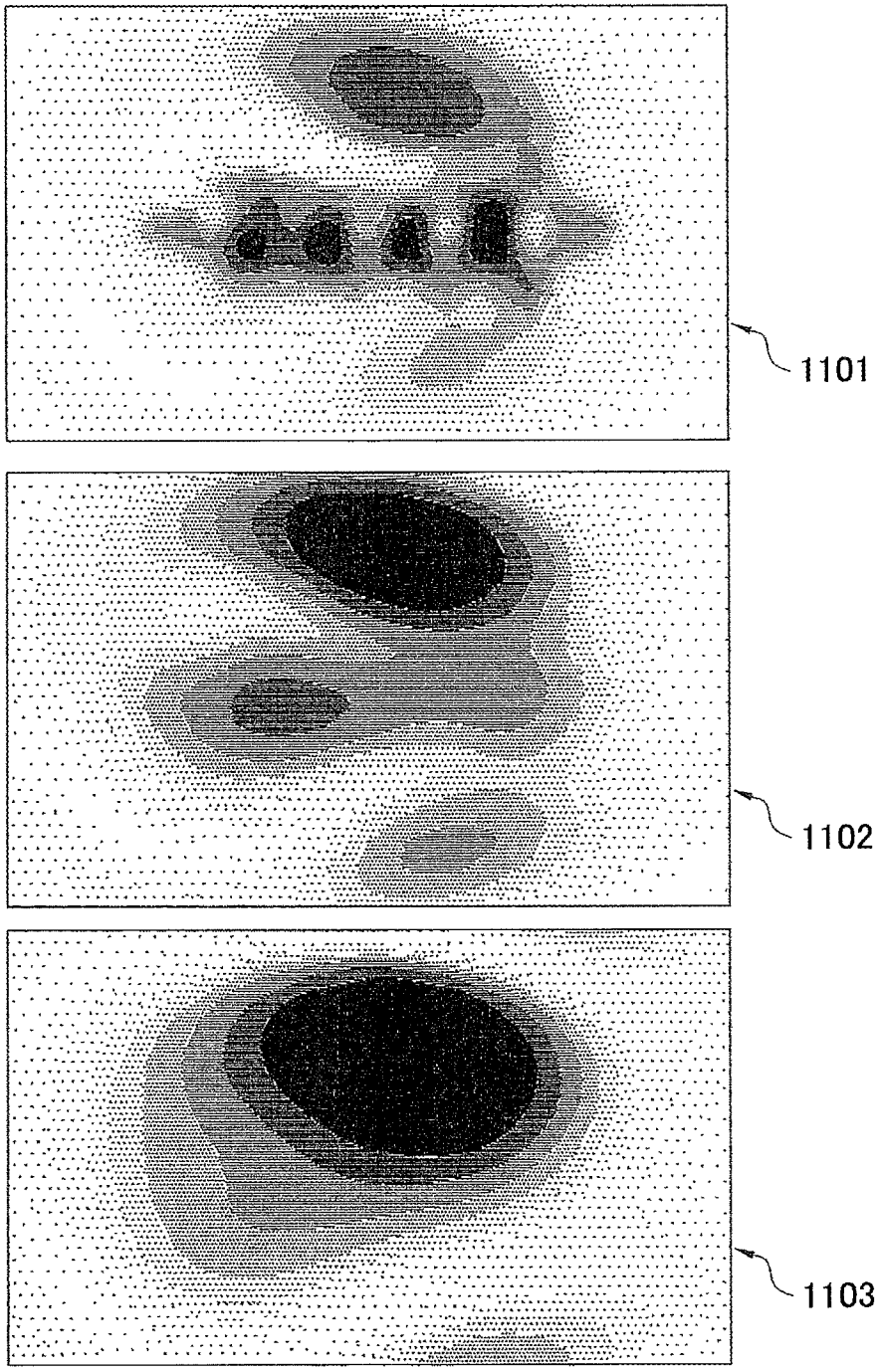
FIG. 29 illustrates simulation results of electric field formed in surface's vicinity of the antenna apparatus according to the fifth embodiment.

FIG. 28 is a drawing illustrating a simulation result of frequency characteristic of S parameter with respect to the antenna apparatus 500. FIG. 29 is drawings illustrating simulation results of electric field formed in surface's vicinity of the antenna apparatus 500. The condition of this simulation is defined as follows. As illustrated in FIG. 27, with respect to sections formed by bending the conductor 12', the length of the longest section which is perpendicular to a longitudinal direction of the conductor 12' is 50 mm, and the length of the each section which is parallel to the longitudinal direction of the conductor 12' and is adjacent to the longest section is 20 mm. Moreover, the distance in a straight line between the center lines of two adjacent resonators is 86 mm so that the length along the conductor 12' between the two adjacent resonators is substantially equal to the design wavelength. Further, the length of the substrate 10 along a longitudinal direction of the conductor 12' is 505 mm. The sizes and the materials of respective components of the antenna apparatus 500 other than those described above are the same as the sizes and the materials which are set in the simulation of the antenna apparatus 300 according to the third embodiment.

Similar to the third and fourth embodiments, the frequency characteristics of S11 parameter of the antenna apparatus 500 as illustrated in FIG. 28 is obtained in a condition where the antenna apparatus 500 does not include the conductive strip 360. The distribution of the intensity of the electric field as illustrated in FIG. 29 is obtained in a condition where the antenna apparatus 500 does not include the conductive strip 360.

In FIG. 28, a horizontal axis represents frequency [GHz] and a vertical axis represents value [dB] of S.sub.11 parameter. The characteristic 1000 represent the frequency characteristic of the S.sub.11 parameter of the antenna apparatus 500, obtained by a simulation of electromagnetic field according to a finite element method.

As illustrated in the characteristics 1000, it is found that the S.sub.11 parameter of the antenna apparatus 500 is −10 dB or less, the range providing an indication of excellent antenna characteristics, in 950 MHz to 960 MHz utilized for an RFID system.

In FIG. 29, the distribution chart 1101 represents the intensity distribution of the electric field on a plane which is parallel to the surface of the antenna apparatus 500 at a distance of 50 mm above from the surface of the antenna apparatus 500. The distribution chart 1102 represents the intensity distribution of the electric field on a plane which is parallel to the surface of the antenna apparatus 500 at a distance of 100 mm above from the surface of the antenna apparatus 500. The distribution chart 1103 represents the intensity distribution of the electric field on a plane which is parallel to the surface of the antenna apparatus 500 at a distance of 200 mm above from the surface of the antenna apparatus 500. In each distribution chart, the frequency of the electric wave is 950 MHz. In each distribution chart, the area which has deeper color represents a stronger electric field. As illustrated in the distribution charts 1101 to 1103, it is found that the electric field is strong not only in the vicinity of the conductor 12' but also in the vicinity of each of resonators 13-1 to 13-5. Furthermore, it is found that, in the position of 100 mm above from the surface of the antenna apparatus 500 and in the position of 200 mm above from the surface thereof, the intensity distribution of the electric field is more uniform in comparison with the electric field formed by the antenna apparatus 300.

Furthermore, the maximum values of the intensities of the electric field at the distances 50 mm, 100 mm, and 200 mm above from the surface of the antenna apparatus 500 are 17.3 V/m, 11.3 V/m and 7.8 V/m, respectively. Those values in respective positions are stronger than the maximum values of the intensities of the electric field about the antenna apparatus 300 or the antenna apparatus 400.

As described above, in the antenna apparatus according to the fifth embodiment, since the conductor 12' includes the meander shape, the length along the conductor 12' between the two adjacent resonators is substantially equal to the design wavelength whereas the distance in a straight line between the two resonators is narrower than the design wavelength. Therefore, in this antenna apparatus, the electric fields radiated from respective resonators can be strengthened by one another. As a result, this antenna apparatus can improve the uniformity of the electric field in the vicinity of the surface of the antenna apparatus, and strengthen the intensity of the electric field in the vicinity of the surface of the antenna apparatus.

Similar to the third and fourth embodiments, it is experimentally verified that the antenna apparatus 500 which includes the conductive strip 360 has wider communication area than that of the antenna apparatus 500 which does not include the conductive strip 360 and that the antenna apparatus 500 which includes the conductive strip 360 can read the RFID tags in a broader area than the antenna apparatus 500 which does not include the conductive strip 360. Such an improvement of the antenna apparatus 500 is confirmed by the measured results obtained from the experiment in which the RFID tags are attached to towels.

According to the third embodiment, it is possible to provide the antenna apparatus 500 which can generate the electric field having sufficient uniformity and intensity in the near field by electromagnetically coupling the resonators 13-1 to 13-5 with the microstrip-antenna. The microstrip-antenna includes the conductive line 12' and the grounded electrode 11. Further, it is possible to provide the antenna apparatus 300 which can generate the magnetic field having sufficient intensity around the open end 12B in the near field by electromagnetically coupling the conductive strip 360 with the microstrip-antenna.

According to modifications of the fifth embodiment, the conductor 12' may be bent in any manner between two adjacent resonators. For example, the conductor 12' may be formed between the two adjacent resonators in a shape of a sine wave, or in a shape of a sawtooth.

Moreover, according to another modification of the fifth embodiment, each resonator may be arranged so that the distance along the conductor which is a part of the micro-strip antenna between the two adjacent resonators is substantially half design wavelength, and the distance in a straight line between the two adjacent resonators is shorter than the half design wavelength.

Sixth Embodiment

Next, an antenna apparatus according to a sixth embodiment will be described. The antenna apparatus according to the sixth embodiment is different from the antenna apparatus according to the fifth embodiment in that each resonator is formed in a convex toward an open end of the conductor, and at least a part of each resonator and a line extending from the power feeding port to the open end of the conductor makes an acute angle. By this means, the antenna apparatus produces the electric field components along a long side direction and the electric field components along a short side direction of the antenna apparatus, respectively. This results in a uniform intensity of the electric field in a plane parallel to the surface of the antenna apparatus, regardless of the direction of the electric field. Hereinafter, a description of the conductor and the resonators will be made. An explanation of other components of the antenna apparatus according to the sixth embodiment can be referred to in the explanation of corresponding components of the antenna apparatus according to the first to fifth embodiments.

Figure 30:
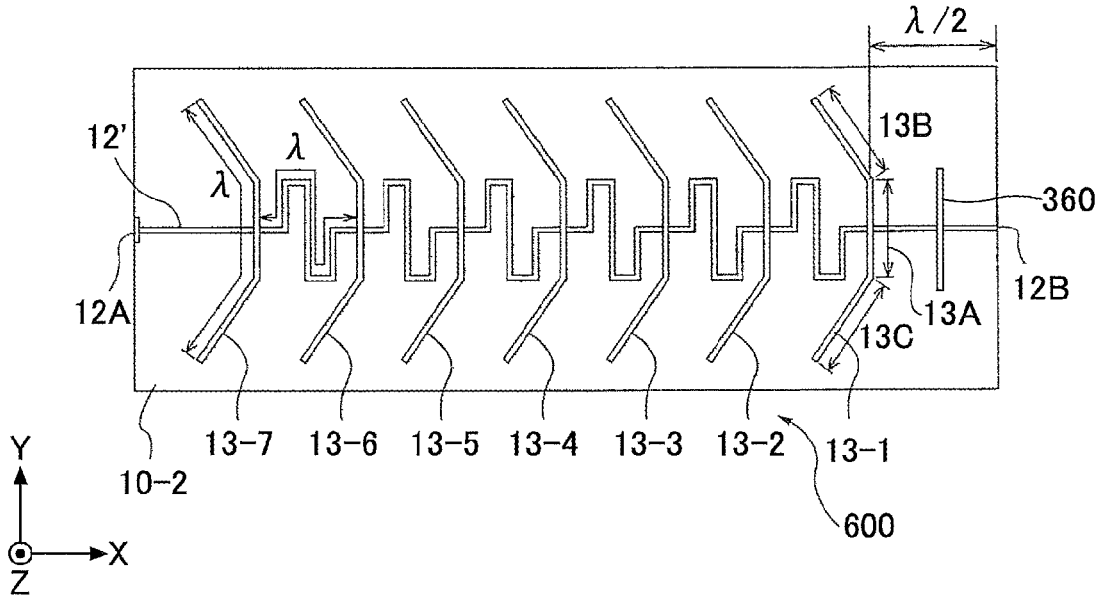
FIG. 30 is a plan view of an antenna apparatus according to a sixth embodiment.

FIG. 30 is a plan view of the antenna apparatus according to the sixth embodiment. In FIG. 30, the same reference numbers are provided to each component of the antenna apparatus 600 according to the sixth embodiment as the reference number of the corresponding component of the antenna apparatus 500 as illustrated in FIG. 27.

In the antenna apparatus 600 according to the sixth embodiment, as is the case in the fifth embodiment, a conductor 12' which forms a part of the micro-strip antenna includes a meander shape, in which the conductor is bent to a right angle at a plurality of positions between the two resonators adjacent to each other. Therefore, the conductor 12' includes a part 121 along the long side direction of the antenna apparatus 600, and a part 122 parallel to the short side direction of the antenna apparatus 600. Therefore, the conductor 12' produces the electric field component parallel to the long side direction of the antenna apparatus 600, and the electric field component parallel to the short side direction of the antenna apparatus 600.

For the sake of simplicity, the long side direction along the surface of the antenna apparatus 600 is referred to as an X-axis direction, and the short side direction along the surface of the antenna apparatus 600 is referred to as a Y-axis direction.

Each of the resonators 13-1 to 13-7 is formed with a conductor in the form of a line which has a length substantially equal to the design wavelength, and is provided on the surface of the upper layer 10-2 of the substrate 10. The resonator 13-1 is arranged at the distance of substantially half design wavelength from the open end 12*b* of the conductor 12' so that the resonator 13-1 is arranged in the vicinity of the nodal point of the standing wave of the current which flows through the conductor 12'. Furthermore, the resonators 13-2 to 13-7 are also arranged so that the distances between two resonators which are adjacent to each other along the conductor 12' are substantially equal to the design wavelength, and the resonators 13-2 to 13-7 are arranged in the vicinity of the nodal point of the standing wave of the current which flows through the conductor 12'.

In the present embodiment, the resonators 13-1 to 13-7 include three elements 13*a* to 13*c* which have straight line shape, respectively. The central element 13*a* crosses a line (hereinafter, referred to as center line for the sake of simplicity), extending from the open end 12*b* to the power feeding port 12*a* of the conductor 12', perpendicular thereto in the middle of the element 13*a*. On the other hand, the elements 13*b* and 13*c* which are located on both sides of the central element 13*a* approach the open end 12*b* of the conductor 12' as approaching the center line, and approach the power feeding port 12*a* as separating from the center line, so that an acute angle may be made with the center line, respectively. As a result, each resonator is formed in a convex form toward the open end 12*b* of the conductor 12'.

Therefore, the electric field produced by each resonator also has, as is the case with an electric field produced by the conductor 12', a component (i.e., a component parallel to the center line) along the X-axis direction, and a component (i.e., a component perpendicular to the center line) along the Y-axis direction. Therefore, in the vicinity of the surface of the antenna apparatus 600, a combination of the intensity of the instant electric field component in the X-axis direction and the intensity of the instant electric field component in the Y-axis direction is also changed according to a change of the phase of the current which flows through the conductor 12' and each resonator, and this results in a change of a direction of the instant electric field. Therefore, the antenna apparatus 600 can uniform the intensity of the electric field regardless of the direction of the electric field. Moreover, forming each resonator in a convex shape toward the open end 12*b* allows a coincidence of the wavelength at which the antenna apparatus 600 resonates, and the wavelength of impedance matching.

Angles made by the elements 13*b* and 13*c* on the both sides of the resonators 13-1 to 13-7 with the center line are preferably determined so that the elements 13*b* and 13*c* do not overlap with the conductor 12'. If the resonators 13-1 to 13-7 overlap with the conductor 12' in a position other than the center line, electromagnetic coupling occurs between the resonators and the conductor 12' at the overlapped position. This results in uneven distribution of the current in the resonators and uneven electric field produced by the resonators.

On the other hand, the larger the angles between the elements 13*b* and 13*c* on the both sides of the resonators 13-1 to 13-7 and the center line are, the stronger the electric field component parallel to the Y-axis direction produced by each resonator is relatively, and the weaker the electric field component parallel to the X-axis direction is relatively. Therefore, the angles between the elements 13*b* and 13*c* on the both sides of the resonators 13-1 to 13-7 and the center line are preferably set so that the intensity of the electric field parallel to the Y-axis direction is substantially equal to the intensity of the electric field parallel to the X-axis direction.

Moreover, the shorter the elements 13*b* and 13*c* on both sides are, the weaker the electric field component parallel to the X-axis direction produced by the resonators 13-1 to 13-7 is. Therefore, the length of the elements 13*b* and 13*c* is also preferably set so that the intensity of the electric field parallel to the Y-axis direction is substantially equal to the intensity of the electric field parallel to the X-axis direction. In the present embodiment, the length of the elements 13*b* and 13*c* is set to substantially one third or more of the design wavelength.

Figure 31A:
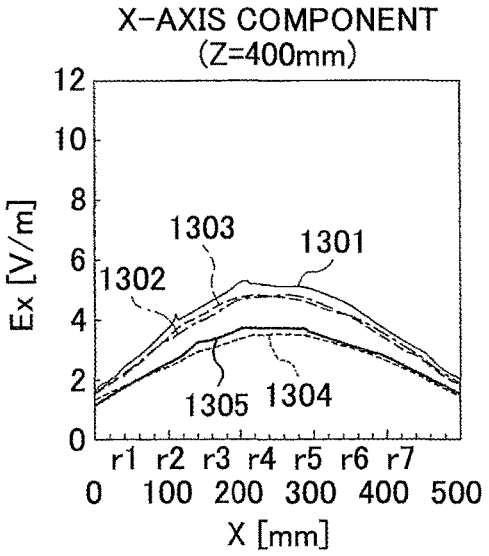
FIG. 31A is a drawing illustrating a simulation result of an intensity of an electric field component parallel to X-axis direction formed in surface's vicinity of the antenna apparatus according to the sixth embodiment.
Figure 31B:
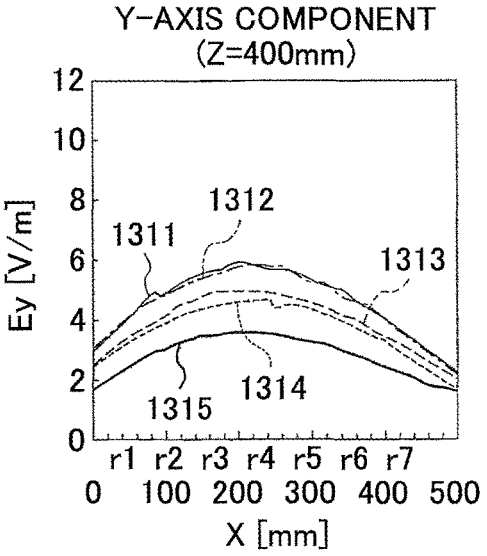
FIG. 31B is a drawing illustrating a simulation result of an intensity of an electric field component parallel to Y-axis direction formed in surface's vicinity of the antenna apparatus according to the sixth embodiment.

FIG. 31A is a drawing illustrating a simulation result of an intensity of an electric field component parallel to X-axis direction formed in surface's vicinity of the antenna apparatus. FIG. 31B is a drawing illustrating a simulation result of an intensity of an electric field component parallel to Y-axis direction formed in surface's vicinity of the antenna apparatus.

The condition of the simulation is defined as follows. The length of the substrate 10 along the X-axis direction is 500 mm, and the length thereof along the Y-axis direction is 200 mm. Moreover, the width of the conductor 12' is 3 mm. The length of the longest part parallel to the Y-axis direction is 61 mm among the bent part of the conductor 12', and the length of the parts which are located on front side and back side of the longest part and are parallel to the X-axis direction are 18 mm, respectively. The distances between two adjacent resonators on the center line are 63 mm so that the length between the two adjacent resonators along the conductor 12' is substantially equal to the design wavelength.

On the other hand, the width of each of resonators 13-1 to 13-7 is 4 mm, and length thereof is 182 mm. The length of the central element 13*a* of the each of resonators 13-1 to 13-7 is 60 mm, and the lengths of the elements 13*b* and 13*c* are 61 mm, respectively. Furthermore, the angle between the elements 13*b*, 13*c*, and the center line is 55 degrees (i.e., the angle between the elements 13*b*, 13*c* and the central element 13*a* is 35 degrees). The size and the material of each component of the antenna apparatus 500 other than the above-described components are the same as the size and the material which are set in the simulation of the antenna apparatus 300 according to the third embodiment.

Figure 32:
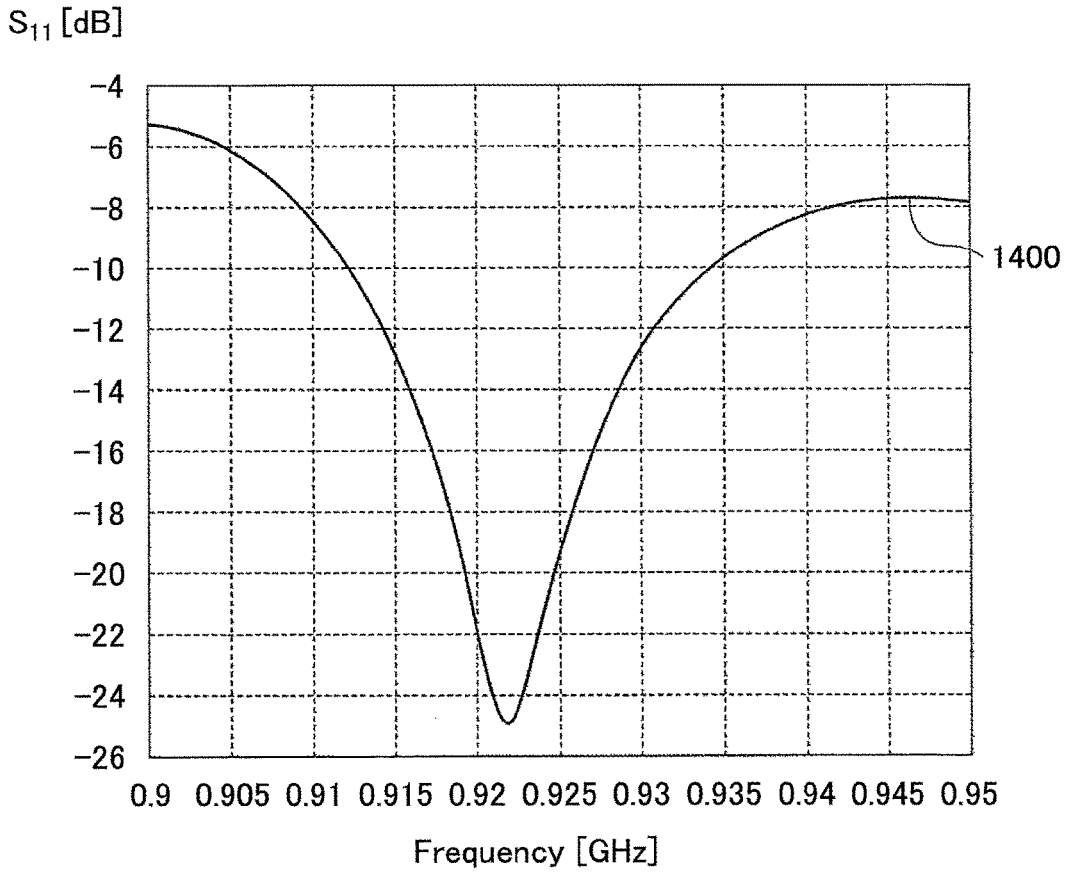
FIG. 32 is a drawing illustrating a simulation result of frequency characteristic of the S parameter with respect to the antenna apparatus according to the sixth embodiment.

Similar to the third to fifth embodiments, the frequency characteristics of S11 parameter of the antenna apparatus 600 as illustrated in FIG. 31 is obtained in a condition where the antenna apparatus 600 does not include the conductive strip 360. The distribution of the intensity of the electric field as illustrated in FIG. 32 is obtained in a condition where the antenna apparatus 600 does not include the conductive strip 360.

In FIG. 31A and FIG. 31B, a horizontal axis expresses the distance from the power feeding port 12*a* along the X-axis direction. On the other hand, a vertical axis expresses the intensity of the electric field. Characteristics 1301 to 1305 represent relations of the distance from the power feeding port 12*a* in the X-axis direction and the intensity of the electric field component parallel to the x-axis, at a distance of 400 mm above from the surface of the antenna apparatus 600, respectively. Among them, the characteristics 1301 represent a relation of the distance from the power feeding port 12*a* and the intensity of electric field component parallel to the X-axis direction, at a position where the distance from the center line in the Y-axis direction is 0 mm. Moreover, the characteristics 1302 and 1303 represent the relationship of the distance from the power feeding port 12*a* and the intensity of electric field component parallel to the X-axis direction, at positions where the distances from the center line in the Y-axis direction are 50 mm and −50 mm, respectively. Furthermore, the characteristics 1304 and 1305 represent the relationship of the distance from the power feeding port 12*a* and the intensity of electric field component parallel to the X-axis direction, at positions where the distances from the center line in the Y-axis direction are 100 mm and −100 mm, respectively. Note that, in FIG. 30, the distance from the center line in the Y-axis direction is represented as positive for upper side of the center line, and is represented as negative for lower side of the center line.

On the other hand, characteristics 1311 to 1315 represent relations of the distance from the power feeding port 12*a* along the X-axis direction and the intensity of the electric field component parallel to the y-axis, at a distance of 400 mm above from the surface of the antenna apparatus 600, respectively. Among them, the characteristics 1311 represent a relation of the distance from the power feeding port 12*a* and the intensity of electric field component parallel to the Y-axis direction at a position where the distance from the center line in the Y-axis direction is 0 mm. Moreover, the characteristics 1312 and 1313 represent the relations of the distance from the power feeding port 12*a* and the intensity of electric field component parallel to the Y-axis direction, at positions where the distances from the center line in the Y-axis direction are 50 mm and −50 mm, respectively. Furthermore, the characteristics 1314 and 1315 represent the relations of the distance from the power feeding port 12*a* and the intensity of electric field component parallel to the Y-axis direction, at positions where the distances from the center line in the Y-axis direction are 100 mm and −100 mm, respectively.

As illustrated in the characteristics 1301 to 1305 and 1311 to 1315, it is found that, at the distance of 400 mm above from the surface of the antenna apparatus 600, the difference between the intensity distribution of the electric field component parallel to the X-axis direction and the intensity distribution of the electric field component parallel to the Y-axis direction is small.

FIG. 32 is a drawing illustrating a simulation result of frequency characteristic of the S parameter with respect to the antenna apparatus 600. In this simulation, it is assumed that the size and the electrical characteristic of each part of the antenna apparatus 600 is the same as the size and the electrical characteristic in the simulation results as illustrated in FIG. 31A and FIG. 31B. In FIG. 32, a horizontal axis expresses frequency [GHz] and a vertical axis expresses value of S11 parameter [dB]. A characteristics 1400 represent the frequency characteristic of the S11 parameter of the antenna apparatus 600 obtained by a simulation of the electromagnetic field according to the finite element method.

As illustrated in the characteristics 1400, it was found that, in the antenna apparatus 600, the S11 parameter is equal to or less than −10 dB, the range providing an indication of excellent antenna characteristics, in 912 MHz to 934 MHz utilized for the RFID system.

When the antenna apparatus 600 communicates with other communication apparatus, such as an RFID tag attached to an article placed on the antenna apparatus 600, the other communication apparatus may face various directions against the antenna apparatus 600. However, according to the present embodiment, the antenna apparatus 600 can make the intensity of the electric field uniform regardless of the direction of the electric field. Accordingly, the antenna apparatus 600 can perform good communication with the other communication apparatus regardless the direction of the antenna of the other communication apparatus.

Similar to the third to fifth embodiments, it is experimentally verified that the antenna apparatus 600 which includes the conductive strip 360 has wider communication area than that of the antenna apparatus 600 which does not include the conductive strip 360 and that the antenna apparatus 600 which includes the conductive strip 360 can read the RFID tags in a broader area than the antenna apparatus 600 which does not include the conductive strip 360. Such an improvement of the antenna apparatus 600 is confirmed by the measured results obtained from the experiment in which the RFID tags are attached to towels.

According to the fourth embodiment, it is possible to provide the antenna apparatus 600 which can generate the electric field having sufficient uniformity and intensity in the near field by electromagnetically coupling the resonators 13-1 to 13-7 with the microstrip-antenna. The microstrip-antenna includes the conductive line 12' and the grounded electrode 11. Further, it is possible to provide the antenna apparatus 600 which can generate the magnetic field having sufficient intensity around the open end 12B in the near field by electromagnetically coupling the conductive strip 360 with the microstrip-antenna.

Figure 33:
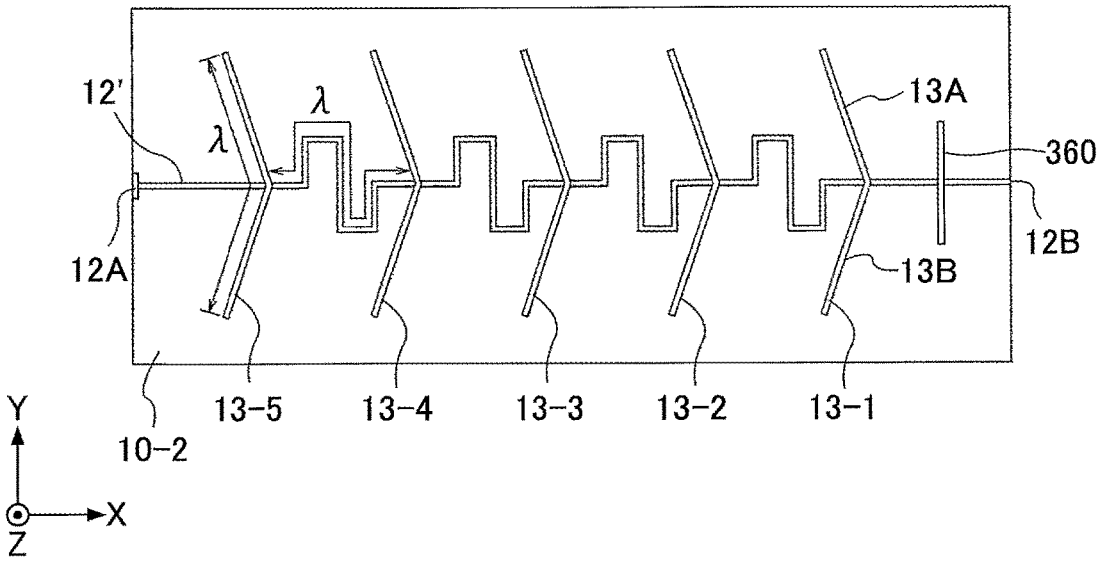
FIG. 33 is a plan view of an antenna apparatus according to a modification of the sixth embodiment.

FIG. 33 is a plan view of an antenna apparatus according to a modification of the sixth embodiment.

Also in the present modification, each of the resonators 13-1 to 13-5 is formed with a conductor in the form of a line which has a length substantially equal to the design wavelength, and each of resonators is provided on the surface of the upper layer 10-2 of the substrate. Each of the resonators 13-1 to 13-5 is arranged so that the distance between two resonators adjacent to each other along the conductor 12' is substantially equal to the design wavelength.

In the present modification, each of the resonators 13-1 to 13-5 includes two elements 13*a* and 13*b* which have straight line shape, and are connected at a position in which the elements overlap with the center line extending from the open end 12*b* to the power feeding port 12*a* of the conductor 12'. The elements 13*a* and 13*b* are symmetrical to the center line, and are formed to make an acute angle with the center line so that the elements are most close to the open end 12*b* at the position in which the elements overlap with the center line and approach the power feeding port 12*a* as separating from the center line. Therefore, also in the present modification, the resonators 13-1 to 13-5 are formed in the convex shape toward the open end 12*b* of the conductor 12', respectively.

Figure 34A:
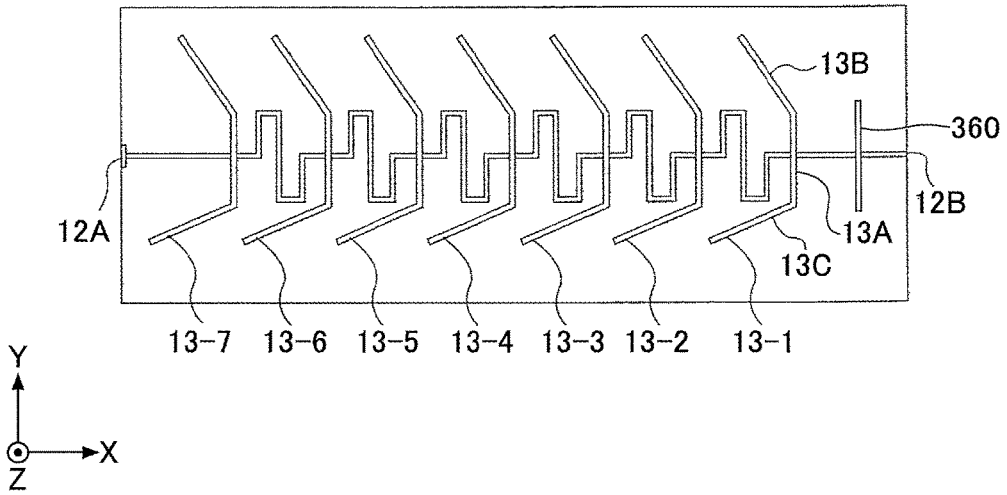
FIG. 34A is a plan view of the antenna apparatus according to further modification of the sixth embodiment.
Figure 34B:
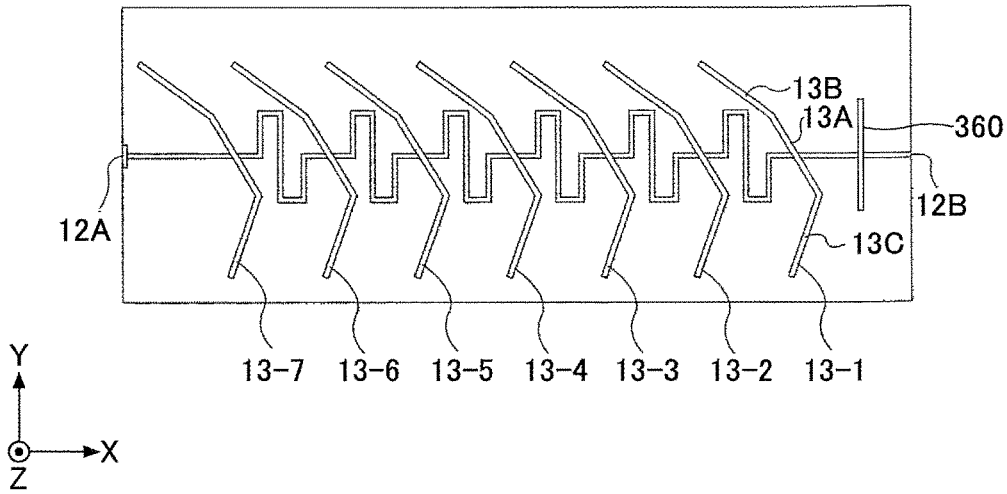
FIG. 34B is a plan view of the antenna apparatus according to further modification of the sixth embodiment.

FIG. 34A and FIG. 34B are plan views of the antenna apparatus according to further modification of the sixth embodiment, respectively. In the modification as illustrated in FIG. 34A and FIG. 34B, the shape and direction of each resonator are different from the antenna apparatus 600 as illustrated in FIG. 30. In the modification as illustrated in FIG. 34A, respective angles made by the two elements 13*b* and 13*c* on the both sides of the resonators 13-1 to 13-7 and the central element 13*a* are different each other. Specifically, the angle between the element 13*b* and the central element 13*a* is larger than the angle between the element 13*c* and the central element 13*a*. Accordingly, each resonator is asymmetrical to the center line extending from the power feeding port 12*a* to the open end 12*b*.

Moreover, in the modification as illustrated in FIG. 34B, each resonator is arranged with a tilt to the center line so that the angle between the centerline extending from the power feeding port 12*a* to the open end 12*b*, and the central element 13*a* of each resonator 13-1 to 13-7 is the acute angle. Accordingly, in the present modification, an angle between the element 13*b* on one side of the resonator and the center line is smaller than an angle between the element 13*c* on another side and the center line. Accordingly, each resonator is asymmetrical to the center line. In both modifications, each resonator is formed in the convex shape toward the open end 12*b* of the conductor 12', and the angle between at least a part of the resonator and the center line is made an acute angle. Therefore, as illustrated in FIG. 34A and FIG. 34B, even when each resonator is formed so as to be asymmetrical to the center line, each resonator can produce the electric field component of the X-axis direction, and the electric field component of the Y-axis direction.

Figure 35:
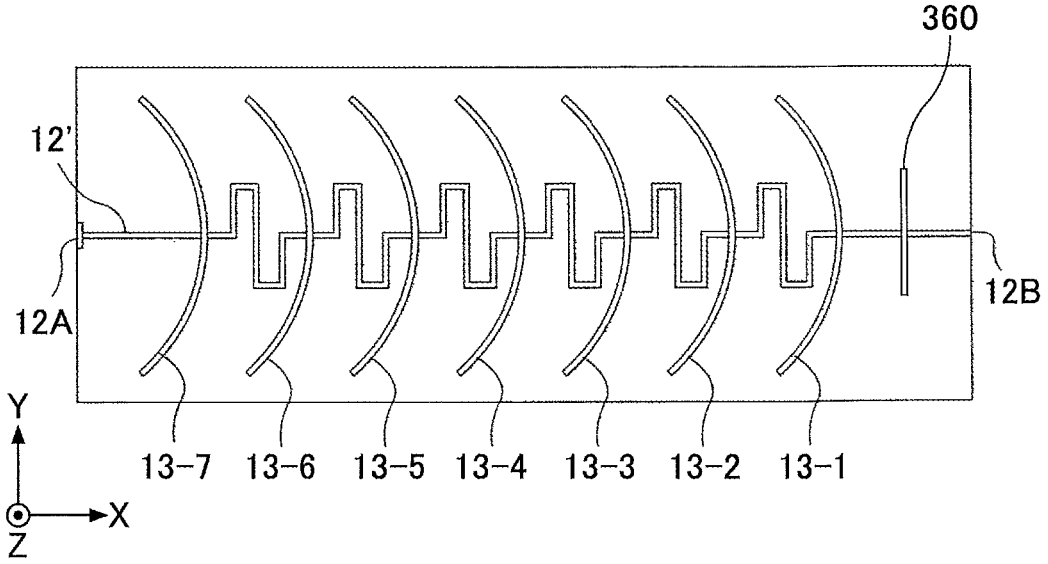
FIG. 35 is a plan view of an antenna apparatus according to a further modification of the sixth embodiment.

FIG. 35 is a plan view of an antenna apparatus according to a further modification of the sixth embodiment. In this modification, the shape of each resonator is different from the resonator in the antenna apparatus 600 as illustrated in FIG. 30. In this modification, the resonators 13-1 to 13-7 are formed in arc-like shape. Also in this modification, each resonator is formed in the convex shape toward the open end 12*b* of the conductor 12', and is arranged so that the middle point of each resonator crosses the conductor 12'. Therefore, since the angle between the resonator and the line extending from the power feeding port 12*a* to the open end 12*b* is an acute angle except for the middle point of the resonator, each resonator can produce the electric field component parallel to the X-axis direction, and the electric field component parallel to the Y-axis direction. Therefore, the antenna apparatus 600 according to this modification can uniform the intensity of the electric field regardless of the direction of the electric field. Consequently, this antenna apparatus enables communication with the other communication apparatus, regardless the direction of the antenna of the other communication apparatus, such as the RFID tag.

Note that, also in these modifications of the sixth embodiment, it is preferable that each resonator does not overlap with the meandering shape part of the conductor, in order to avoid uneven distribution of the current in the resonator.

Figure 36A:
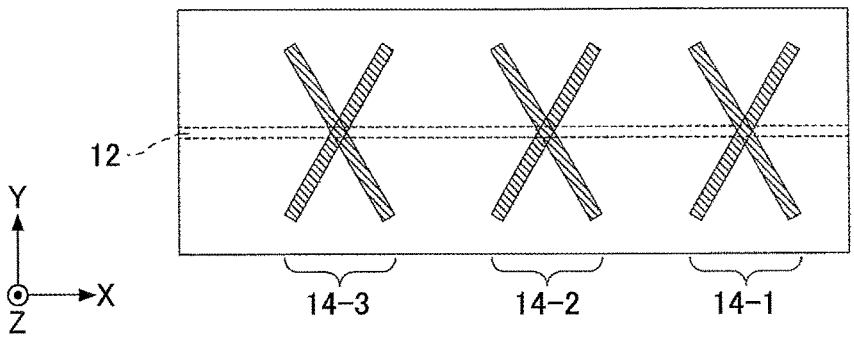
FIG. 36A is a drawing illustrating shapes of resonators according to other embodiments.
Figure 36B:
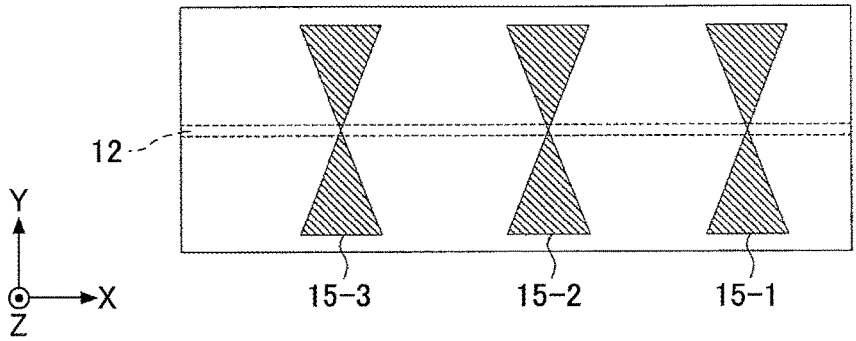
FIG. 36B is a drawing illustrating shapes of resonators according to other embodiments.
Figure 36C:
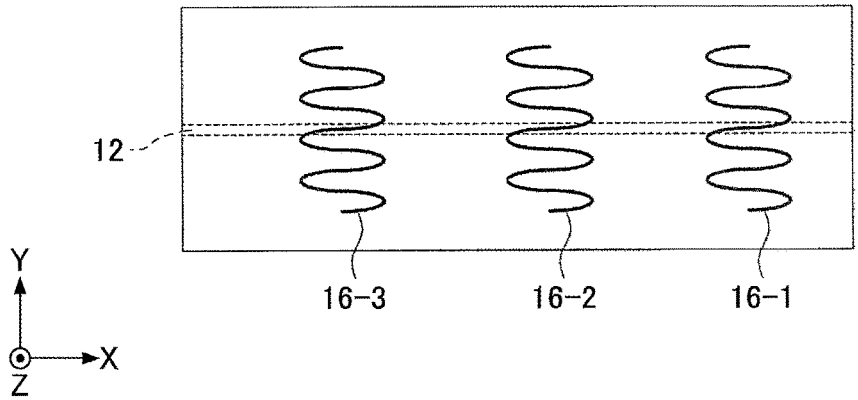
FIG. 36C is a drawing illustrating shapes of resonators according to other embodiments.

Furthermore, according to modifications of each of the above-described embodiments, each resonator may have a shape other than the form of a line. FIG. 36A to FIG. 36C are drawings illustrating shapes of the resonators according to other embodiments, respectively. In each modification, each resonator is arranged in the vicinity of the nodal point of the standing wave of the current which flows through the micro-strip antenna, i.e., in the vicinity of any of the positions at the distance of half design wavelength and distances of integral multiples thereof from the open end.

In an example as illustrated in FIG. 36A, the resonators 14-1 to 14-3 include the two conductors in the form of lines arranged in the shape of an X character. In this example, the two conductors which form the resonator also have a length substantially equal to the design wavelength. Each resonator is arranged so that an intersection of the two conductors which form the resonator is located right above the conductor 12.

In an example as illustrated in FIG. 36B, the resonators 15-1 to 15-3 have a bow-tie-like shape. Each of the resonators 15-1 to 15-3 is arranged so that the part at which the width along the longitudinal direction of the conductor 12 is minimum is located above the conductor 12.

In an example as illustrated in FIG. 36C, the resonators 16-1 to 16-3 include a meandering shape, respectively. In this case, each of the resonators 16-1 to 16-3 is designed so that the length along the meandering conductor is substantially equal to the design wavelength. Each resonator is arranged so that a middle point of the resonator is located above the conductor 12. Moreover, the shapes of respective resonators may differ with each other. For example, if an antenna apparatus includes three resonators, one of the resonators may be a conductor in the form of a line as the resonator 13-1 as illustrated in FIG. 21, another may be a conductor in the form of X character as illustrated in FIG. 36A, and still another may be a conductor in the form of a bow tie as illustrated in FIG. 36B.

According to yet another modifications, each resonator may be arranged so that the longitudinal direction of the resonator and the longitudinal direction of the conductor which is a part of the micro-strip antenna take an acute angle.

In any of the embodiments and their modifications, one of resonators is preferably arranged in the vicinity of the position at the distance of the half design wavelength from the open end of the micro-strip antenna, i.e., in the vicinity of the nodal point nearest to the open end among the nodal points of the standing wave of current which flows through the micro-strip antenna. This is because the electric field in the vicinity of the nodal point which is nearest to the open end is stronger than the electric field in the vicinity of other nodal points, and therefore the resonator arranged in the vicinity of the nodal point can be strongly electromagnetically coupled with the micro-strip antenna.

The descriptions of the antenna apparatus of exemplary embodiments have been provided heretofore. The present invention is not limited to these embodiments, but various variations and modifications may be made without departing from the scope of the present invention.

So far, the preferred embodiments and modification of the antenna apparatuses are described. However, the invention is not limited to those specifically described embodiments and the modification thereof, and various modifications and alteration may be made within the scope of the inventions described in the claims.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention.

Although the embodiments of the present invention have been described in detail, it should be understood that the various changes, substitutions, and alterations could be made hereto without departing from the spirit and scope of the invention.

What is claimed is:

1. An antenna apparatus comprising:

a first dielectric layer having a rectangular shape in plan view;

a ground plane configured to be disposed on a first surface of the first dielectric layer;

a conductive line configured to have a first end and a second end and to be disposed on a second surface of the first dielectric layer, the first end being a feeding point, the second end being an open end or a short end connected to the ground plane;

a second dielectric layer configured to have a shape corresponding to the first dielectric layer and to be disposed on the second surface of the first dielectric layer in a state where the conductive line is sandwitched between the first dielectric layer and the second dielectric layer, the second dielectric layer having a first surface facing toward the first dielectric layer and a second surface opposite to the first surface;

a plurality of first conductive elements configured to be disposed on the second surface of the second dielectric layer so that the first conductive elements intersect with the conductive line at a plurality of first positions corresponding to nodes of a standing wave of current flowing through the conductive line in plan view, respectively, the first conductive elements having third ends and fourth ends, respectively, the third ends being located on a first side with respect to the conductive line in plan view, the fourth ends being located on a second side with respect to the conductive line in plan view; and one or more second conductive elements configured to be disposed on the second surface of the second dielectric layer so that the one or more second conductive elements intersect with the conductive line in plan view at one or more second positions corresponding to one or more antinodes of the standing wave between the second end and the first position which is closest to the second end among the first positions, respectively.

2. The antenna apparatus as claimed in claim 1, wherein each of the first conductive elements is electromagnetically coupled with the conductive line and constitutes a first resonator.

3. The antenna apparatus as claimed in claim 1, wherein a length between the third end and the fourth end of each of the first conductive elements is set to a length corresponding to a single wavelength at a resonant frequency.

4. The antenna apparatus as claimed in claim 1, wherein the second end of the conductive line is the open end, a length between the second end of the conductive line and each of the first positions corresponds to a designated length obtained by multiplying an integer number by a half wavelength at a resonant frequency.

5. The antenna apparatus as claimed in claim 4, wherein the designated length is obtained by multiplying an odd number by the half wavelength at the resonant frequency.

6. The antenna apparatus as claimed in claim 1, wherein the second end of the conductive line is the short end, a length between the second end of the conductive line and each of the first positions corresponds to a designated length obtained by multiplying an integer number by a half wavelength at a resonant frequency and by subtracting a quarter wavelength at the resonant frequency from a multiplied result of the integer number and the half wavelength.

7. The antenna apparatus as claimed in claim 6, wherein the designated length is obtained by multiplying an odd number by the half wavelength at the resonant frequency and by subtracting the quarter wavelength from the multiplied result.

8. The antenna apparatus as claimed in claim 1, wherein the first conductive element includes a first line and two second lines, the first line being configured to extend from the first position, the second lines being configured to be connected to both ends of the first line, respectively, and to extend in directions different from the direction of the first line, and wherein the third end is a fore end of one of the second lines and the fourth end is a fore end of the other of the second lines.

9. The antenna apparatus as claimed in claim 8, wherein the first conductive element further includes third lines connected to the fore ends of the second lines.

10. The antenna apparatus as claimed in claim 8, wherein the second lines are formed in tapered shapes that spread from connecting portions between the first line and the second line in plan view.

11. The antenna apparatus as claimed in claim 1, wherein the first conductive elements are bent or rounded toward the feeding point from the first positions in plan view, respectively.

12. The antenna apparatus as claimed in claim 1, wherein rounded degrees, bent degrees or lengths of the first conductive elements are different from each other.

13. The antenna apparatus as claimed in claim 1, wherein the one or more second conductive elements are coupled with the conductive line by magnetic field and constitute one or more second resonators, respectively, and wherein the second conductive element has a fifth end and a sixth end, the fifth end being located on the first side with respect to the conductive line in plan view, the sixth end being located on the second side with respect to the conductive line in plan view.

14. The antenna apparatus as claimed in claim 1, wherein each of one or more lengths between the fifth ends and the sixth ends of the one or more second conductive elements corresponds to a length obtained by multiplying an integer number by a half wavelength at a resonant frequency.

15. The antenna apparatus as claimed in claim 1, wherein the one or more second conductive elements intersect with the conductive line in a manner where one or more midpoints of the one or more second conductive elements in longitudinal direction overlap with the conductive line.

16. The antenna apparatus as claimed in claim 1, wherein the one or more second conductive elements have one or more conductive patterns that are symmetrical with respect to the one or more second positions in plan view, respectively.

17. The antenna apparatus as claimed in claim 1, wherein the one or more second conductive elements have one or more patterns that are rounded or bent toward the conductive line in plan view, respectively.

18. The antenna apparatus as claimed in claim 1, wherein the conductive line has a meander shape between the feeding point and the second end of the conductive line in plan view.

19. The antenna apparatus as claimed in 18, wherein the meander shape is a rounded meander shape.

20. An antenna apparatus comprising:

a first dielectric layer having a rectangular shape in plan view;

a ground plane configured to be disposed on a first surface of the first dielectric layer;

a conductive line configured to have a first end and a second end and to be disposed on a second surface of the first dielectric layer, the first end being a feeding point, the second end being an open end or a short end connected to the ground plane;

a second dielectric layer configured to have a shape corresponding to the first dielectric layer and to be disposed on the second surface of the first dielectric layer in a state where the conductive line is sandwitched between the first dielectric layer and the second dielectric layer, the second dielectric layer having a first surface facing toward the first dielectric layer and a second surface opposite to the first surface a plurality of first conductive elements configured to be disposed on the second surface of the second dielectric layer so that the first conductive elements intersect with the conductive line at a plurality of first positions corresponding to nodes of a standing wave of current flowing through the conductive line in plan view, respectively, the first conductive elements having third ends and fourth ends, respectively, the third ends being located on a first side with respect to the conductive line in plan view, the fourth ends being located on a second side with respect to the conductive line in plan view; and one or more second conductive elements configured to be insulated from the conductive line and to be disposed on a surface different from the second surface of the second dielectric layer so that the one or more second conductive elements intersect with the conductive line in plan view at one or more second positions corresponding to one or more antinodes of the standing wave between the second end and the first position which is closest to the second end among the first positions, respectively.

21. The antenna apparatus as claimed in claim 1, wherein a plurality of first lines of the plurality of the first conductive elements extend in the same direction with each other in plan view.

22. The antenna apparatus as claimed in claim 21, wherein the plurality of first lines intersect with the conductive line at right angle in plan view.

23. The antenna apparatus as claimed in claim 21, wherein the plurality of first lines extend in a direction orthogonal to a direction in which the conductive line extends between the first end and the second end in plan view.

* * * * *